US007549966B2

(12) United States Patent
Fujii et al.

(10) Patent No.: US 7,549,966 B2
(45) Date of Patent: Jun. 23, 2009

(54) MASSAGING APPARATUS AND FOREARM MASSAGER

(75) Inventors: Yasuo Fujii, Osaka (JP); Nichimu Inada, Osaka (JP)

(73) Assignee: Family Co., Ltd., Osaka (JP)

( * ) Notice: Subject to any disclaimer, the term of this patent is extended or adjusted under 35 U.S.C. 154(b) by 257 days.

(21) Appl. No.: 10/527,535

(22) PCT Filed: Sep. 3, 2003

(86) PCT No.: PCT/JP03/11226

§ 371 (c)(1),
(2), (4) Date: May 26, 2005

(87) PCT Pub. No.: WO2004/024054

PCT Pub. Date: Mar. 25, 2004

(65) Prior Publication Data

US 2006/0142676 A1 Jun. 29, 2006

(30) Foreign Application Priority Data

| | | |
|---|---|---|
| Sep. 9, 2002 | (JP) | 2002-262689 |
| Dec. 12, 2002 | (JP) | 2002-360376 |
| Dec. 27, 2002 | (JP) | 2002-379266 |
| Jul. 3, 2003 | (JP) | 2003-270694 |
| Aug. 11, 2003 | (JP) | 2003-291342 |

(51) Int. Cl.
*A61H 15/00* (2006.01)
*A61H 23/00* (2006.01)

(52) U.S. Cl. ..... 601/133; 601/149; 601/152

(58) Field of Classification Search ..... 601/90, 601/92, 93, 94, 96, 99, 100, 101, 103, 133, 601/148, 151, 149, 152
See application file for complete search history.

(56) References Cited

U.S. PATENT DOCUMENTS

| | | | | |
|---|---|---|---|---|
| 1,354,248 | A * | 9/1920 | Gardner | 601/102 |
| 6,190,339 | B1 | 2/2001 | Imazaike et al. | |
| 6,491,652 | B1 * | 12/2002 | Hata et al. | 601/151 |
| 6,585,668 | B2 | 7/2003 | Nissim | |

FOREIGN PATENT DOCUMENTS

| | | |
|---|---|---|
| JP | SHO. 52-28517 | 7/1977 |

(Continued)

OTHER PUBLICATIONS

European Patent Office, Supplementary European Search Report of EP03795280, Mar. 14, 2008, EP (1 page).

*Primary Examiner*—Danton DeMille
(74) *Attorney, Agent, or Firm*—Alleman Hall McCoy Russell & Tuttle LLP

(57) ABSTRACT

The present invention is aimed at providing a chair-like massaging apparatus and a forearm massager for use with the chair-like massaging apparatus, which are capable of massaging a forearm of a user as desired and allow the user to take a free posture because of absence of an arm obstructing part in an upper portion of an armrest when the forearm is not to be massaged.

To this end, the massaging apparatus of the present invention is configured such that an arm rest (5) configured to support a forearm of the user is provided with a detachable member (38) that is movable along a guide rail (37) and the detachable member (38) is provided with a fitting groove (39). A forearm massager (7) configured to be capable of giving pressure stimulation to the forearm with the forearm of the user sandwiched between the fix and support portion (46) and the pressing portion (47) is provided with a fitting protrusion (40) fitted in the fitting groove (39). By removably fitting the fitting protrusion (40) into the fitting groove (39), the forearm massager (7) is removably attached to the armrest (5).

5 Claims, 51 Drawing Sheets

FOREIGN PATENT DOCUMENTS

| | | | | |
|---|---|---|---|---|
| JP | 10-243981 | | | 9/1998 |
| JP | 10243981 | | | 9/1998 |
| JP | 10-263029 | | | 10/1998 |
| JP | 2000-051301 | | | 2/2000 |
| JP | 2000167001 | A | * | 6/2000 |
| JP | 2000-288050 | | | 10/2000 |
| JP | 2001-025497 | | | 1/2001 |
| JP | 2001-204776 | | | 7/2001 |
| JP | 2001-204777 | | | 7/2001 |
| JP | 2001-333951 | | | 12/2001 |
| JP | 2002-143249 | | | 5/2002 |
| TW | 415241 | | | 12/2000 |
| TW | 497422 | | | 8/2002 |

* cited by examiner

MASSAGING APPARATUS AND FOREARM MASSAGER

TECHNICAL FIELD

The present invention relates to a massaging apparatus configured to massage a forearm of a user and a forearm massager for use with the massaging apparatus.

BACKGROUND ART

One of conventional chair type massaging apparatuses by which a forearm of a user can be massaged is disclosed in Japanese Laid-Open Publication No. 2001-204776. The massaging apparatus disclosed in the publication has, at the upper part of the armrest, an arm holding portion comprising a holding wall portion forming a U-shaped concave portion. This holding wall portion includes an air bag. Compressed air is supplied to or exhausted from the air bag in each holding wall portion so that the air bag is expanded or contracted. As a result, an arm (forearm) of the user inserted into the concave portion of the holding wall portion is massaged by providing pressure and releasing the pressure to the arm in a sandwiching manner.

Another conventional massaging apparatus is disclosed in Japanese Laid-Open Publication No. S52-28517. This massaging apparatus has a fixation frame configured to support a leg portion or an arm portion or the like of the user (the following section will describe a case of the leg portion) and a movable frame coupled to both ends of the fixation frame in a hinged manner. The fixation frame and the movable frame are connected to both ends of a cylinder. This cylinder can be driven to open or close the fixation frame and the movable frame. The fixation frame and the movable frame are configured to have a concavity so as to hold the leg portion of the user. A part at which the fixation frame is opposed to the movable frame has a finger pressure tube as an accordion-like air bag. Such a massaging apparatus has, at the tip end of the finger pressure tube, a finger pressure head. The respective finger pressure tube is elongated to allow the finger pressure head to have a contact with the leg portion of the user so that the leg portion receives pressure stimulation.

The fixation frame and the movable frame can be configured so as to be moved, in an integrated manner, in the longitudinal direction of the leg portion of the user, thereby changing a position at which the finger pressure is provided.

The construction as described above allows this massaging apparatus to use the finger pressure head to massage the leg portion of the user while the leg portion is being held. This prevents the leg portion from escaping in the direction along which the pressure by the finger pressure head is applied when the finger pressure head presses the leg portion. Thus, the pressure stimulation by the finger pressure head can be reliably given to the leg portion of the user.

However, the above massaging apparatus disclosed in Japanese Laid-Open Publication No. 2001-204776 has a problem as described below. Specifically, when a user sits on the massaging apparatus, his or her forearm is inserted to the holding wall portion provided at the upper part of the armrest. The holding wall portion cannot be detached from the armrest. This caused a problem in which, even when the massaging apparatus is used as a mere comfort chair or when the massaging apparatus is not used for the purpose of massaging the forearm (e.g., when the massaging apparatus is used for massaging a body member other than the forearm), the user was required to insert the forearm to the arm holding portion.

The insertion of the forearm to the arm holding portion as described above caused limitation on the posture of the user, making it difficult for the user to take a desired posture due to the arm holding portion as an obstacle.

The above massaging apparatus disclosed in Japanese Laid-Open Publication No. S52-28517 had a similar problem because it has a construction in which the leg portion or the arm portion of the user is retained by the fixation frame and the movable frame that cannot be detached.

Furthermore, the massaging apparatus disclosed in Japanese Laid-Open Publication No. S52-28517 had a problem in which, due to a construction in which a cylinder for rotating a rotation portion and each finger pressure head includes a finger pressure tube as an air bag so that the finger pressure tube is elongated to move the finger pressure head, a large number of actuators (cylinder, finger pressure tube) must be provided, thus causing the construction to be complicated.

Furthermore, the massaging apparatus disclosed in Japanese Laid-Open Publication No. S52-28517 had a problem in which, due to the construction in which, a fixation frame for supporting a portion to be massaged of a user (e.g., leg portion, arm portion) is moved with a movable frame in an integrated manner, a position at which the portion to be massaged is supported is changed when the finger pressure is provided while moving the fixation frame and the movable frame, which makes it impossible for the portion to be massaged to be reliably supported.

The fixation frame supports the portion to be massaged with a small area and thus is prevented from being used as a footrest or an armrest, for example. The fixation frame requires a region in which it can move, thus preventing an additional component such as a footrest or an armrest from being additionally provided.

DISCLOSURE OF THE INVENTION

The present invention has been made in view of the above. It is an objective of the present invention to provide a massaging apparatus and a forearm massager for use with the massaging apparatus. The massaging apparatus can massage, as desired, the forearm of the user and can prevent, when the forearm is not massaged, the armrest from having an obstacle to an arm at the upper part thereof so that the user can take a free posture.

It is another objective of the present invention to provide a massager that has a construction having a reduced number of actuators than that of a conventional construction and that can provide pressure stimulation to the leg portion or the arm portion of the user while holding the leg portion or the arm portion.

It is still another objective of the present invention to provide a massager that can give pressure stimulation to the leg portion or the arm portion of the user while holding the leg portion or the arm portion to prevent the leg portion or the arm portion from escaping in a direction along which the pressure is applied; that can adjust a position at which the leg portion or the arm portion is massaged and can provide a stimulation corresponding to a so-called rubbing kneading by a massage practitioner or the like; and that can support the leg portion or the arm portion in a more stable manner than in the case of the conventional construction.

In order to solve the above problem, the massaging apparatus according to the present invention is configured to be capable of sandwiching and releasing a leg portion or an arm portion of a user and to be capable of giving pressure stimulation to the sandwiched leg portion or arm portion of the user.

In this case, the massaging apparatus can have a construction having an armrest configured to support a forearm of the user; and a forearm massager that is removably mounted to the armrest and that is configured to give pressure stimulation to the forearm of the user with the forearm sandwiched.

The forearm massager according to the present invention can be removably mounted to an armrest provided in a chair-like massaging apparatus and is configured to sandwich the forearm of the user to give pressure stimulation to the forearm.

According to such massaging apparatus and forearm massager, the forearm massager can be removably mounted to the armrest of the massaging apparatus. This allows, when the forearm of the user is massaged, the armrest to be provided with the forearm massager and also allows, when the forearm of the user is not massaged, the armrest to be detached from the forearm massager. This allows the forearm of the user to be massaged if required and also prevents, when the forearm is not massaged, the armrest from having an obstacle to an arm at the upper part thereof so that the user can take a free posture.

The forearm of the user sandwiched by the forearm massager prevents, even when the forearm of the user is pressed, the forearm from escaping in a direction along which the pressure is applied, thus reliably giving the pressure stimulation by the forearm massager to the forearm of the user.

In the above invention, a length of the forearm massager in a longitudinal direction of the armrest is shorter than a length of the armrest. This allows the forearm massager detached frequently to have a smaller size. This also provides a relatively small massaging region by the forearm massager. Thus, a specific position existing at the forearm of the user (e.g., acupuncture point) can be applied with a localized pressure stimulation to provide a further enhanced massaging effect.

In the above invention, the armrest is desirably configured to be able to move the forearm massager in the longitudinal direction of the armrest. This can adjust a position at which the forearm is massaged at the armrest in the longitudinal direction.

In this case, a construction in which the forearm massager is automatically moved may be used or a construction in which the user manually moves the forearm massager also may be used.

In the above invention, the massaging apparatus desirably further comprises a lock mechanism configured to fix the forearm massager to the armrest. This allows the forearm massager to be reliably fixed to the armrest, preventing the forearm massager from being positioned in an instable manner while the forearm of the user is massaged.

In the above invention, another construction also may be used in which the armrest has a moving means configured to move the forearm massager in the longitudinal direction of the armrest. In this case, the forearm massager can be moved automatically, thus adjusting the position of the forearm massager in a further simpler manner. The forearm can be applied with the pressure stimulation while moving the forearm massager, thus providing massaging corresponding to a so-called rubbing kneading by a massage practitioner or the like.

In the above invention, another construction also may be used in which the massaging apparatus further comprises: a backrest configured to support an upper half body of the user; a reclining angle change means configured to change a reclining angle of the backrest; and a control circuit configured to control, in synchronization with a change of the reclining angle of the backrest by the reclining angle change means, an operation of the moving means so that the moving means causes the forearm massager to move in a direction according to the reclining direction of the backrest and by a distance corresponding to the reclining angle. This allows, even when the position of the forearm of the user to the armrest is dislocated due to the change in the reclining angle of the backrest, the forearm massager to be moved in accordance with this dislocation to maintain a relative positional relation between the forearm massager and the forearm of the user.

In the above invention, the forearm massager is desirably configured to include a fix and support portion configured to support the forearm of the user, with the forearm massager attached to the armrest. This allows, when the forearm of the user is massaged, the forearm massager having a shorter length than that of the armrest to give pressure stimulation to the forearm of the user in such a manner in which only a part of the forearm of the user to be applied with the pressure stimulation and the neighborhood thereof are supported on the fix and support portion to provide a more stable support than in the case where the substantially entire forearm of the user is supported.

Furthermore, when an opposite side of a support portion of the forearm of the user by the fix and support portion is applied with pressure stimulation, the pressure causes the forearm of the user to be pressed to the fix and support portion. Thus, the fix and support portion also substantially gives pressure stimulation and the support region is relatively small, thus allowing the fix and support portion to also apply a localized pressure stimulation to the forearm of the user.

In this case, a construction can be used in which the forearm massager further comprises: a pressing portion configured to move close to and away from the fix and support portion and configured to cooperate with the fix and support portion to sandwich the forearm of the user supported on the fix and support portion; an actuator configured to move the pressing portion to be close to and away from the fix and support portion; and a massaging portion that is provided at at least one of opposed parts of the fix and support portion and the pressing portion and that is configured to give pressure stimulation to the forearm of the user sandwiched between the fix and support portion and the pressing portion.

In the above invention, the actuator is preferably configured to be an air bag that is configured to, with the forearm massager attached to the armrest, be connected to an air supply and exhaust device for air intake and air exhaust which is provided at the exterior of the forearm massager. The massaging portion is preferably configured to be an air bag that is configured to, with the forearm massager attached to the armrest, be connected to an air supply and exhaust device for air intake and air exhaust which is provided at the exterior of the forearm massager. This allows, when the forearm massager is attached to the armrest, the actuator and the massaging portion to be driven. The air supply and exhaust device is provided exterior to the forearm massager, thus allowing the forearm massager to have a smaller size.

In the above invention, a construction can be used in which the massaging portion has, at the opposed part of the pressing portion which is opposed to the fix and support portion, two air bags arranged in a direction crossing the longitudinal direction of the armrest; and the massaging apparatus further comprises: a control circuit configured to control: an operation of the actuator to cause the pressing portion to move close to the fix and support portion to thereby allow the forearm of the user supported on the fix and support portion to be sandwiched between the fix and support portion and the pressing portion; then an operation of the massaging portion to cause the two air bags to be expanded to allow the forearm of the user to be sandwiched between the fix and support portion and the pressing portion to be sandwiched in a direction crossing the longitudinal direction of the armrest; and then the operation of the actuator to cause the pressing portion to move away from the fix and support portion to allow the two air bags sandwiching the forearm of the user to move away from the forearm of the user. This provides a so-called pull kneading in which the forearm of the user is pulled while being sandwiched.

In the massaging apparatus according to the above invention, a construction is preferably used in which the massaging apparatus comprises: a support base configured to have a support face for supporting the leg portion or the arm portion of the user; a rotation portion configured to be rotatably mounted at a side part of the support base so as to move close to and away from the support face; a driving portion configured to rotate the rotation portion to be close to and away from the support base; and a massaging portion mounted at an opposed face of the rotation portion which is opposed to the support face, the massaging portion being configured to give, when the driving portion causes the rotation portion to rotate close to the support face, pressure stimulation to the leg portion or the arm portion supported on the support base.

According to such a massaging apparatus, a construction is provided in which the driving portion causes the rotation portion to rotate toward the support face so that the leg portion or the arm portion of the user supported on the support base has a contact with the massaging portion to give pressure stimulation to the leg portion or the arm portion of the user. This construction eliminates the need for additionally providing an actuator for driving the massaging portion and thus can require a reduced number of actuators as compared to the case of the conventional construction. The rotation portion is rotated toward the support face to allow the support face and the rotation portion to hold the leg portion or the arm portion of the user. This prevents, even when the leg portion or the arm portion of the user receives pressure by the massaging portion, the leg portion or the arm portion from escaping in a direction along which the pressure by the massaging portion is applied, thus reliably giving the pressure stimulation by the massaging portion to the leg portion or the arm portion of the user.

In the above invention, a construction may be used in which: the rotation portion has a pushed portion that extends, with respect to a rotation center of the rotation portion, to a substantially opposite side of a position at which the massaging portion is attached; the support base has an opposed part which is opposed to the pushed portion; and the driving portion is configured to vary a distance between the pushed portion and the opposed part. Alternatively, a construction may be used in which: the rotation portion has a pushed portion at a face thereof which is on substantially opposite side of the opposed face thereof opposed to the support face of the support base; the support base has an opposed part which is opposed to the pushed portion; and the driving portion is configured to vary a distance between the pushed portion and the opposed part.

In the above invention, the driving portion desirably has air bags fixed to the pushed portion and the opposed part, respectively. This allows, by merely expanding the air bags, the rotation portion to rotate toward the support face. The air bags having a simple construction can be used as a driving portion to provide the massager with a simple construction.

In the above invention, a construction also may be used in which the support face is configured to support both leg portions of the user and the support base is provided at both sides with the rotation portions. This can provide a footrest on which both legs of the user are placed.

In the above invention, the massaging portion is desirably formed of an elastic material. This allows the leg portion or the arm portion of the user to be provided with a stimulation through which as if the leg portion or the arm portion receives the finger pressure by a massage practitioner.

In the above invention, the massaging portion is desirably configured to be a roller that is formed of an elastic material and that is configured to be rotatable around a pivot substantially parallel to a rotation axis of the rotation portion. This allows, even when the rotation portion is rotated to cause the massaging portion to move to have friction with the leg portion or the arm portion of the user, the massaging portion to be rotated on skin or cloth of the user, thus preventing the massaging portion from having friction with the skin or the cloth of the user.

In the above invention, a construction is desirably used in which: the massaging apparatus further comprises a detection module configured to detect a contact the leg portion or the arm portion of the user with the massaging portion; and wherein the control portion is configured to repeatedly execute a control process to control the operation of the driving portion: to operate the driving portion to cause the rotation portion to rotate close to the support face, to cause the detection module to detect the contact of the leg portion or the arm portion of the user with the massaging portion, and then to operate the driving portion to cause the rotation portion to rotate away from the support face, until the detection module does not detect the contact of the leg portion or the arm portion of the user with the massaging portion.

This allows, while generally retaining the massaging portion to have a contact with the leg portion or the arm portion of the user, the massaging portion to repeatedly press and release the leg portion or the arm portion of the user, thus preventing a waste of operation (e.g., preventing the massaging portion from being unnecessarily away from the leg portion or the arm portion of the user).

In the above invention, the massaging apparatus desirably further comprises an air bag provided at the support face. This provides further variety of stimulations to the leg portion or the arm portion of the user. For example, this air bag and the massaging portion can provide a so-called grab kneading while sandwiching the leg portion or the arm portion of the user.

In the above invention, a construction can be used in which the control portion is configured to control respective operations of the air bag and the driving portion to operate the driving portion to cause the air bag provided at the support face to be expanded and then to cause the rotation portion to rotate close to the support face.

In the massaging apparatus according to the present invention, a construction is preferably used in which the massaging apparatus comprises: a support base configured to be maintained to be immovable and to support the leg portion or the arm portion of the user; a pressing portion configured to cooperate with the support base to sandwich the leg portion or the arm portion of the user supported on the support base and to move, when the support base is immovable, in a substantially longitudinal direction of the leg portion or the arm portion of the user supported on the support base; and a massaging portion that is mounted to at least one of opposed parts of the support base and the pressing portion and that is configured to give pressure stimulation to the leg portion or the arm portion of the user sandwiched between the support base and the pressing portion.

Such a construction allows the support base to be maintained to be immovable and thus the leg portion or the arm portion of the user can be supported in a stable manner. The pressing portion can be moved in a substantially longitudinal direction of the leg portion or the arm portion supported on the support base. Thus, massaging corresponding to a so-called rubbing kneading can be provided by a massage practitioner or the like by adjusting a position at which the leg portion or the arm portion is massaged or by continuously changing a position at which the leg portion or the arm portion is massaged while giving the pressure stimulation to the leg portion or the arm portion.

The leg portion or the arm portion of the user sandwiched between the support base and the pressing portion prevents, even when the leg portion or the arm portion of the user receives pressure by the massaging portion, the leg portion or the arm portion from escaping in a direction along which the pressure by the massaging portion is applied, thus reliably giving the pressure stimulation by the massaging portion to the leg portion or the arm portion of the user.

In the above invention, the support base is desirably configured to support a substantially entire length of a lower thigh or a forearm of the user. This allows the support base to be used as a footrest or an armrest without additionally providing a footrest or an armrest.

In the above invention, the massaging apparatus desirably further comprises a driving portion configured to move the pressing portion in the substantially longitudinal direction of the leg portion or the arm portion of the user supported on the support base. This allows the driving portion to drive the pressing portion to move the driving portion in the substantially longitudinal direction of the leg portion or the arm portion.

In this case, the massaging apparatus desirably further comprises a detection portion configured to detect the leg portion or the arm portion of the user supported on the support base; and a control portion configured to control, based on a detection result by the detection portion, the operation of the driving portion. This can control, for example, the driving portion so that the driving portion is operated only when the leg portion or the arm portion of the user is placed on the support base and can control the pressing portion so that the pressing portion has a reciprocating movement only within a part at which the leg portion or the arm portion of the user exists in the moving range of the pressing portion, thus additionally providing a function highly convenient to the user.

In the above invention, the pressing portion may have a roller configured to roll on the leg portion or the arm portion of the user supported on the support base. This allows the roller to be rotated while being pushed to the leg portion or the arm portion of the user, thus providing the leg portion or the arm portion with a massaging corresponding to a so-called rubbing kneading.

In the above invention, the support base also may be configured to support a calf of the user and the massaging apparatus further comprises a sole massaging portion configured to give mechanical stimulation to a sole of the user. As a result, greater variety of stimulations can be provided to the leg portion of the user.

In the above invention, the massaging apparatus also may further comprise a cover portion configured to be rotatable around a rotation axis provided at one end or in the vicinity of the support base so as to be close to and away from the support face of the support base on which the leg portion or the arm portion of the user is supported; and wherein the pressing portion is mounted at an opposed part of the cover portion which is opposed to the support face so as to move close to and away from the support face, when the cover portion is at a position distant from the support face.

This allows, when the massaging apparatus is used, the cover portion to be rotated to a position away from the support face (open position) to allow the support base to have thereon the leg portion or the arm portion of the user while moving the pressing portion toward the support face so as to have a contact with the leg portion or the arm portion to subsequently move the pressing portion, thereby massaging the leg portion or the arm portion. This also allows, when the massaging apparatus is not used, the cover portion to be rotated to a position in the vicinity of the support face (close position), thus allowing the pressing portion or the like to be stored in a compact manner. This also allows the cover portion to be in the close position while the cover portion being used as a footrest or an armrest or the like.

In this case, the massaging apparatus desirably further comprises a driving portion configured to move the pressing portion to be close to and away from the support face.

In the above invention, a construction also may be used in which the pressing portion comprises: a first member that is configured to move distant from the support base while being opposed thereto and to move in the substantially longitudinal direction of the leg portion or the arm portion of the user supported on the support base; and a second member mounted at an opposed part of the first member which is opposed to the support base and configured to move close to or away from the support base.

In this case, the massaging apparatus desirably further comprises a driving portion configured to move the second member to be close to and away from the support base.

In the above invention, a construction may be used in which the massaging portion has a roller that is rotatably attached to the pressing portion and that is configured to roll on the leg portion or the arm portion of the user supported on the support base. This allows the roller to be pushed to the leg portion or the arm portion of the user while being rotated, thereby providing the leg portion or the arm portion with a massaging corresponding to a so-called rubbing kneading.

In the above invention, a construction is desirably used in which the support base has a guide rail extending in the substantially longitudinal direction of the supported leg portion or arm portion of the user; and the pressing portion has a movable element engageable with the guide rail so as to be movable along the guide rail. This can regulate the direction along which the pressing portion is moved.

The massager according to the present invention is characterized by comprising: a support base configured to be maintained to be immovable and to support the leg portion or the arm portion of the user; a pressing portion configured to cooperate with the support base to sandwich the leg portion or the arm portion of the user supported on the support base; and a massaging portion that is mounted at least one of opposed parts of the support base and the pressing portion, that is configured to be able to give pressure stimulation to the leg portion or the arm portion of the user sandwiched between the support base and the pressing portion, and that is configured, when at least the support base is immovable, to change a position at which the pressure simulation is given to the leg portion or the arm portion of the user.

Such a construction allows the support base to be maintained to be immovable, thus supporting the leg portion or the arm portion of the user in a stable manner. When the support base is immovable, a position at which the massaging portion gives pressure stimulation (i.e., a position at which the user receives massaging) can be changed. Thus, massaging corresponding to a so-called rubbing kneading by a massage practitioner or the like can be provided by adjusting a position at which the leg portion or the arm portion is massaged or by continuously changing a position at which the leg portion or the arm portion is massaged while the leg portion or the arm portion receives the pressure stimulation.

The leg portion or the arm portion of the user sandwiched between the support base and the pressing portion prevents, even when the leg portion or the arm portion of the user receives pressure by the massaging portion, the leg portion or the arm portion from escaping in a direction along which the pressure by the massaging portion is applied, thus reliably giving the pressure stimulation by the massaging portion to the leg portion or the arm portion of the user.

In the above invention, the support base and the pressing portion are desirably configured to sandwich a lower thigh or a forearm of the user over a substantially entire length thereof. This allows the support base to be used as a footrest or an armrest without additionally providing a footrest or an armrest.

In the above invention, another construction also may be used in which the massaging portion has a plurality of massaging elements configured to be capable of giving pressure stimulation to different positions of the leg portion or the arm portion of the user; and the massaging apparatus further comprises a control portion configured to perform control to separately drive the respective massaging elements.

This allows, for example, the massaging elements to be driven simultaneously to simultaneously give pressure stimulations to a plurality of positions of the leg portion or the arm portion of the user. This also allows the massaging elements to be driven separately to change positions at which the leg portion or the arm portion of the user is massaged while applying pressure stimulation thereto. This also allows, for example, the massaging elements arranged in the longitudinal direction of the leg portion or the arm portion of the user so that the massaging elements are driven in the order of the arrangement, thus changing positions at which the leg portion or the arm portion of the user is massaged while applying pressure stimulation thereto so that a massaging corresponding to a so-called rubbing kneading by a massage practitioner or the like can be provided.

In the above invention, the massaging apparatus desirably further comprises a cover portion configured to be rotatable around a rotation axis provided at one end or in the vicinity of the support base so as to be close to or away from the support face of the support base on which the leg portion or the arm portion of the user is supported; and wherein the pressing portion is mounted at an opposed part of the cover portion which is opposed to the support face so as to move close to and away from the support face with the cover portion inclined at a predetermined angle with respect to the support face.

This allows, when the massaging apparatus is used, the cover portion to be rotated to a position away from the support face (open position) to allow the support base to have thereon the leg portion or the arm portion of the user while moving the pressing portion toward the support face so as to have a contact with the leg portion or the arm portion to subsequently move the pressing portion, thereby massaging the leg portion or the arm portion. This also allows, when the massaging apparatus is not used, the cover portion to be rotated to a position in the vicinity of the support face (close position), thus allowing the pressing portion or the like to be stored in a compact manner. This also allows the cover portion to be in the close position while the cover portion being used as a a footrest or an armrest or the like.

In this case, the massaging apparatus desirably further comprises a driving portion configured to move the pressing portion to be close to and away from the support face.

In the above invention, the support base is configured to be adjustably positioned. This allows the leg portion or the arm portion of the user to be supported in a more appropriately manner. Another construction also may be used in which a distance or an angle of the support base to a floor face or the like is adjusted to adjust the position of the support base or a construction also may be used in which the support base is slid in the longitudinal direction of the leg portion or the arm portion of the user.

In the above invention, another construction also may be used in which the massaging portion has an air bag provided at an opposed part of the pressing portion which is opposed to the support base. Another construction also may be used in which the massaging portion has an air bag provided at an opposed part of the support base which is opposed to the pressing portion.

In the above invention, the pressing portion desirably has a vibrator.

The above and other objectives, features, and advantages of the present invention will be clear from the detailed description of the preferable embodiments with reference to the attached drawings.

BRIEF DESCRIPTION OF THE DRAWINGS

FIG. 29(*a*) is a perspective view showing the appearance while FIG. 29(*b*) is a top view showing when the footrest is used.

FIG. 34(*a*) is a perspective view showing the appearance while FIG. 34(*b*) is a top view showing when the footrest is used.

BEST MODE FOR CARRYING OUT THE INVENTION

Hereinafter, embodiments of the present invention will be described with reference to the drawings.

Embodiment 1

Figure 1:
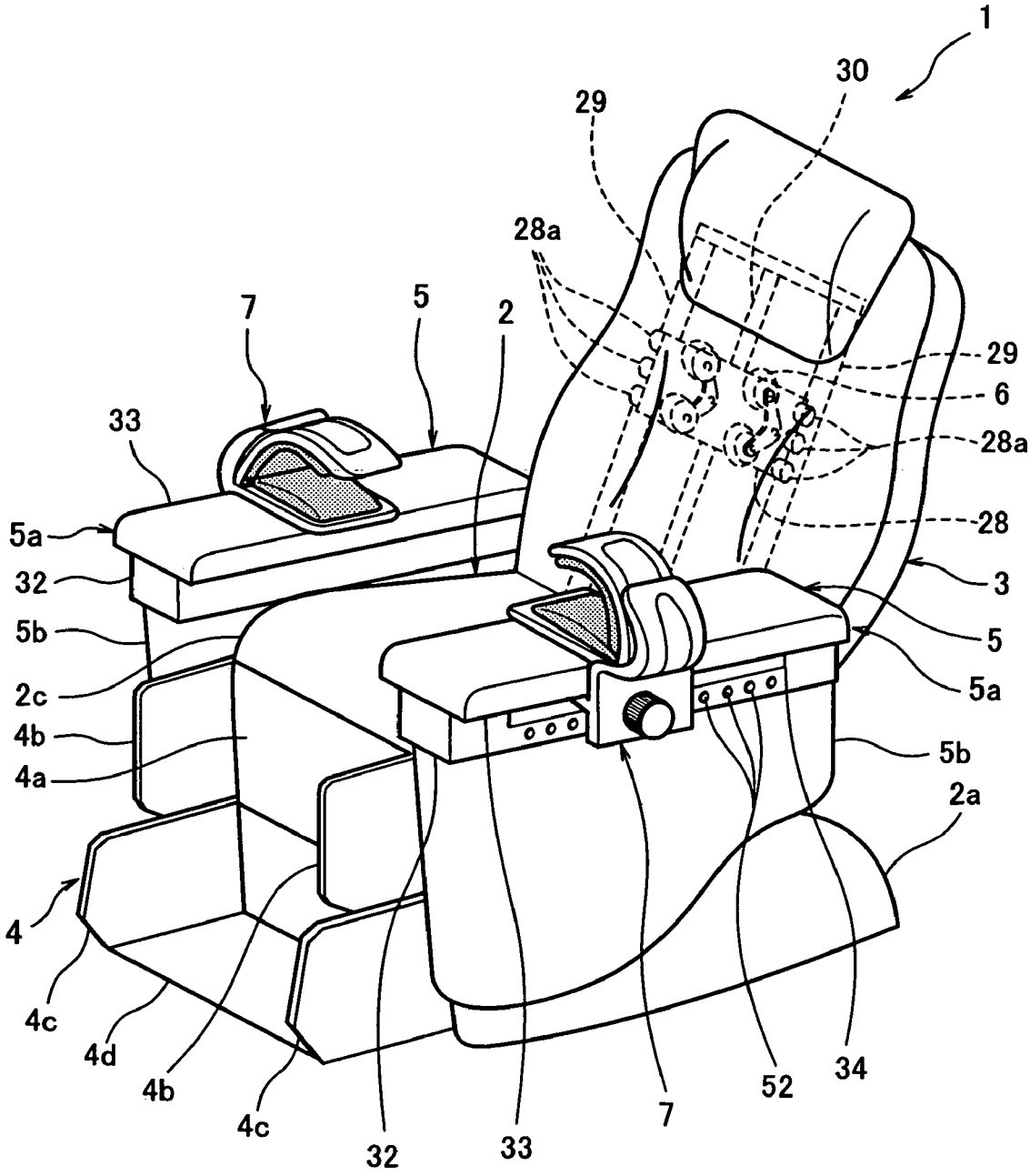
FIG. 1 is a perspective view illustrating the entire construction of a massaging apparatus according to embodiment 1 of the present invention.

FIG. 1 is a perspective view illustrating the entire construction of a massaging apparatus according to embodiment 1 of the present invention. As shown in FIG. 1, the massaging apparatus according to embodiment 1 is the chair type one and is configured to mainly include a seat 2, a backrest 3, a footrest 4, and armrests 5. The seat 2 is configured such that a base (not shown) having at both lower sides thereof leg portions 2*a* has at the upper part thereof a cushion portion 2*c*. The cushion portion 2*c* is provided to have a substantially flat upper face that is used as a seating surface. The cushion portion 2*c* is configured such that an inner packing material (not shown) made of urethane foam, sponge, or polystyrene foam is provided at the upper face of the base and the inner packing material is covered by an outer packaging material (cover) formed of polyester-made raised tricot, synthetic leather, natural leather or the like.

In the following description, the expression "front side" represents the front side seen from a user sitting on the massaging apparatus 1. Also in the following description, the expression "left" represents the left side seen from the user sitting on the massaging apparatus 1 while the expression "right" represents the right side seen from the user sitting on the massaging apparatus 1. The front side of the upper part of the seat 2 is pivotally mounted with the upper end portion of the footrest 4 for massaging the ankle and calf of the user. This allows the footrest 4 to rotate around the upper end portion forward and backward.

In the footrest 4 as described above, a planate lower thigh support face 4*a* extending from the front end of the seat 2 in the downward direction in FIG. 1 has, at both sides thereof, side walls 4*b* and 4*c* protruded forward in the drawing and the lower thigh support face 4*a* has at the lower end thereof in the drawing (i.e., end portion that has the longest distance to the seat 2) a sole support wall 4*d* protruded forward in the drawing. The side walls 4*b* and 4*c* have therein air bags (not shown). These air bags are connected, via an air hose (not shown), to an air supply and exhaust device 9 (see FIG. 5) comprising a pump and a valve or the like that are included in the seat 2 or the backrest 3 and are configured to expand or contract by the air supply and exhaust by the air supply and exhaust device 9. By this construction, when the user sits on the massaging apparatus, the repeated expansion and contraction of the air bags give pressure stimulation to the outer part of the lower thigh and the side part and upper part of the leg of the user.

The lower thigh support face 4*a* is also configured to have a contact with the lower thigh of the user sitting on the massaging apparatus 1 to support the lower thigh. The lower thigh support face 4*a* also includes a plurality of air bags (not shown) that are also connected via an air hose to the air supply and exhaust device 9. The repeated expansion and contraction of these air bags give pressure stimulation to the periphery of the calf and Achilles' tendon of the user.

Furthermore, the sole support wall 4*d* is provided to have a contact with the sole of the user sitting on the massaging apparatus 1 to support the sole. The sole support wall 4*d* has therein a vibrator (not shown) and an air bag (not shown). The air bag is connected to the air supply and exhaust device 9 via an air hose. The vibrator has such a construction in which an eccentric mass is attached to an output shaft of a DC motor that is driven to generate micro vibration. The repeated expansion and contraction of these air bags can give pressure stimulation to the sole of the user. The operation of the vibrator can provide vibration stimulation to the sole of the user.

A plurality of air bags are also provided at a rear portion of the seat 2. These air bags are also connected to the air supply and exhaust device 9 via an air hose (not shown) and are configured to have expansion or contraction by the air supply and exhaust by the air supply and exhaust device 9. The center of the rear portion of the seat 2 also has a vibrator (not shown) having a construction as described above. By the construction as described above, the repeated expansion and contraction of the air bag while the user is sitting on the seat 2 can give pressure stimulation to the buttocks of the user and the operation of the vibrator in the same condition can provide vibrating stimulation to the anus part of the user.

Furthermore, the rear portion of the seat 2 includes the backrest 3. The backrest 3 is sized, in order to support the upper half body of the user, such that an adult having a general physical constitution does not protrude from the backrest 3 when the adult sits on the massaging apparatus 1. The backrest 3 has a substantially rectangular shape as seen in a front view. The lower end of the backrest 3 is pivotally supported at the rear portion of the seat 2 by a lateral pivot. The rotation of the backrest 3 around this pivot allows the backrest 3 to be reclined in a forward and backward. The backrest 3 has, at both sides, the armrests 5 fixedly mounted to the base of the seat 2. This armrests 5 extend from both lateral ends of the backrest 3 in the frontward direction and are mounted with the forearm massagers 7 (which will be described later). The forearm massager 7 can be removably mounted to the armrest 5. The armrest 5 can be used as an elbowrest when the user sits on the massaging apparatus 1 while the forearm massager 7 being detached from the armrest 5.

Figure 2:
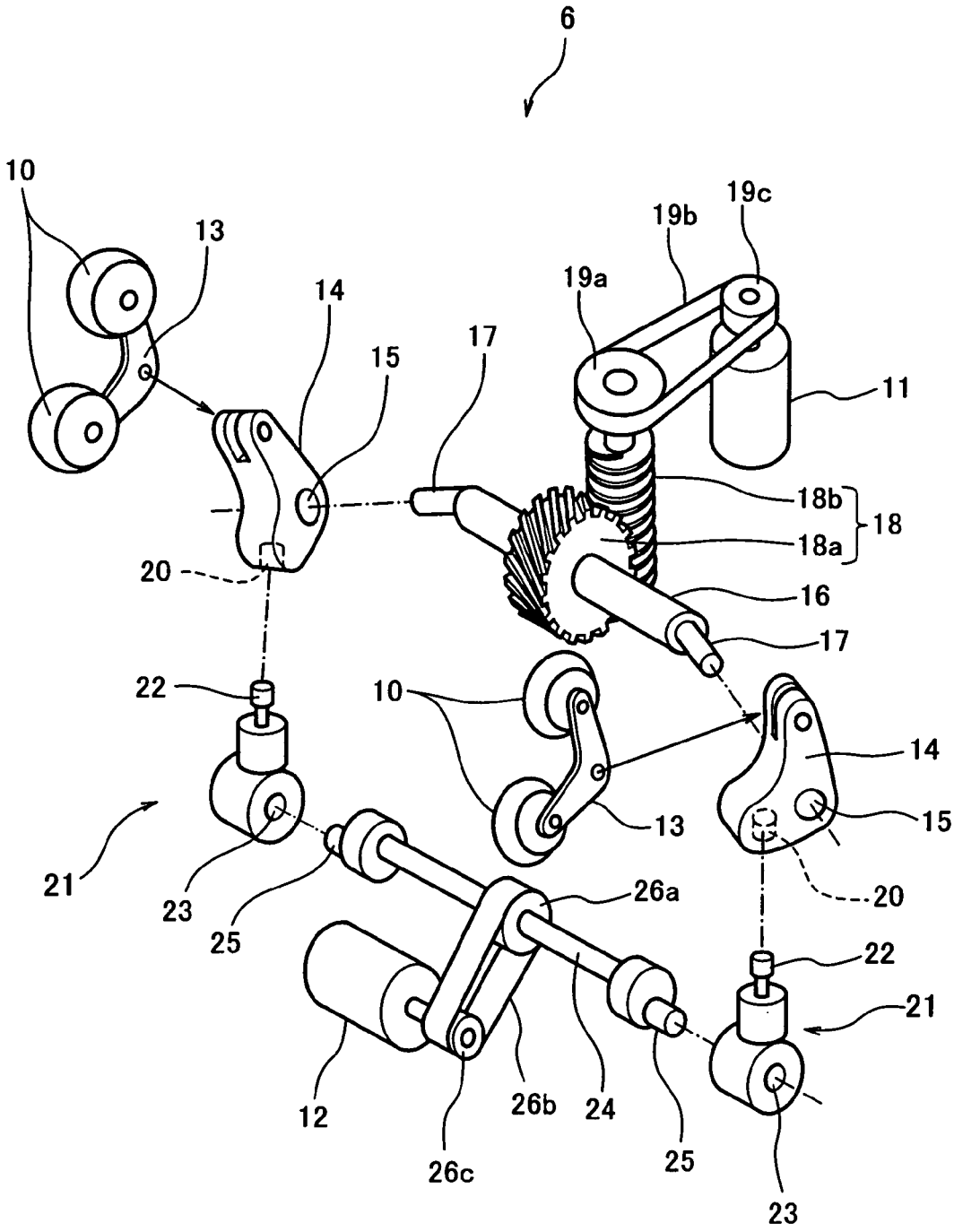
FIG. 2 is an exploded perspective view illustrating the construction of a massaging mechanism included in the massaging apparatus according to embodiment 1 of the present invention.

The backrest 3 has therein the massaging mechanism 6 as shown in FIG. 2. FIG. 2 is an exploded perspective view illustrating the construction of the massaging mechanism 6 owned by the massaging apparatus according to embodiment 1 of the present invention. The massaging mechanism 6 has the four roller-like massaging elements 10 configured to provide mechanical stimulation to the body of the user. There are also provided DC motors 11 and 12 driven to cause the massaging elements 10 to displace. The massaging elements 10 are attached to the tip ends of two V-shaped arms 13, respectively. The respective arms 13 are attached to two V-shaped connecting rods 14 so as to be rotatable within a predetermined range, respectively. Each connecting rod 14 includes a fitting hole 15. This fitting hole 15 is loosely fitted with inclined portions 17 provided at both ends of a rotation axis 16. This inclined portion 17 is provided to have a predetermined inclining angle to the rotation axis 16. The intermediate part of the rotation axis 16 is coaxially provided with a helical gear 18*a*. This helical gear 18*a* is meshed with a worm 18*b*. In this way, the helical gear 18*a* and the worm 18*b* constitute the worm gear mechanism 18.

One end of the worm 18*b* is coaxially provided with a pulley 19*a*. This pulley 19*a* is connected, via a belt 19*b*, to a pulley 19*c* provided at the output shaft of the motor 11. Thus, the rotation movement of the motor 11 is transmitted via the belt 19*b* to the worm 18*b* and the rotation of the worm 18*b* causes the rotation axis 16 to rotate. Then, the rotation of the rotation axis 16 causes the inclined portion 17 to displace to draw a conical trajectory. This allows the connecting rod 14 to operate in a regular manner so that the left and right massaging elements 10 are moved so as to be close to and away from each other in horizontal and vertical directions to draw a substantially elliptical shape. This provides the kneading operation by the massaging element 10. The kneading operation by the massaging element 10 includes an operation provided when the left and right massaging element 10 move in the frontward direction (user side) while moving to be close to each other and the left and right massaging elements 10 move in the rearward direction while moving away from each other. In this way, the kneading operation provides a three-dimensional movement of the massaging element 10.

As shown in FIG. 2, the connecting rod 14 has at the lower part a fitting hole 20. This fitting hole 20 is inserted with a protruding portion 22 provided at a coupling member 21. The coupling member 21 includes a lateral hole 23. The hole 23 is loosely fitted with eccentric portions 25 provided at both ends of the rotation axis 24. An intermediate part of a rotation axis 24 is coaxially provided with a pulley 26*a*. This pulley 26*a* is coupled by a belt 26*b* to a pulley 26*c* provided at an output shaft of the motor 12. Therefore, the rotation movement of the motor 12 is transmitted via the belt 26*b* to the rotation axis 24 and the revolution of the eccentric portions 25 at both ends of the rotation axis 24 allows the coupling member 21 to move in a substantially vertical direction. As a result, the connecting rod 14 has a reciprocating rotation around the fitting hole 15, thus allowing the massaging element 10 to have a reciprocating movement in a substantially vertical direction so as to draw a circular arc. When the motor 12 is rotated with a fixed rate, then the massaging element 10 has a reciprocating movement with a fixed cycle. This provides a tapping operation by the massaging element 10. When the motor 12 is rotated while the rotation rate being changed, the massaging element 10 has a reciprocating movement with an irregular cycle. This provides the finger pressure operation by the massaging element 10.

In this way, the driving of the motor 11 provides the kneading operation by the massaging element 10 while the driving of the motor 12 provides the tap operation and the finger pressure operation by the massaging element 10. When the motors 11 and 12 are driven at the same time, the kneading operation and the tap operation or the kneading operation and the finger pressure operation are performed in a combined manner. The respective operation also may be performed individually.

The massaging mechanism 6 as described above is attached to an up-down member 28 as shown in FIG. 1. This up-down member 28 has at both lateral ends rollers 28*a*. The rollers 28*a* are supported by guide rails 29 so as to be able to roll. The up-down member 28 includes a nut (not shown) and the nut is fastened with the threaded rod 30 provided to be parallel with the guide rails 29. The threaded rod 30 and the upper and lower ends are pivotally mounted and the lower end is coupled to an output shaft of a motor (not shown) provided at the lower part of the backrest 3. Thus, when the driving of the motor allows the threaded rod 30 to rotate, the engagement of the roller 28*a* with the guide rail 29 restricts an integral rotation of the up-down member 28 having the nut with the threaded rod 30 and provides a relative rotation of the nut and the threaded rod 30, thus allowing the up-down member 28 and the massaging mechanism 6 to move up and down. The construction as described above allows, with the upper half body of the user resting on the backrest 3, the massaging mechanism 6 to move up and down, thus providing a rolling operation in which the massaging element 10 is rolled on the back of the user.

Next, the construction of the forearm massager 7 will be described in further detail. As shown in FIG. 1, the armrest 5 includes the bases 5*b* provided at both ends of the seat 2 and the upper part cover 5*a* covered on the upper part of the base 5*b*. The base 5*b* is provided at both ends of the seat 2 so as to slightly protrude upward from the upper face of the seat 2 (i.e., seating surface). The upper part cover 5*a* is provided so as to cover the protruding portion. The upper part cover 5*a* is configured to include the side wall 32 configured to cover the side part of the upper end part of the base 5*b* and the support portion 33 provided at the upper part of the side wall 32 to cover the upper end face of the base 5*b*. The support portion 33 has a substantially cuboid-shaped upper face that is rounded forward and backward so that this upper face supports the forearm of the user by having a contact thereto when the armrest 5 is used as an armrest.

The support portion 33 is provided to have a flat surface that is larger than that of the side wall 32. This provides the support portion 33 with a construction in which the support portion 33 laterally protrudes from the side wall 32 over the entire periphery.

Long slits 34 are formed on the outer faces of the side walls 32 (i.e., on the side distant from the seat 2) to extend forward and backward, respectively. The forearm massager 7 can be attached to the armrest 5 via the slits 34. The width of the forearm massager 7 in the forward-and-rearward direction is provided to be sufficiently shorter than the length of the slit 34 so that the forearm massager 7 can have a position adjustment forward and backward within the range of the slit 34.

Figure 3:
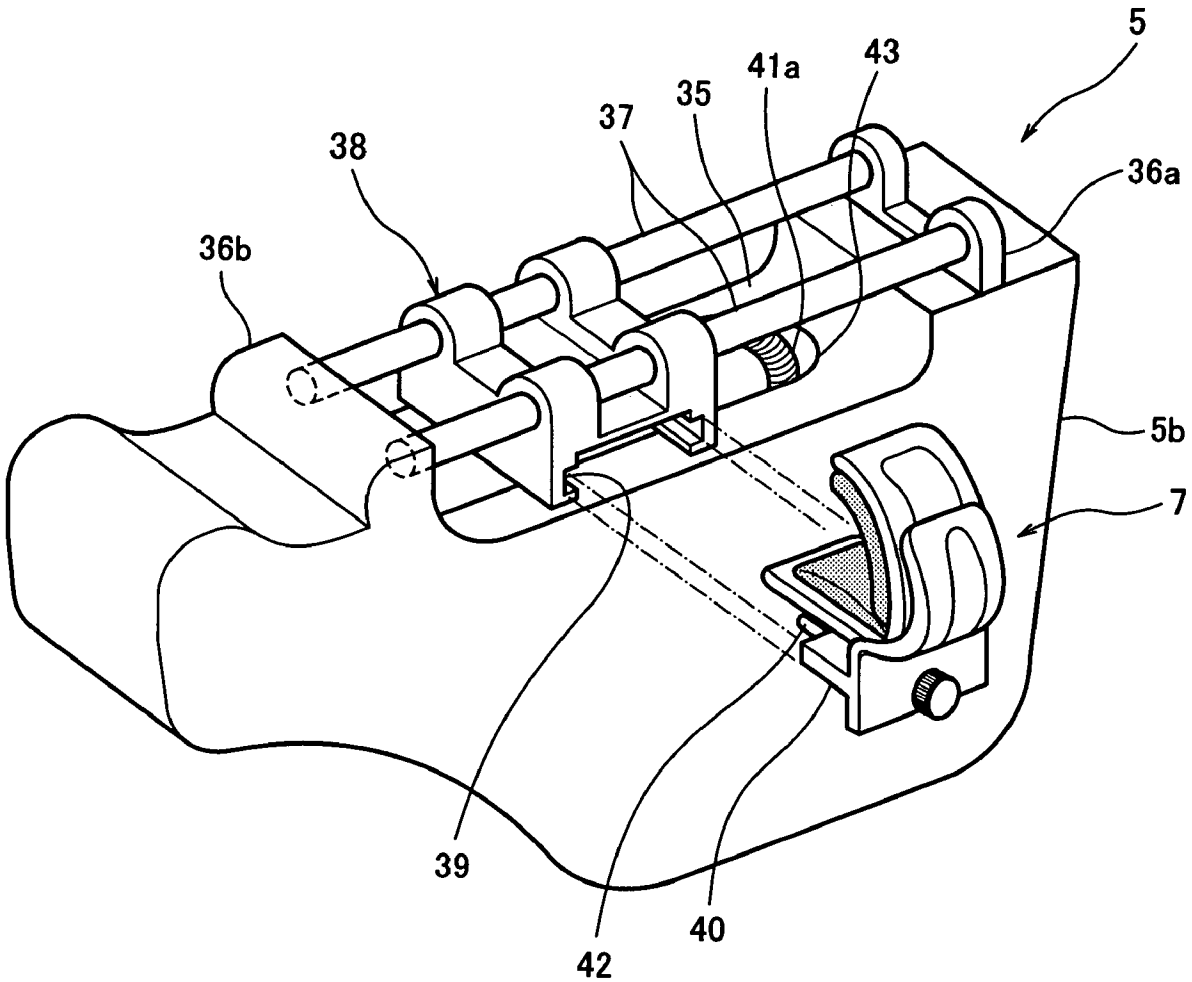
FIG. 3 is a perspective view illustrating the construction of a forearm massager according to embodiment 1 of the present invention.
Figure 4:
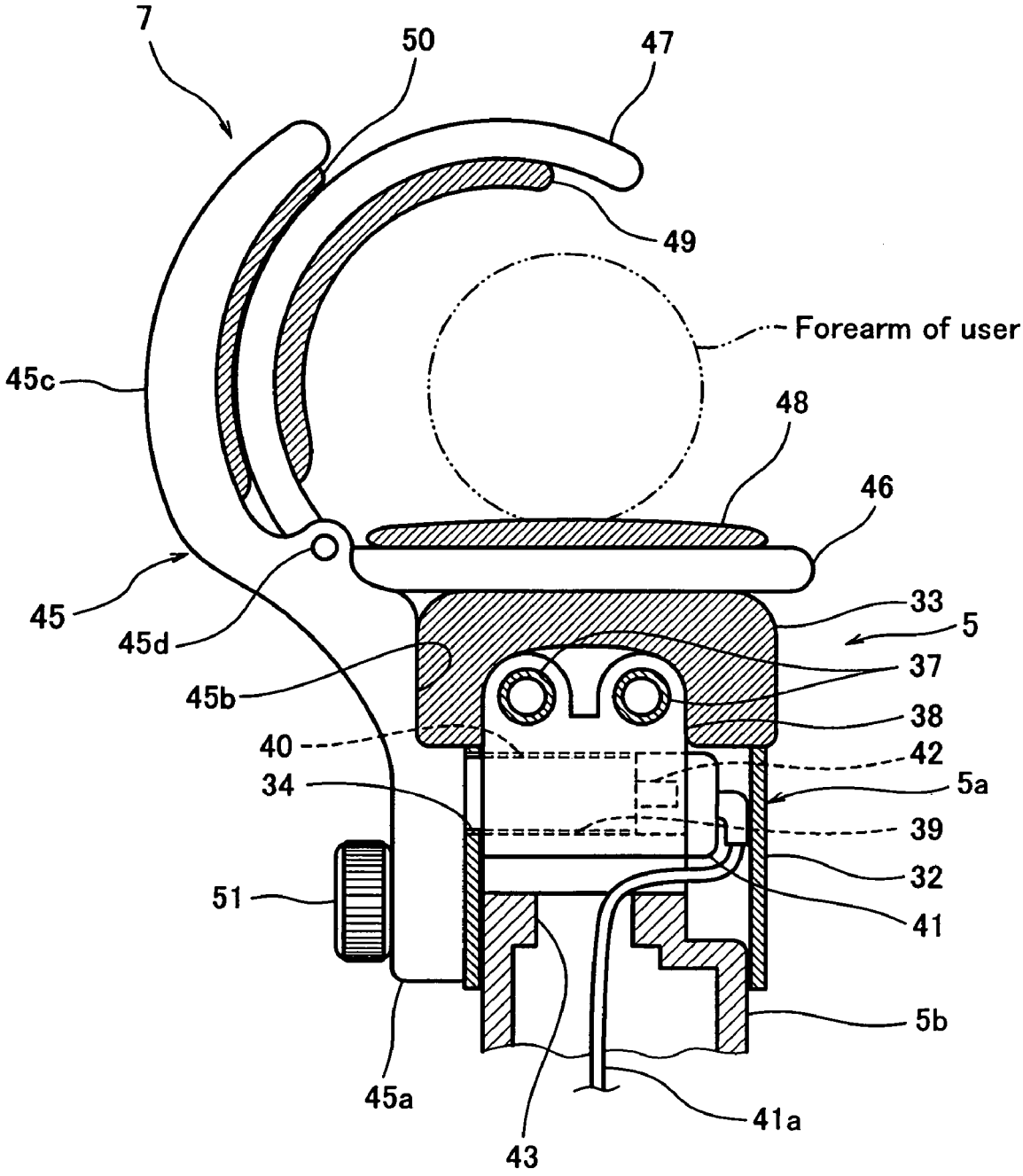
FIG. 4 is a partial cross-sectional front view illustrating the construction of the forearm massager according to embodiment 1 of the present invention.

FIG. 3 is a perspective view illustrating the construction of the forearm massager 7 according to embodiment 1 of the present invention and FIG. 4 is a partial cross-sectional front view thereof. Although the upper part of the armrest 5 is actually covered by the upper part cover 5*a* as shown in FIG. 1, FIG. 3 shows the internal structure by omitting the upper part cover 5*a* of the armrest 5.

As shown in FIG. 3, the base 5*b* has at the upper end portion a concave portion 35 extending forward and backward. Among the upper face of the base 5*b*, the front-and-rear end portion of the concave portion 35 has the protruding portions 36*a* and 36*b* slightly protruding in the upward direction. These protruding portions 36*a* and 36*b* are provided to be opposed to each other between which two round bar-shaped guide rails 37 are provided in parallel. The concave portion 35 forms a space having an appropriate size under the guide rails 37. These guide rails 37 penetrate a detachable member 38 with an appropriate play, thus allowing the detachable members 38 to have a front-and-rear movement along the guide rails 37 within the range of the space.

The detachable member 38 has at the lower part a fitting groove 39 opened to the above-described slit 34. The fitting groove 39 extends in a lateral direction and can be fitted with the fitting projection 40 provided in the forearm massager 7.

As shown in FIG. 4, the inner side of the fitting groove 39 (i.e., side of the lower part of the detachable member 38 which is distant from the slit 34) has the coupling socket 41 for connecting an air piping. The socket 41 can be connected to a plug 42 (see FIG. 3) provided at the tip end of the fitting projection 40 of the forearm massager 7 and the socket 41 and the plug 42 constitute a coupling. An air hose 41*a* extends from the socket 41. The air hose 41*a* is communicated with the air supply and exhaust device 9 provided in the seat 2 or the backrest 3 via the opening 43 provided at the lower bottom of the concave portion 35 (see FIG. 5).

The forearm massager 7 mainly includes: a base 45; a fix and support portion 46; a pressing portion 47; and air bags 48 to 50. As shown in FIG. 4, the lower part of the base 45 is provided as a flat-plate portion 45*a* so that, when the forearm massager 7 is attached to the armrest 5, the lower part can be closely abutted to or be in the vicinity of the outer face of the side wall 32 of the upper part cover 5*a*. At the flat surface portion abutted with the side wall 32 of the flat-plate portion 45*a*, the above-described fitting projection 40 is protruded. At the upper part continuing from the flat-plate portion 45*a*, a concave portion 45*b* that conforms in shape to the support portion 33 is provided.

Furthermore, the upper part of the base 45 which is located above the concave portion 45*b* is the curved portion 45*c* that is once curved outward and the upper part thereof is inwardly curved to have a circular arc shape. The shape of the curved portion 45*c* will be described in further detail. The curved portion 45*c* is curved to have a substantially circular arc shape around a virtual center axis extending forward and backward, above the support portion 33.

The fix and support portion 46 having a flat surface is attached to the upper part of the concave portion 45*b* of the base 45. The fix and support portion 46 is provided to be on the upper face of the support portion 33 when the forearm massager 7 is attached to the armrest 5. The upper face of the fix and support portion 46 has the air bag 48. The air bag 48 is communicated with the above-described plug 42 via an air hose (not shown).

In the vicinity of the projection base end of the fix and support portion 46 of the base 45, there is provided a rotation axis 45*d* extending forward and backward. The circular arc plate-shaped pressing portion 47 is pivotally supported by the rotation axis 45*d*. The pressing portion 47 has a circular arc plate-like shape having a curvature radius that is slightly smaller than that of the above-described curved portion 45*c* and can be rotated around the rotation axis 45*d*. In the vicinity of the rotation axis 45*d*, there is provided a bias means (not shown) such as a spring that is configured to bias the pressing portion 47 to cause the pressing portion 47 to move away from the fix and support portion 46.

The air bag 50 is provided between the curved portion 45*c* and the pressing portion 47. The air bag 50 is communicated via an air hose (not shown) to the plug 42 so that, when the air bag 50 has expansion or contraction by being provided with air supply or exhaust, the pressing portion 47 can be rotated around the rotation axis 45*d*.

The air bag 49 is provided on an inner peripheral face of the pressing portion 47. The air bag 49 is also communicated via an air hose (not shown) to the above-described plug 42, as in the case of the air bags 48 and 50.

The flat-plate portion 45*a* of the base 45 has a threaded hole (not shown) penetrating in the plate thickness direction. The threaded hole is threaded with a threaded rod for a fixation knob 51 having a disk-like knob at one end thereof. The slit 34 of the side wall 32 of the upper part cover 5*a* has, at the lower part thereof, a plurality of holes 52 provided in parallel forward and backward. As a result, when the forearm massager 7 is attached to the armrest 5, the fixation knob 51 can be rotated to project the tip end of the threaded rod so that the tip end is inserted to one of the holes 52, thereby fixing the forearm massager 7 to the armrest 5. In this way, the fixation knob 51 and the hole 52 constitute a lock mechanism according to the present invention.

With regards to the forearm massager 7 having the construction as described above, two types of a right arm massager and a left arm massager are provided to one massaging apparatus 1 so that they can be removably mounted to the left and right armrests 5.

Figure 5:
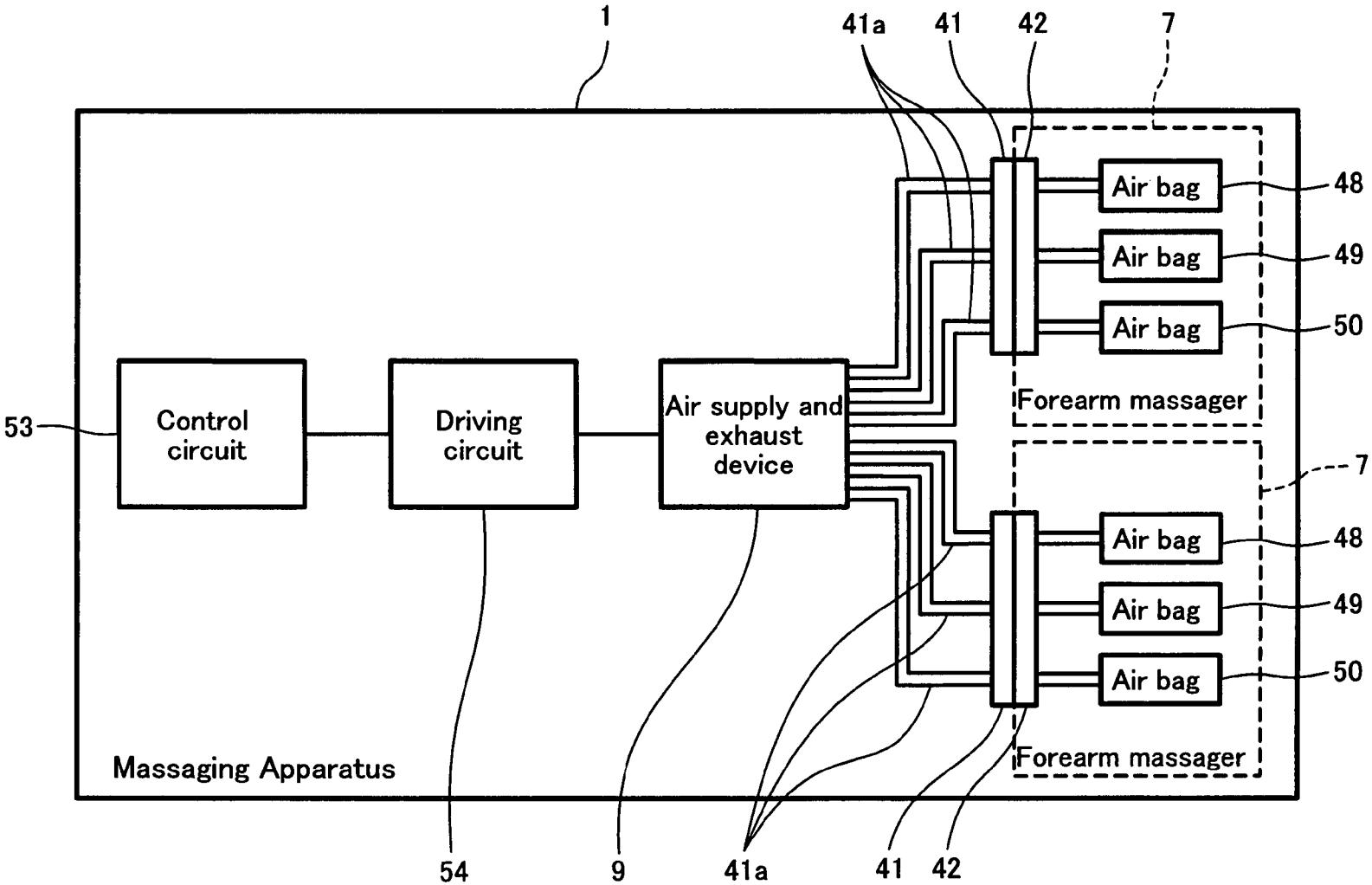
FIG. 5 is a block diagram illustrating a part of the construction of the massaging apparatus 1 according to embodiment 1 of the present invention.

FIG. 5 is a block diagram illustrating a part of the construction of the massaging apparatus 1 according to embodiment 1 of the present invention. As shown in FIG. 5, the massaging apparatus 1 includes a control circuit 53. The control circuit 53 is provided by a CPU, ROM, RAM, and an input/output interface or the like and is provided in the seat 2 or the backrest 3. The control circuit 53 is connected to a driving circuit 54. The driving circuit 54 is connected to the air supply and exhaust device 9. The air supply and exhaust device 9 is provided by a switching valve (e.g., electromagnetic valve) and an air pump or the like and is communicated to the socket 41 via an air hose. When the socket 41 is connected with the plug 42, the air supply and exhaust device 9 is connected to the above-described air bags 48 to 50 and then the air supply and exhaust device 9 can supply air to or exhaust air from the air bags 48 to 50 in an individual manner. The driving circuit 54 is configured to drive the air supply and exhaust device 9 in accordance with a control signal sent from the control circuit 53.

Figure 6:
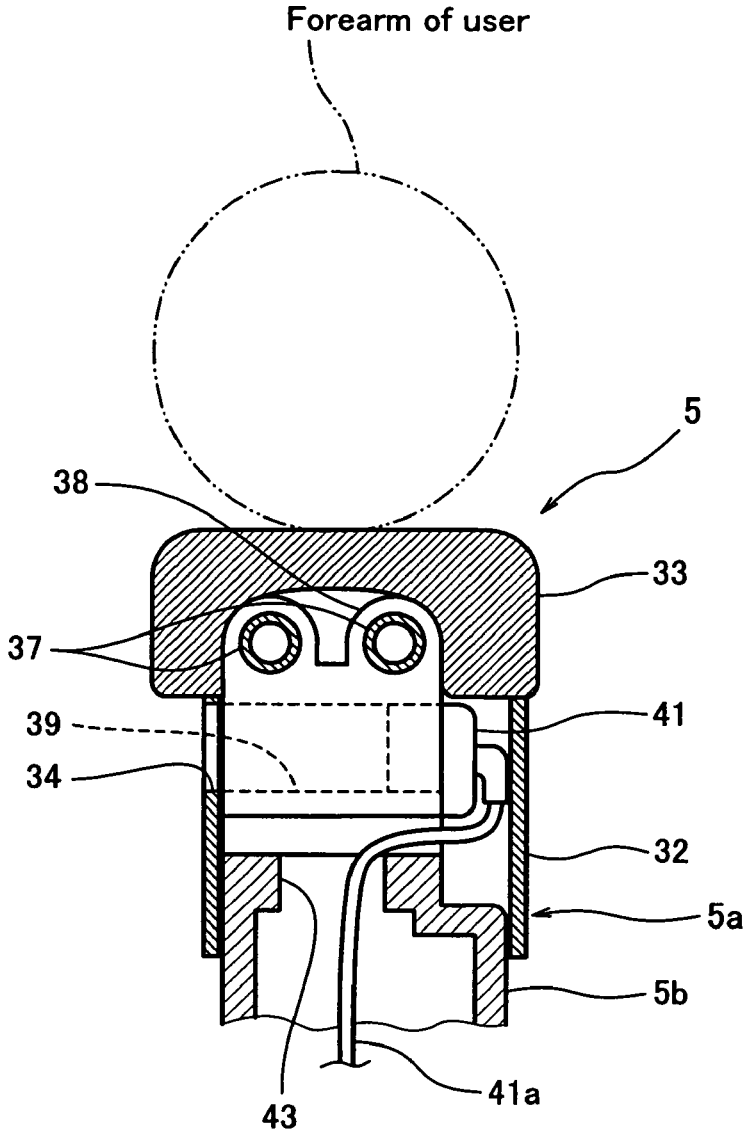
FIG. 6 is a partial cross-sectional front view illustrating the construction of an armrest when the forearm massager is not attached.

Next, the operation of the forearm massager 7 according to embodiment 1 will be described. When the massaging apparatus 1 is used as a mere comfort chair or when the massaging apparatus 1 is used for massaging a body member other than a forearm, the massaging apparatus 1 is used without being provided with the forearm massager 7. FIG. 6 is a partial cross-sectional front view illustrating the construction of the armrest 5 when the forearm massager 7 is not attached. As shown in FIG. 6, when the massaging apparatus 1 is used without being provided with the forearm massager 7, the user sits on the massaging apparatus 1 and uses the upper face of the support portion 33 as an elbowrest. This eliminates an obstacle to the upper part of the armrest 5 when an arm is placed thereon to allow the user to take a desired posture freely.

On the other hand, when the forearm massager 7 is used to massage the forearms of the user, then the user or the like attaches the forearm massagers 7 for a right arm and a left arm to the left and right armrests 5, respectively, as shown in FIG. 4. The forearm massager 7 is attached by allowing the fitting projection 40 of the forearm massager 7 to be fitted to the fitting groove 39 of the detachable member 38. Then, the fitting projection 40 is inserted to the fitting groove 39 until the plug 42 of the forearm massager 7 is coupled to the socket 41 of the armrest 5.

Figure 7:
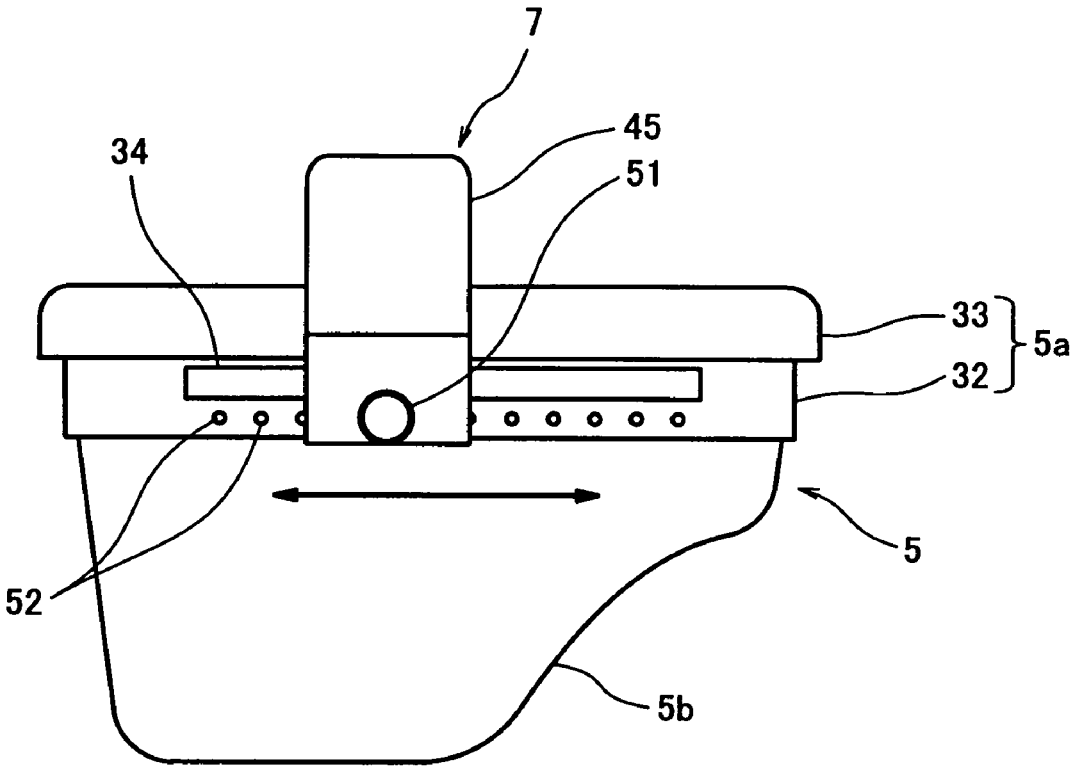
FIG. 7 is a schematic side view illustrating the operation for sliding the forearm massager according to embodiment 1 of the present invention forward and backward.

FIG. 7 is a schematic side view illustrating the operation for sliding the forearm massager 7 according to embodiment 1 of the present invention forward and backward. As shown in FIG. 7, the user manually slides the forearm massager 7 to a desired position. Then, the forearm massager 7 and the detachable member 38 are integrally moved along the guide rail 37 (see FIG. 3), thereby realizing the slide of the forearm massager 7 forward and backward. As described above, the massaging apparatus 1 according to embodiment 1 can adjust the position of the forearm massager 7 forward and backward in an easy manner.

When the position adjustment of the forearm massager 7 is finished, the fixation knob 51 is rotated and, at this position, the forearm massager 7 is fixed by allowing the hole 52 opposed to the threaded rod of the fixation knob 51 to be inserted with the tip end of the threaded rod. This allows the forearm massager 7 to be firmly fixed to the armrest 5 and prevents, when the forearm of the user is massaged by the forearm massager 7, the forearm massager 7 from being positioned in an instable manner due to the reactive force applied to the forearm massager 7 while the forearm of the user is pressed and can be reliably given a massaging pressure, thus further enhancing the massaging effect to the forearm of the user.

Figure 8:
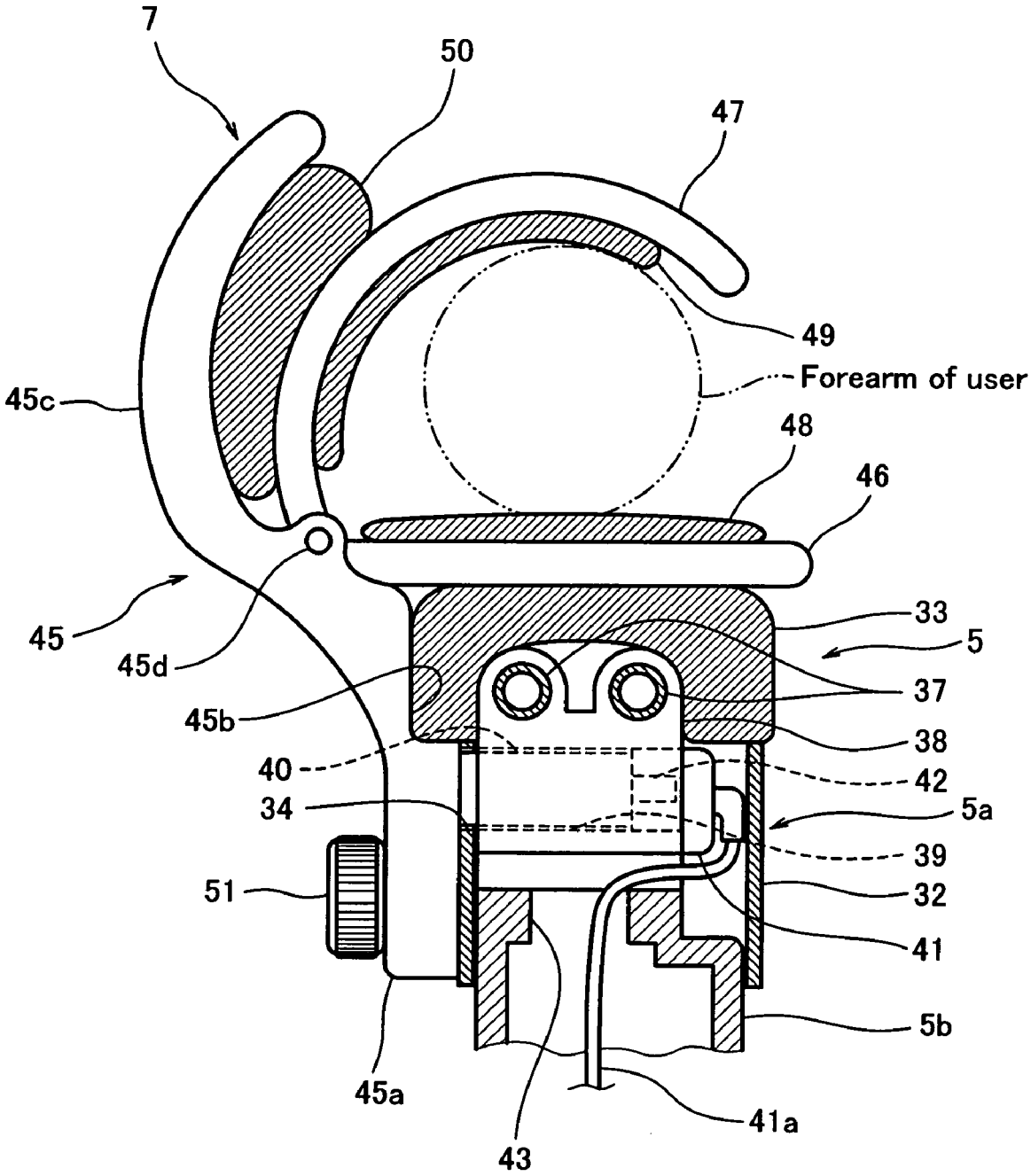
FIG. 8 is a partial cross-sectional front view for explaining the operation of the forearm massager according to embodiment 1 of the present invention.

Then, the user inserts the forearm between the fix and support portion 46 and the pressing portion 47 and performs an input to an operation panel (not shown) to instruct the massaging apparatus 1 to start the massaging operation. This instruction signal is given to the control circuit 53 and the control circuit 53 outputs a control signal in accordance with the instruction signal to the driving circuit 54. When receiving this control signal, the driving circuit 54 drives the air supply and exhaust device 9, thereby operating the forearm massager 7. FIG. 8 is a partial cross-sectional front view for explaining the operation of the forearm massager 7 according to embodiment 1 of the present invention. The operation of the air supply and exhaust device 9 allows the air bag 50 to be expanded as shown in FIG. 8 and the pressing portion 47 is rotated around the rotation axis 45*d* so as to be close to the fix and support portion 46, thereby allowing the forearm of the user to be sandwiched between the fix and support portion 46 and the pressing portion 47. The expanding operation of the air bag 50 in this situation may be provided by supplying air to the air bag 50 with a predetermined flow rate for a predetermined time or by measuring the pressure in the air bag 50 or of the fix and support portion 46 or the pressing portion 47 by a pressure sensor so that the air supply is continued until the measurement value by the pressure sensor reaches a predetermined value.

Next, while the air bag 50 being expanded, air supply to and air exhaust from the air bags 48 and 49 are repeated to allow the air bags 48 and 49 to have repeated expansion and contraction. This allows the forearm of the user to be provided with repeated strong and weak pressure stimulations.

As a result, while the forearm of the user being sandwiched between the fix and support portion 46 and the pressing portion 47, the air bags 48 and 49 give pressure stimulation to the forearm of the user. This can prevent the forearm of the user from escaping in the direction along which the pressure is applied to give the pressure stimulation by the air bags 48 and 49 to the forearm of the user in an efficient manner.

Although embodiment 1 described a construction in which the forearm massager 7 is slid manually, the present invention is not limited to this construction. Another construction also may be used in which an actuator (e.g., electric motor, air cylinder) is used to slide the forearm massager 7. In this case, the forearm massager 7 is slid forward and backward while the forearm of the user being provided with the pressure stimulation by air bags 48 and 49, thereby allowing the forearm of the user to be provided with a stimulation corresponding to a so-called rubbing kneading given by a massage practitioner.

Embodiment 2

Figure 9:
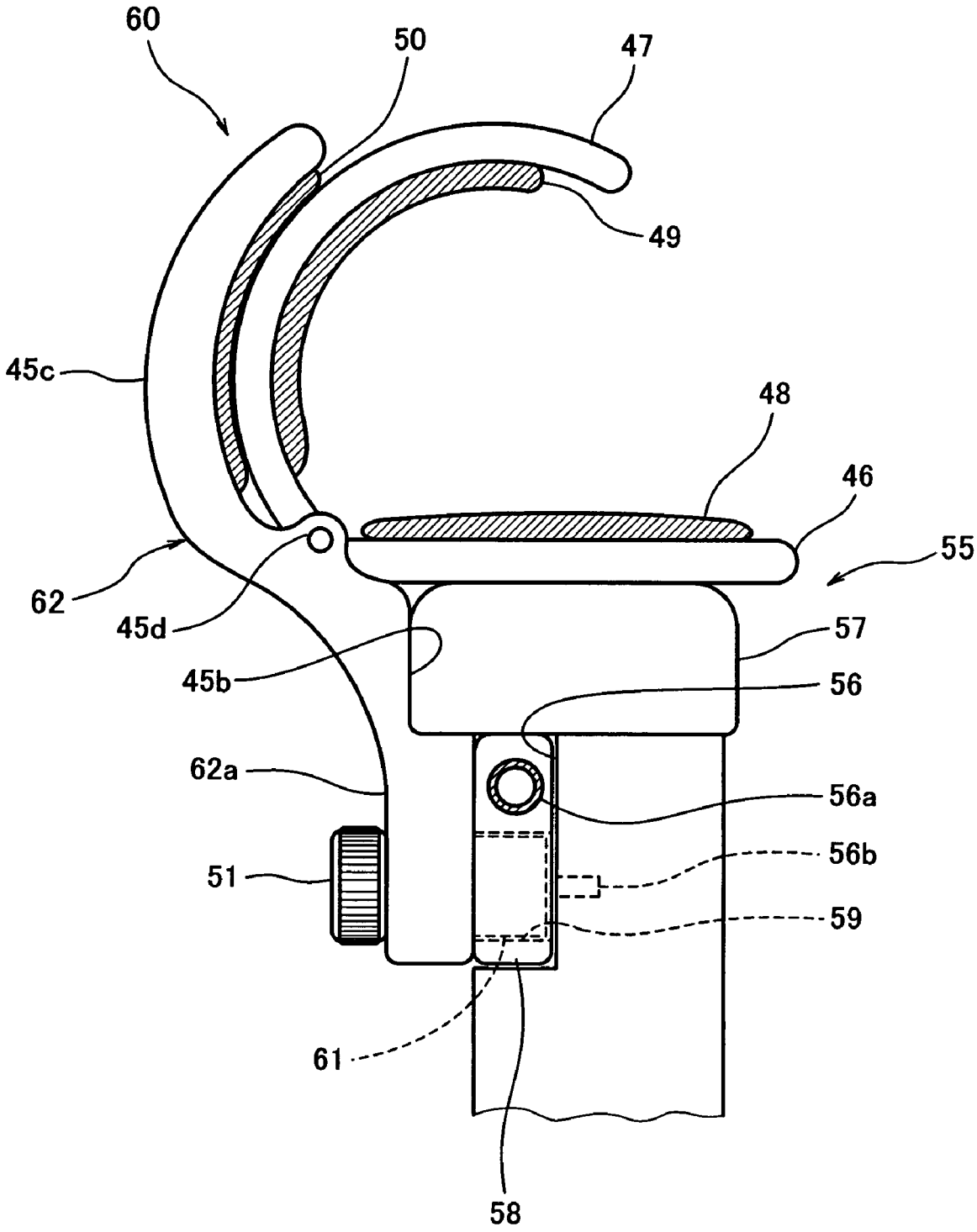
FIG. 9 is a partial cross-sectional front view illustrating the construction of a forearm massager according to embodiment 2 of the present invention.

FIG. 9 is a partial cross-sectional front view illustrating a forearm massager according to embodiment 2 of the present invention. As shown in FIG. 9, an armrest 55 of the massaging apparatus according to embodiment 2 has, at the outer face (i.e., right side face in the case of the right side armrest 55 or left side face in the case of the left side armrest 55, respectively), a groove 56 extending forward and backward. A support portion 57 for supporting the forearm of the user while having a contact thereto is provided above the groove 56. The support portion 57 is rounded and substantially rectangular plate-shaped. A round bar-like guide rail 56*a* is provided between the front and rear end faces of the groove 56 (not shown). The guide rail 56*a* penetrates, with an appropriate play, the substantially cuboid-like detachable member 58 having a size that can be loosely fitted with the groove 56. This allows the detachable member 58 to move along the guide rail 56*a* for the entire length of the groove 56 forward and backward.

The detachable member 58 has an outer shape that substantially conforms to that of the groove 56. This prevents the detachable member 58 from being rotated around the guide rail 56*a*.

The detachable member 58 is provided with a fitting hole 59 under a penetrating portion of the guide rail 56*a* so as to penetrate the detachable member 58 in the lateral direction. This fitting hole 59 can be engaged with a fitting protrusion 61 of a forearm massager 60 according to embodiment 2.

As shown in FIG. 9, a base 62 of the forearm massager 60 has a lower part that is provided as a flat-plate portion 62*a*. The flat-plate portion 62*a* is provided, when the forearm massager 60 is attached to the armrest 55, to be opposed to the outer face of the detachable member 58 while having a close contact with or being in the vicinity of the outer face. The fitting projection 61 protrudes from the flat surface part of the flat-plate portion 62*a* opposed to the detachable member 58.

The fitting projection 61 includes a plug of a coupling for an air piping (not shown). The plug can be removably mounted to a socket (not shown) provided in the detachable member 58. When the forearm massager 60 is attached, the plug is connected to the socket, thereby allowing the air bags 48 to 50 to be connected to the air supply and exhaust device 9.

A threaded hole (not shown) is provided in the lateral direction so as to penetrate the flat-plate portion 62*a* and the fitting projection 61. The threaded hole is threaded with the threaded rod of the fixation knob 51. A side face of the groove 56 (i.e., the right side face in the case of the groove 56 of the right side armrest 55 or the left side face in the case of the groove 56 of the left side armrest 55) includes a plurality of holes 56*b* arranged forward and backward in parallel to have a predetermined interval thereamong. This allows, when the forearm massager 60 is slid forward and backward to a desired position and the fixation knob 51 is rotated to be threaded, the tip end of the threaded rod to be inserted to one of the holes 56*b*, thereby allowing the forearm massager 60 to be fixed at the position.

The other components of the massaging apparatus according to embodiment 2 are the same as those of the massaging apparatus 1 according to embodiment 1 and thus are provided with the same reference numerals and will not be described further. The operation of the massaging apparatus according to embodiment 2 is also the same as that of the massaging apparatus 1 according to embodiment 1 and will not be described further.

Embodiment 3

Figure 10:
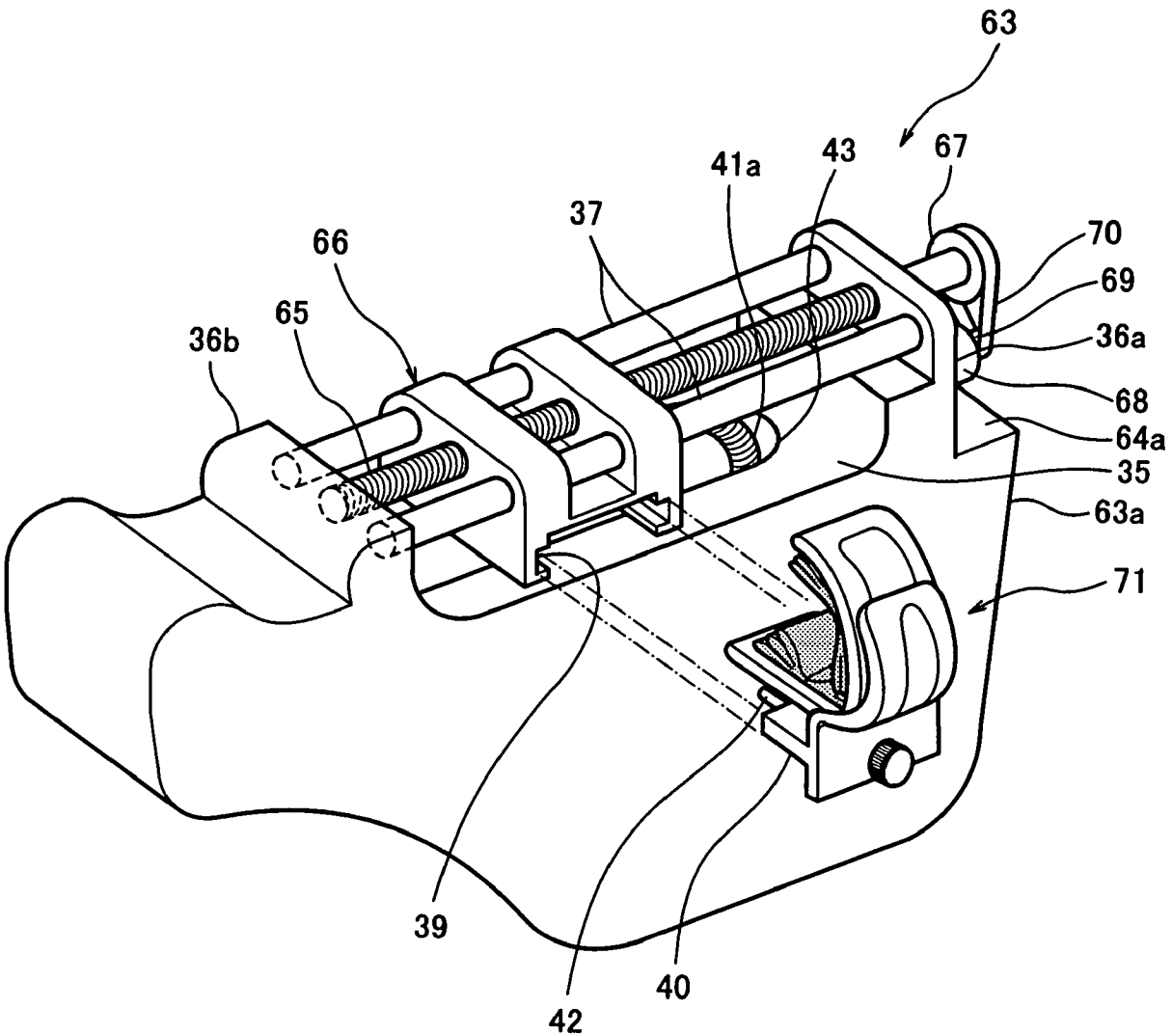
FIG. 10 is a perspective view illustrating the construction of a forearm massager according to embodiment 3 of the present invention.
Figure 11:
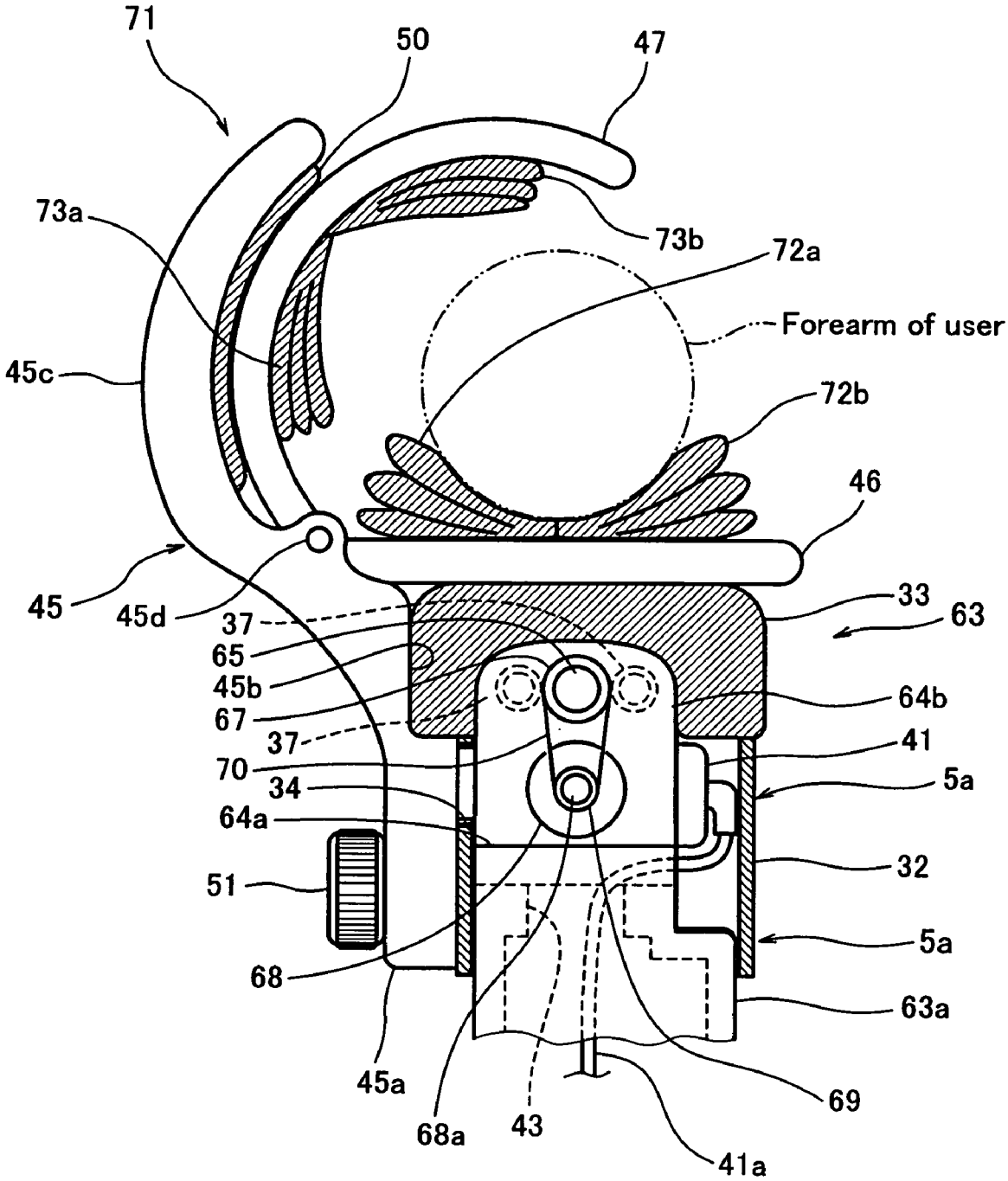
FIG. 11 is a partial cross-sectional front view illustrating the construction of the forearm massager according to embodiment 3 of the present invention.
Figure 12:
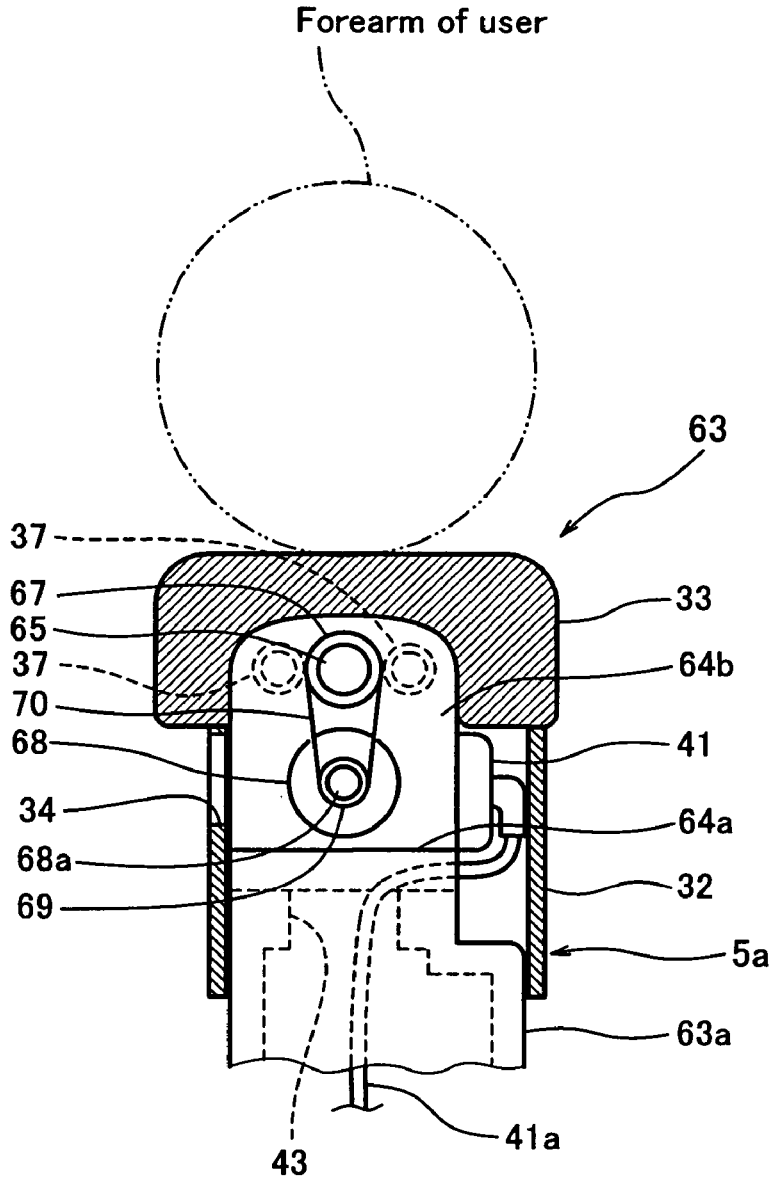
FIG. 12 is a partial cross-sectional front view illustrating the construction of an armrest when the forearm massager according to embodiment 3 of the present invention is not attached.

FIG. 10 is a perspective view illustrating the construction of a forearm massager according to embodiment 3 of the present invention. FIG. 11 is a partial cross-sectional front view thereof. FIG. 12 is a partial cross-sectional front view illustrating the construction of an armrest when the forearm massager according to embodiment 3 of the present invention is not attached. As shown in FIG. 10, in a base 63*a* of the armrest 63 according to embodiment 3, a portion forward of the protruding portion 36*a* is lacked to provide a stepped portion 64*a* having a substantially horizontal surface and an attachment face 64*b* that is continued from the stepped portion 64*a* and that has a substantially vertical face (see FIG. 11). The protruding portions 36*a* and 36*b* have a threaded rod 65 in parallel with the guide rail 37. The threaded rod 65 is supported by bearings (not shown) at the respective protruding portions 36*a* and 36*b* so as to be rotatable around a center axis. The threaded rod 65 also penetrates the protruding portion 36*a* and is provided to protrude by a predetermined length from the protruding portion 36*a*. A part between the protruding portion 36*a* and the protruding portion 36*b* of the threaded rod 65 is provided as a male threaded portion that is threaded with a female threaded portion provided at the detachable member 66.

As shown in FIG. 10, a surface of a part forward of the protruding portion 36*a* of the threaded rod 65 is not a threaded face but a smooth flat surface. As shown in FIG. 10 to FIG. 12, a toric pulley 67 is coaxially fixed to the front end of this part. A DC motor 68 is attached to the part of the attachment face 64*b* under the threaded rod 65 such that an output shaft 68*a* is in parallel with the threaded rod 65. A pulley 69 having a diameter that is larger than that of the pulley 67 is coaxially fixed to the tip end of the output shaft 68*a*. The pulleys 67 and 69 are coupled by a belt 70, thus allowing the rotation movement of the output shaft 68*a* of the motor 68 to be transmitted to the threaded rod 65 to rotate the threaded rod 65.

This motor 68 is connected to a driving circuit (not shown) connected to the control circuit 53 and is configured to be controlled by the control circuit 53 with regards to the operation. For example, when the user inputs to an operation panel (not shown) an instruction regarding the rubbing kneading operation to the forearm, then this instruction signal is given to the control circuit 53. Then, the control circuit 53 outputs a control signal to the driving circuit and the motor 68 is driven to repeat forward rotation and backward rotation. As a result, the threaded rod 65 is repeatedly rotated in both directions and the detachable member 66 and a forearm massager 71 attached to this are moved forward and backward in an integrated manner.

As shown in FIG. 11, two air bags 72*a* and 72*b* are arranged in parallel on an upper surface of the fix and support portion 46 of the forearm massager 71. Two air bags 73*a* and 73*b* are arranged in parallel on an inner peripheral face of the pressing portion 47. Each of the air bags 72*a*, 72*b*, 73*a*, and 73*b* has an accordion-like shape one end of which can be extended while the other end cannot be extended. When air is supplied to the air bags 72*a*, 72*b*, 73*a*, and 73*b*, one end of the accordion-like shape is extended so that the respective bag is expanded to have a substantially fan-like shape. The air bags 72*a* and 72*b* are attached in parallel to the upper face of the fix and support portion 46 so that the other ends that are unextendible are opposed to each other. The air bags 73*a* and 73*b* are also provided in parallel to the inner peripheral face of the pressing portion 47 so that the other ends that are unextendible are opposed to each other.

This allows the forearm of the user to be placed on the air bags 72*a* and 72*b* to expand the air bag 50 so that the fix and support portion 46 and the pressing portion 47 sandwich the forearm of the user while supplying air to the respective air bags 72*a*, 72*b*, 73*a*, and 73*b*. Then, the air bags 72*a* and 72*b* sandwich the lower part of the forearm of the user in the left-and-right direction and the air bags 73*a* and 73*b* sandwich the upper part of the forearm of the user in the left-and-right direction. The repeated air supply and exhaust to/from the air bag 72*a*, 72*b*, 73*a*, and 73*b* provide the repetition of the operation for sandwiching and releasing the forearm of the user in this way, thus providing the forearm of the user with a more preferable pressure stimulation.

The driving of the motor 68 can slide the forearm massager 71 forward and backward automatically. This can provide the forearm of the user with a stimulation corresponding to a so-called rubbing kneading given by a massage practitioner.

The other components of the massaging apparatus according to embodiment 3 are the same as those of the massaging apparatus 1 according to embodiment 1 and thus are provided with the same reference numerals and will not be described further. The operation of the massaging apparatus according to embodiment 3 is also the same as that of the massaging apparatus 1 according to embodiment 1 and will not be described further.

Embodiment 4

Figure 13:
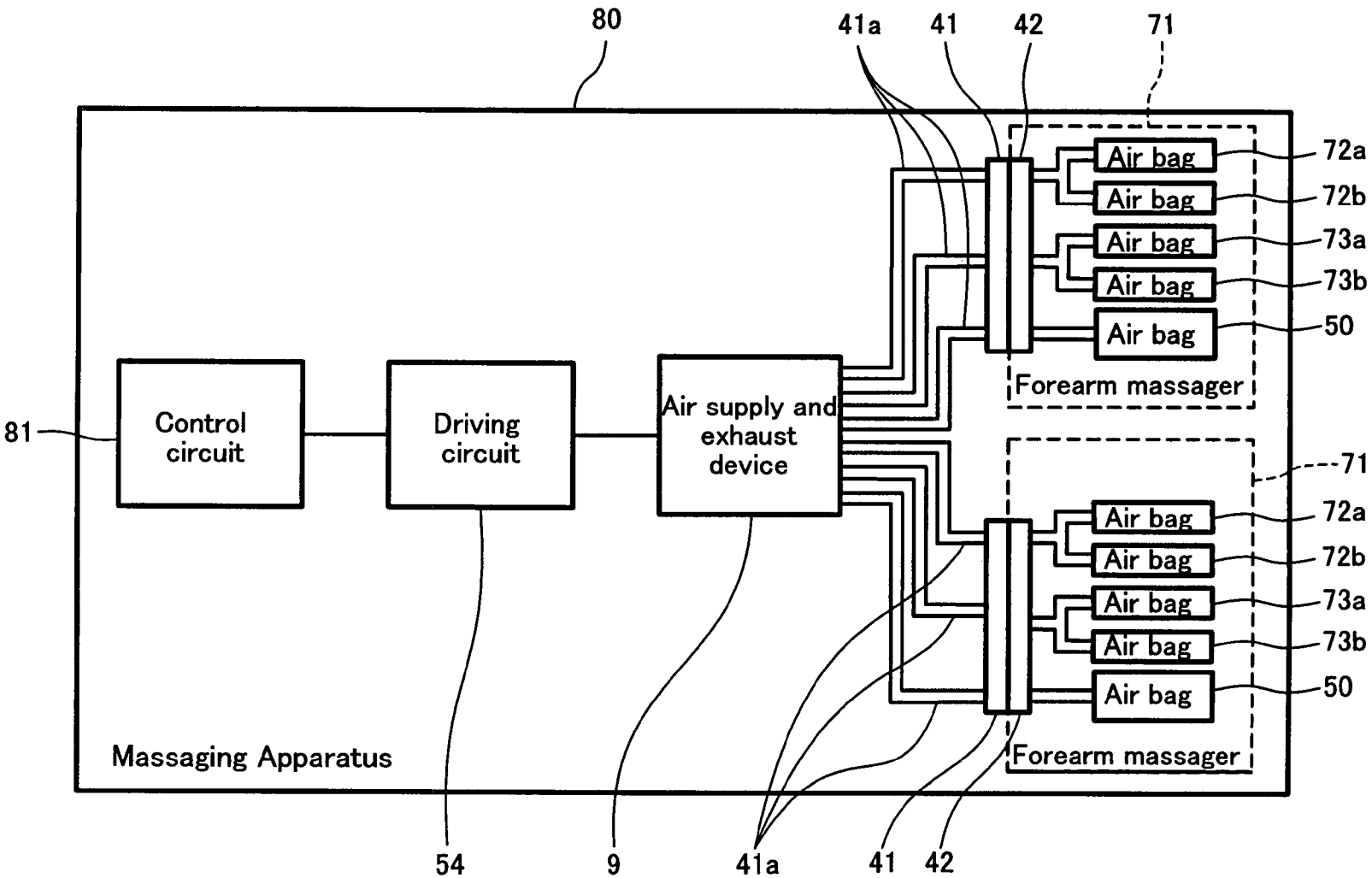
FIG. 13 is a block diagram illustrating a part of the construction of a massaging apparatus according to embodiment 4 of the present invention.

FIG. 13 is a block diagram illustrating a part of the construction of a massaging apparatus according to embodiment 4 of the present invention. A massaging apparatus 80 according to embodiment 4 includes a control circuit 81. This control circuit 81 is provided by a CPU, ROM, RAM, and an input/output interface (not shown) and the ROM stores therein a computer program for causing the massaging apparatus 80 to perform an operation as described later.

The other components of the massaging apparatus 80 according to embodiment 4 are the same as those of the massaging apparatus 1 according to embodiment 3 and thus are provided with the same reference numerals and will not be described further.

Figure 14:
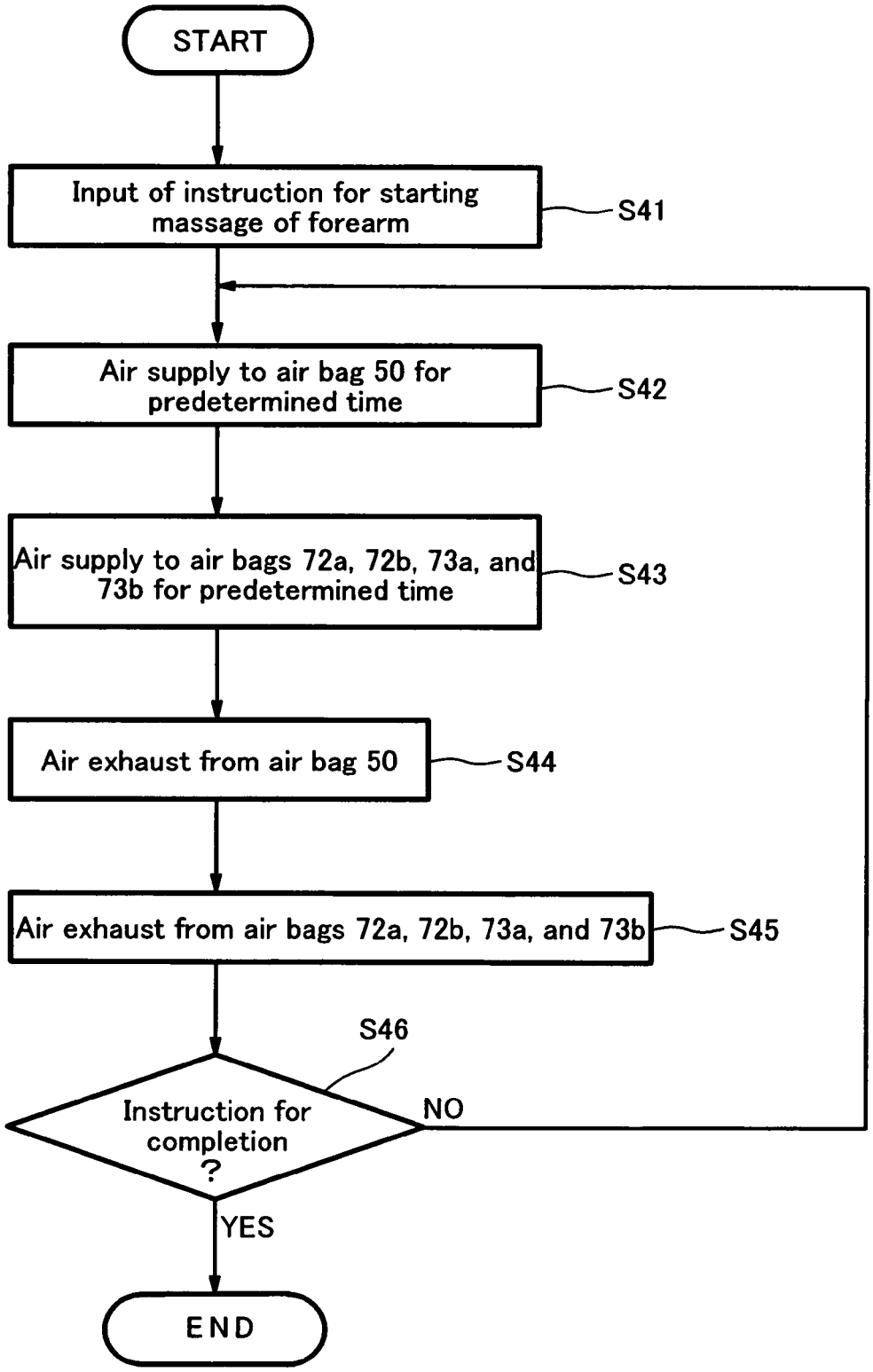
FIG. 14 shows a flowchart illustrating an example of the operation of the massaging apparatus according to embodiment 4 of the present invention.

Next, the massaging apparatus 80 according to embodiment 4 will be described with regards to the operation. FIG. 14 shows a flowchart illustrating an example of the operation of the massaging apparatus according to embodiment 4 of the present invention. The user sitting on the massaging apparatus 80 inserts the forearm between the fix and support portion 46 and the pressing portion 47 and performs an input to an operation panel (not shown) to instruct the massaging apparatus 80 to start the massage to the forearm (Step S41). The control circuit 81 sends a predetermined control signal to the driving circuit 54 to control the operation of the air supply and exhaust device 9 so that air is supplied to the air bag 50 for a predetermined time (Step S42). Thereafter, the control circuit 81 controls the operation of the air supply and exhaust device 9 so that air is supplied to the respective air bags 72*a*, 72*b*, 73*a*, and 73*b* for a predetermined time (Step S43). As a result of the processing in Step S41, the forearm of the user is covered by the air bag 72*a*, 72*b*, 73*a*, and 73*b* while the respective air bags 72*a*, 72*b*, 73*a*, and 73*b* are contracted (i.e., the pressure faces of the air bags 72*a* and 72*b* being away from each other and the pressure faces of the air bags 73*a* and 73*b* being away from each other). Thereafter, the air bags 72*a*, 72*b*, 73*a*, and 73*b* are expanded to allow the air bags 72*a* and 72*b* to sandwich the lower part of the forearm of the user in the left-and-right direction and to allow the air bags 73*a* and 73*b* to sandwich the upper part of the forearm of the user in the left-and-right direction.

When the predetermined time has passed since the start of the supply of air to the respective air bags 72*a*, 72*b*, 73*a*, and 73*b*, the control circuit 81 sends a predetermined control signal to the driving circuit 54 to control the operation of the air supply and exhaust device 9 so that air in the air bag 50 is exhausted (Step S44). As a result, the air bag 50 has contraction and the biasing force by the above-described bias means rotates the pressing portion 47 in the upward direction (in the direction along which the pressing portion 47 is away from the forearm of the user) while allowing the air bags 73*a* and 73*b* to be risen. This causes the forearm of the user to be pulled in the upward direction while being sandwiched by the air bags 72*a*, 72*b*, 73*a*, and 73*b*, thereby providing a so-called pull kneading to the forearm of the user.

When the predetermined time has passed since the start of the exhaust of air from the air bag 50, the control circuit 81 sends a predetermined control signal to the driving circuit 54 to control the operation of the air supply and exhaust device 9 so that air is exhausted from the respective air bags 72*a*, 72*b*, 73*a*, and 73*b* (Step S45). As a result, the pressure force to the forearm of the user is released.

Then, the control circuit 81 determines whether or not the completion of the massage of the forearm is instructed by the user (Step S46). When the completion is not instructed, the processing returns to Step S42. When the completion is instructed in Step S46, the processing is completed.

Thus, the pull kneading of the forearm by the forearm massager 71 is repeatedly performed so long as an instruction by the user to complete the massaging of the forearm is not received. The massaging strength to the forearm can be adjusted by allowing the user to input a predetermined operation to an operation panel (not shown). When this massaging strength is increased, a time for supplying air in Steps S42 and S43 to the respective air bags 50, 72*a*, 72*b*, 73*a*, and 73*b* is set to be longer. When the massaging strength is reduced, the air supply time is set to be shorter. The adjustment of the massaging strength can be provided not only by the structure configured to adjust the air supply time but also by a structure configured to adjust the pressure of the air supplied to the respective air bags 50, 72*a*, 72*b*, 73*a*, and 73*b* to adjust the massaging strength or a structure configured to adjust the flow rate per a unit time of the air supplied to the respective air bags 50, 72*a*, 72*b*, 73*a*, and 73*b* to adjust the massaging strength.

The other components of the massaging apparatus 80 according to embodiment 4 are the same as those of the massaging apparatus according to embodiment 3 and thus will not be described further.

Embodiment 5

Figure 15:
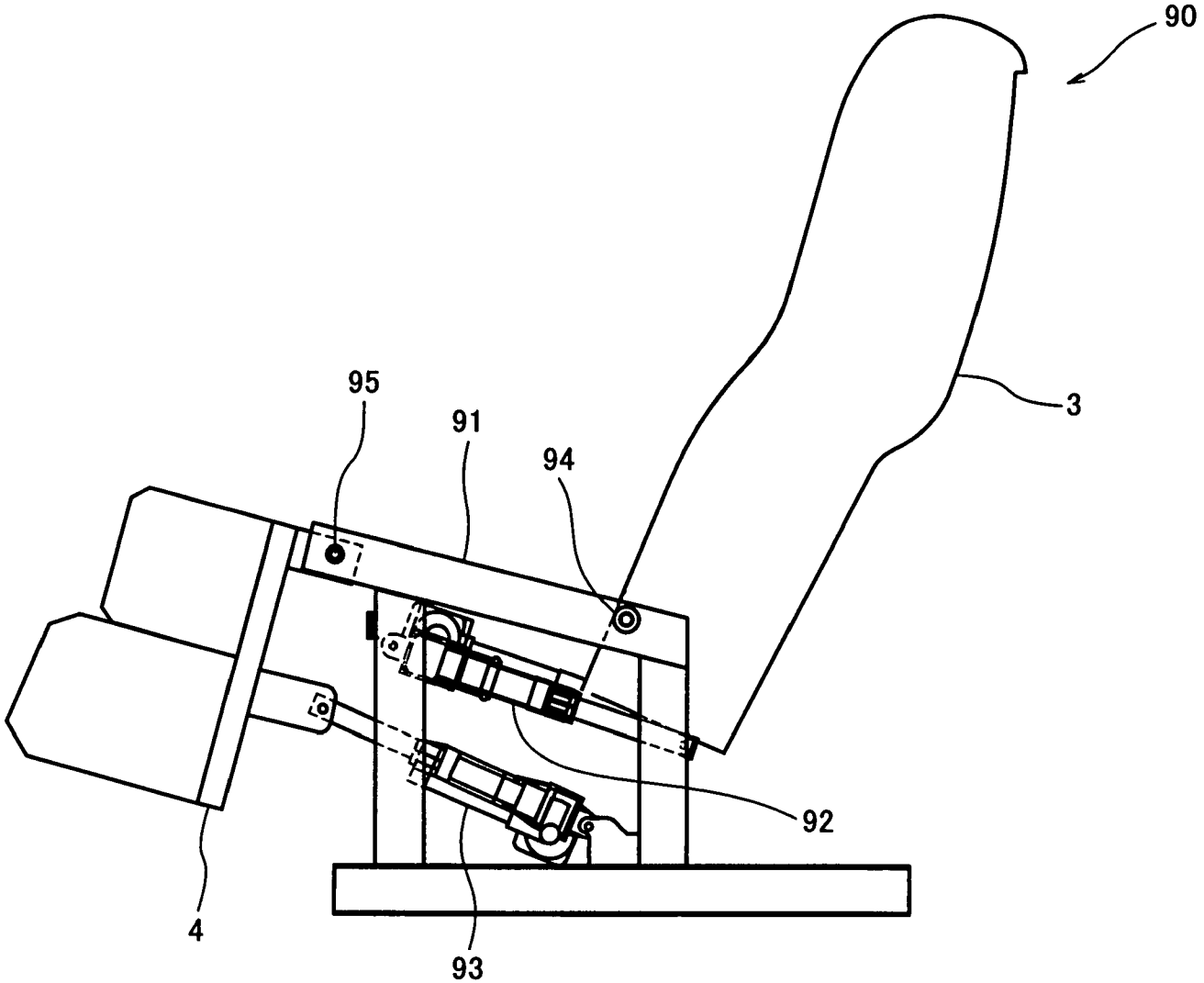
FIG. 15 is a side view illustrating a rotation construction of a backrest of a massaging apparatus according to embodiment 5 of the present invention.

FIG. 15 is a side view illustrating a rotation construction of a backrest of a massaging apparatus according to embodiment 5 of the present invention. As shown in FIG. 15, a massaging apparatus 90 according to embodiment 5 is provided such that the seat 2 has therein a frame structure 91. This frame structure 91 is provided with the two direct acting type actuators 92 and 93. One end of the direct acting type actuator 92 is pivotally mounted to the frame structure 91 so that the direct acting type actuator 92 can be pivoted around a pivot extending in the lateral direction. The other end of the direct acting type actuator 92 is pivotally mounted to the lower end portion of the backrest 3 so that the direct acting type actuator 92 can be pivoted around the pivot extending in the lateral direction. The direct acting type actuators 92 and 93 respectively have a construction that has an electric motor so that the rotation movement of the output shaft of the electric motor is converted to a straight movement to allow the direct acting type actuators 92 and 93 themselves to have expansion and contraction. This direct acting type actuator 92 is pivotally mounted to the frame structure 91 at a position forward of a position at which the direct acting type actuator 92 is pivotally mounted to the backrest 3 so that the direct acting type actuator 92 extends in the substantially forward and backward. The backrest 3 is pivotally supported, in the vicinity of the lower end thereof, by the frame structure 91 by the pivot 94 extending in the lateral direction. This construction allows, when the direct acting type actuator 92 has expansion and contraction, the backrest 3 to rotate around a pivot 94 forward and backward, thereby changing the reclining angle.

One end of the direct acting type actuator 93 is pivotally mounted to the frame structure 91 so that the direct acting type actuator 93 can be pivoted around a pivot extending in the lateral direction. The other end of the direct acting type actuator 93 is pivotally mounted to the lower part of the footrest 4 so that the direct acting type actuator 93 can be pivoted around a pivot extending in the lateral direction. The position at which this direct acting type actuator 93 is pivotally mounted to the frame structure 91 is rearward of the position at which the direct acting type actuator 93 is pivotally mounted to the footrest 4 so that the direct acting type actuator 93 extends in a substantially forward and backward. The footrest 4 is pivotally supported, in the vicinity of the upper end thereof, by the frame structure 91 by a pivot 95 extending in the lateral direction. This allows, when the direct acting type actuator 93 has expansion and contraction, the footrest 4 to rotate around the pivot 95 forward and backward, thereby changing the inclining angle of the footrest 4.

Figure 16:
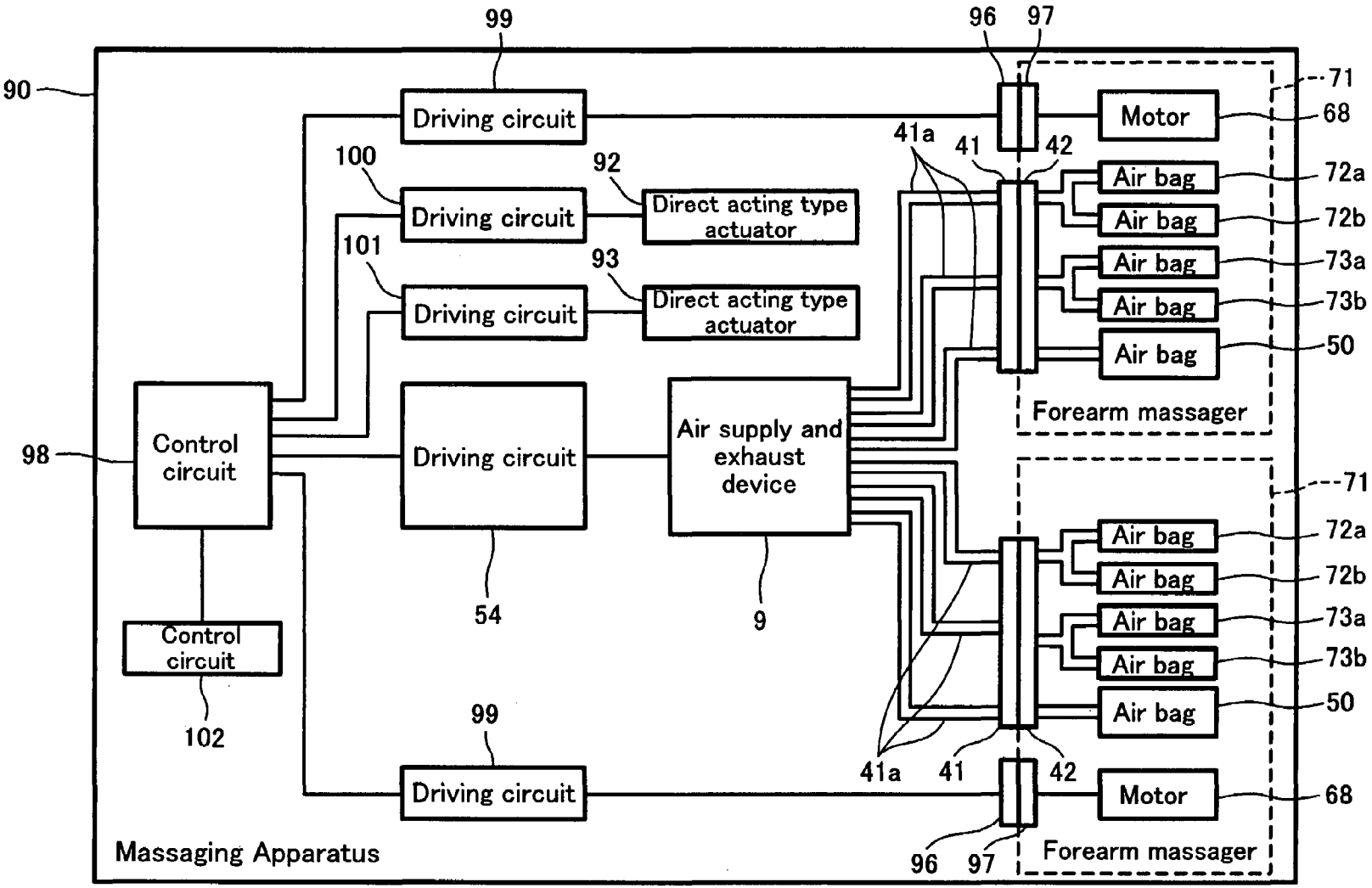
FIG. 16 is a block diagram illustrating a part of the construction of the massaging apparatus according to embodiment 5 of the present invention.

FIG. 16 is a block diagram illustrating a part of the construction of the massaging apparatus according to embodiment 5 of the present invention. As shown in FIG. 16, the massaging apparatus 90 according to embodiment 5 is provided such that the plug 42 of the forearm massager 71 (see FIG. 11) is integrated with a plug 97 for connecting an electric wiring and a socket 96 that can be connected to this plug 97 is integrated with the socket 41 for connecting an air piping. The socket 96 and plug 97 are configured to be connected when the connection is made between the socket 41 and the plug 42. A cable for transmitting an electric signal is extended from the plug 97 and is connected to the motor 68 (see FIG. 11).

On the other hand, the seat 2 or the backrest 3 has therein a control circuit 98 provided by CPU, ROM, RAM, and an input/output interface. This control circuit 98 is connected to the driving circuit 54 for driving the air supply and exhaust device 9 so that the control circuit 98 can transmit an electric signal (control signal) to the driving circuit 54. The control circuit 98 as described above is connected to two driving circuits 99 for separately driving the motors 68 separately provided in the two forearm massagers 71 so that the control circuit 98 can transmit a control signal to the two driving circuits 99. The control circuit 98 is also connected to driving circuits 100 and 101 for separately driving the direct acting type actuators 92 and 93 so that the control circuit 98 can transmit a control signal to the driving circuits 100 and 101. The respective driving circuits 54, 99, 100, and 101 are configured to drive, in accordance with the control signal received from the control circuit 98, the air supply and exhaust device 9, the motors 68, and the direct acting type actuators 92 and 93. The ROM of the control circuit 98 stores therein a computer program for causing the massaging apparatus 90 to execute an operation as described later.

The control circuit 98 is connected with an operation portion 102 (e.g., remote controller including a plurality of operation keys). When the user presses the operation keys to perform various operations, this operation signal is sent to the control circuit 98.

The other components of the massaging apparatus 90 according to embodiment 5 are the same as those of the massaging apparatus according to embodiment 3 and thus are provided with the same reference numerals and will not be described further.

Next, the massaging apparatus 90 according to embodiment 5 of the present invention will be described with regards to the operation. The massaging apparatus 90 according to embodiment 5 can provide, by allowing the CPU of the control circuit 98 to execute the above-described computer program stored in the ROM, the operation as described below.

When the user depresses a predetermined operation key of the operation portion 102 to incline the backrest 3 in the rearward direction (i.e., to lay the backrest 3 in the horizontal direction), the operation signal representing this operation is given to the control circuit 98. This allows the control circuit 98 to send to the driving circuit 100 a control signal for causing the direct acting type actuator 92 to have contraction in accordance with the amount and rate specified by the instruction by the user. On receiving the control signal, the driving circuit 100 causes the direct acting type actuator 92 to have contraction in accordance with the amount and rate, thus allowing the backrest 3 to be inclined in the rearward direction until the angle specified by the user is reached.

Then, when transmitting the control signal to the driving circuit 100, the control circuit 98 simultaneously transmits to the driving circuits 99 a control signal for sliding the respective forearm massagers 71 in the rearward direction. On receiving this control signal, the driving circuit 99 provides the driving with the amount, direction, and rate in accordance with the inclination angle, operation direction (backward), and operation rate of the backrest 3, thereby sliding the forearm massagers 71 in the backward direction in synchronization with the backward inclination of the backrest 3.

When the user depresses a predetermined operation key of the operation portion 102 to instruct an operation for standing the backrest 3 in the forward direction, the operation signal representing this operation is given to the control circuit 98. This allows the control circuit 98 to send to the driving circuit 100 a control signal for causing the direct acting type actuator 92 to have extension in accordance with the amount and rate specified by the instruction by the user. On receiving the control signal, the driving circuit 100 causes the direct acting type actuator 92 to have extension in accordance with the amount and rate, thus standing the backrest 3 in the forward direction until the angle specified by the user is reached.

Then, when transmitting the control signal to the driving circuit 100, the control circuit 98 simultaneously transmits to the driving circuits 99 a control signal for sliding the respective forearm massagers 71 in the forward direction, respectively. On receiving this control signal, the driving circuit 99 provides the driving with the amount, direction, and rate depending on the inclination angle, operation direction (forward), and operation rate of the backrest 3, thereby sliding the forearm massager 71 in the forward direction in synchronization with the forward standing of the backrest 3.

When the user inclines the backrest 3 in the rearward direction or stands the backrest 3 in the forward direction, the upper half body of the user is also inclined in the rearward direction or is stood in the forward direction, thus causing the forearm of the user to be dislocated to the armrest 5 in the rearward direction or in the forward direction. However, the operation as described above causes the forearm massagers 71 to be slid in the rearward or forward direction in accordance with the rearward or forward dislocation of the forearm of the user, thus preventing the massaged portion of the forearm of the user from being changed due to the reclining operation of the backrest 3. Specifically, even when the reclining angle of the backrest 3 is changed, the substantially same portion of the forearm of the user is massaged by the forearm massagers 71 before and after the change.

The other components of the massaging apparatus 90 according to embodiment 5 are the same as those of the massaging apparatus according to embodiment 3 and thus will not be described further.

Embodiment 6

Figure 17:
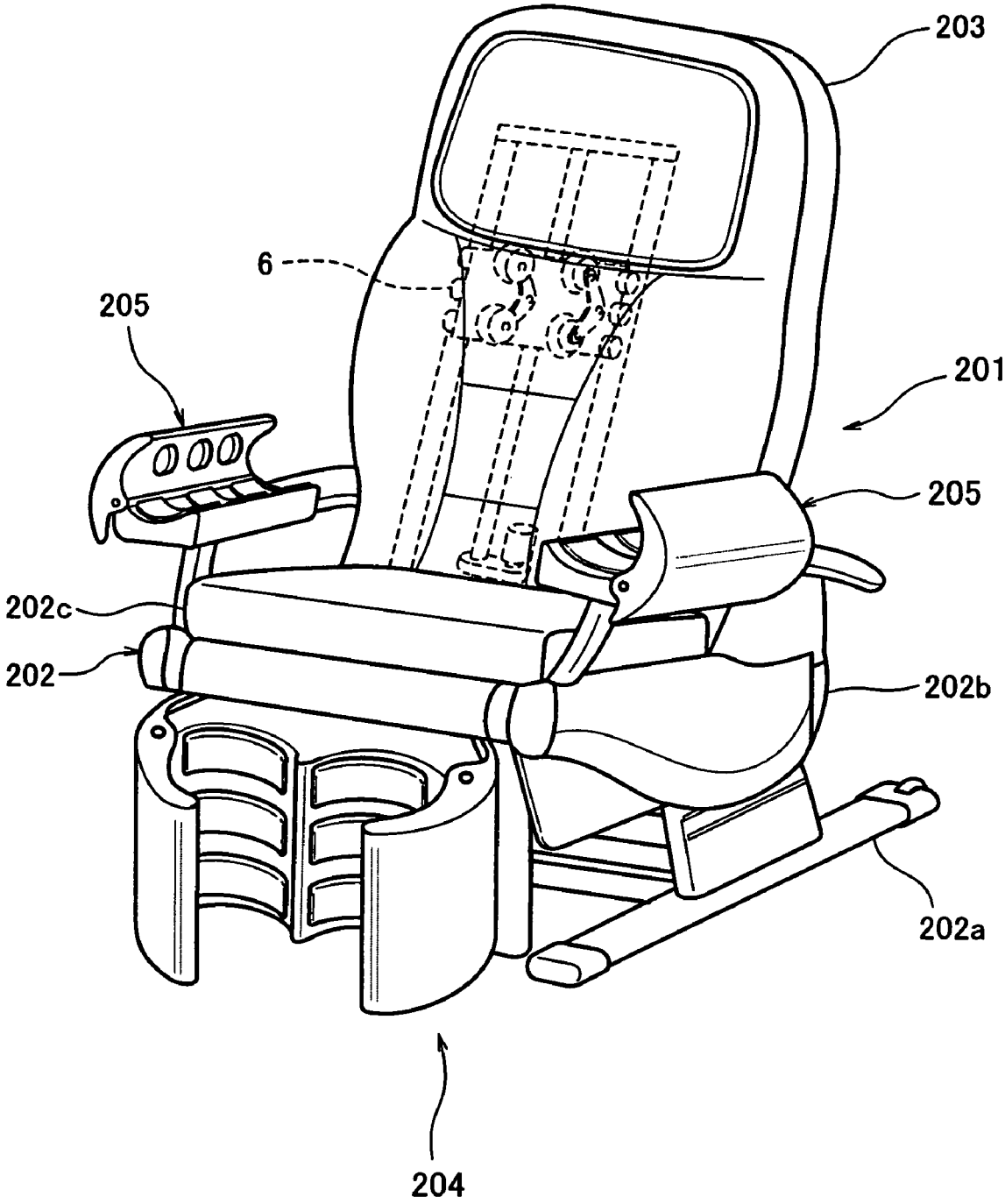
FIG. 17 is a perspective view illustrating the construction of a massaging apparatus according to embodiment 6 of the present invention.

FIG. 17 is a perspective view illustrating the construction of a massaging apparatus according to embodiment 6 of the present invention. In a massaging apparatus 201 according to embodiment 6 is provided as shown in FIG. 17, a seat 202 is provided so that a base 202*b* (which has at both sides of the lower parts thereof the horizontally provided leg portions 202*a*) have at the upper part thereof a cushion portion 202*c* having a substantially flat upper part to be used as a seating surface. The cushion portion 202*c* is configured such that an inner packing material (not shown) made of urethane foam, sponge, or polystyrene foam is provided at the upper face of the base 202*b* and the inner packing material is covered by an outer packaging material (cover) formed of polyester-made raised tricot, synthetic leather, natural leather or the like. The front side of the upper part of the seat 202 is pivotally mounted with the upper end portion of a footrest 204 for massaging the ankle and calf of the user, thus allowing the footrest 204 to be rotated around the upper end portion forward and backward.

A backrest 203 also has at both sides thereof armrests 205 fixedly supported by the seat 202, respectively. This armrests 205 extend from both ends of the backrest 203 in the frontward direction and can be used as an elbowrest when the user sits on the massaging apparatus 201.

Figure 18:
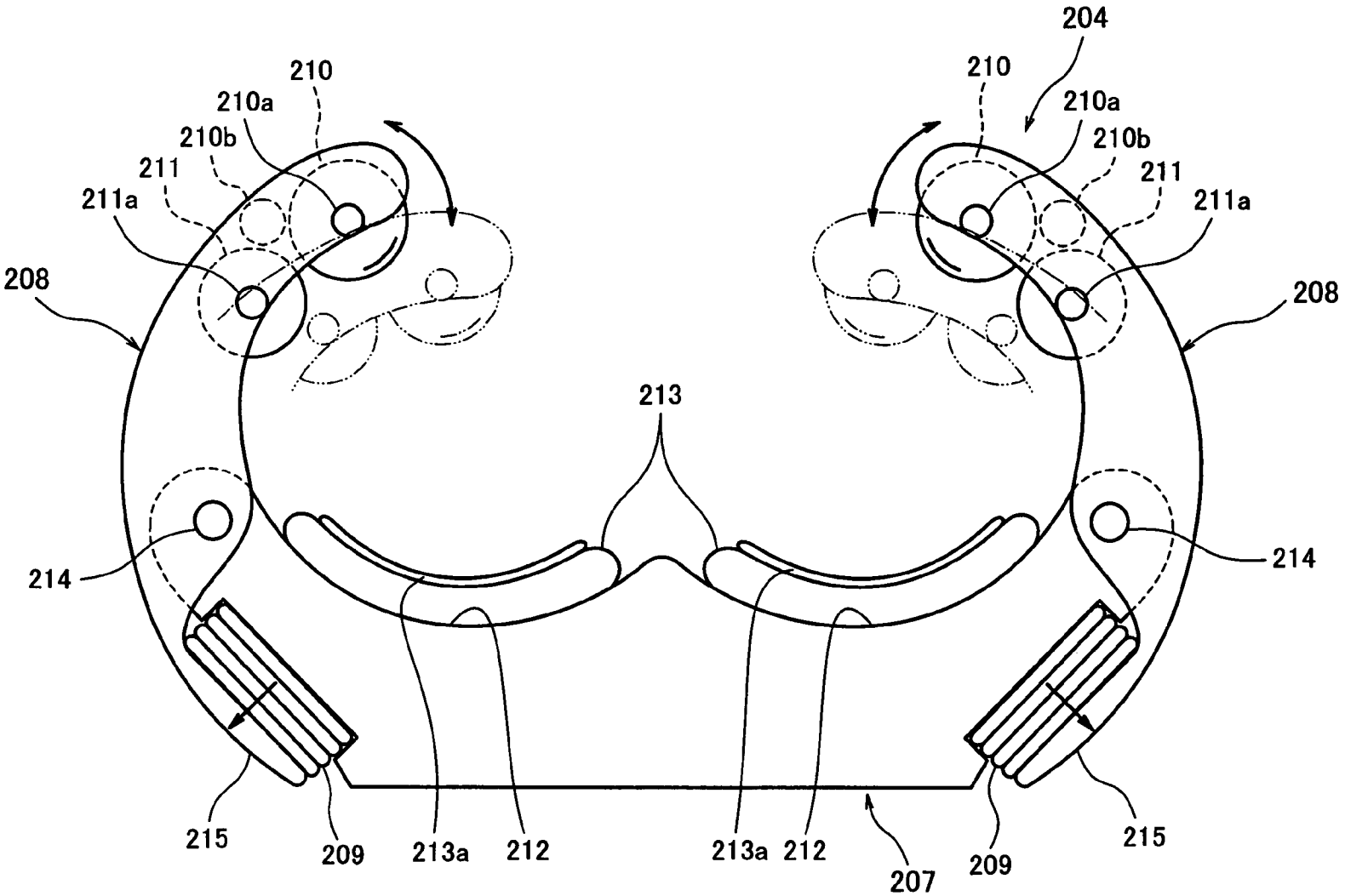
FIG. 18 is a top view illustrating the construction of a footrest of the massaging apparatus according to embodiment 6 of the present invention.

Next, the footrest 204 and the armrest 205 will be described further in detail with regards to the construction. FIG. 18 is a top view illustrating the construction of the footrest 204 of the massaging apparatus 201 according to embodiment 6 of the present invention. As shown in FIG. 18, the footrest 204 mainly includes a support base 207, rotation portions 208, air bags 209, and rollers 210 and 211. The support base 207 is provided such that the front face thereof has two concave-shaped circular arc faces 212 that are arranged in the left-and-right direction and that have the axes in the vertical direction. These concave-shaped circular arc faces 212 are used to support the calf of the user. Air bags 213 are fixed to the concave-shaped circular arc face 212. When being supplied with air, the air bags 213 can be expanded to provide stimulation to the calf of the user.

The air bag 213 is provided with a sheet-like heating element 213*a* on a surface thereof. This heating element 213*a* is configured to generate heat when being driven, thereby heating the calf of the user.

Rotation portions 208 are provided on both lateral sides of the support base 207 so as to be rotatable rightward and leftward, respectively, around the pivots 214 in the longitudinal direction. These rotation portions 208 have a substantially circular arc plate-like shape and the concave inner face thereof is provided to be opposed to the concave-shaped circular arc face 212 so as to conform in shape to the lower thigh of the user.

The rotation portion 208 is provided with the roller 210 at a front end thereof. The roller 210 is provided to be rotatable by the pivot 210*a* that is substantially in parallel with the pivot 214 and functions as a massaging portion of the present invention. A roller 211 is rotatably attached by the pivot 211*a* at a position of the rotation portion 208 which is slightly rearward of the position where the roller 210 is attached. These rollers 210 and 211 are made of a material having an elasticity corresponding to that of a thumb of a human (e.g., rubber, sponge).

In the vicinity of the rollers 210 and 211 in the rotation portion 208, there is provided a vibrator 210*b* provided by a motor in which a rotation axis is provided with an eccentric mass, for example. The operation of this vibrator 210*b* allows the rotation portion 208 to be vibrated.

The rotation portion 208 is pivotally mounted to the support base 207 at the middle of the circumference direction (forward and backward) of the circular arc thereof. The part of the rotation portion 208 rearward of this pivot 214 is a pushed portion 215. In other words, the rotation portion 208 has the pushed portion 215 that is extended, with regards to the rotation center (pivot), to the substantially opposite side of the position at which the rollers 210 and 211 are attached. The face of this pushed portion 215 opposed to the support base 207 has a substantially flat face to which the air bag 209 is fixed.

The part of the support base 207 opposed to the pushed portion 215 has a concave portion to which the air bag 209 is fixed. This air bag 209 has an accordion-like shape in which the part fixed to the pushed portion 215 and the part fixed to the support base 207 have therebetween a part that is folded a plurality of times. This shape allows, when the air bag 209 is supplied with air (air supply), the air bag 209 to be extended to rotate the rotation portion 208 in the direction along which the rotation portion 208 is close to the concave-shaped circular arc face 212 serving as a support face of the present invention (hereinafter referred to as close direction). The support base 207 and the rotation portion 208 are provided with a spring (not shown) that biases the rotation portion 208 in the direction along which the rotation portion 208 is away from the concave-shaped circular arc face 212 (hereinafter referred to as open direction). This allows, when the air bags 209 are communicated with ambient air and the air in the air bags 209 is exhausted (air exhaust), the respective rotation portions 208 to be opened to both lateral sides until the limitation is reached. As a result, when the user sits on the massaging apparatus 201, the rotation portion 208 is opened, thus allowing the leg portion to be provided on the footrest 204 in an easy manner. In this way, the air bag 209 and the spring constitute the driving portion according to the present invention.

Although embodiment 6 provided the driving portion according to the present invention by the air bag 209 and the spring, the present invention is not limited to this. For example, the driving portion also may be provided by another actuator (e.g., electric motor, electric cylinder, fluid cylinder).

Although embodiment 6 provided the footrest 204 having an integrated structure for holding left and right legs, the present invention is not limited to this. The footrest 204 also may have another construction in which a portion for holding a left leg and a portion for holding a right leg are provided separately.

Figure 19:
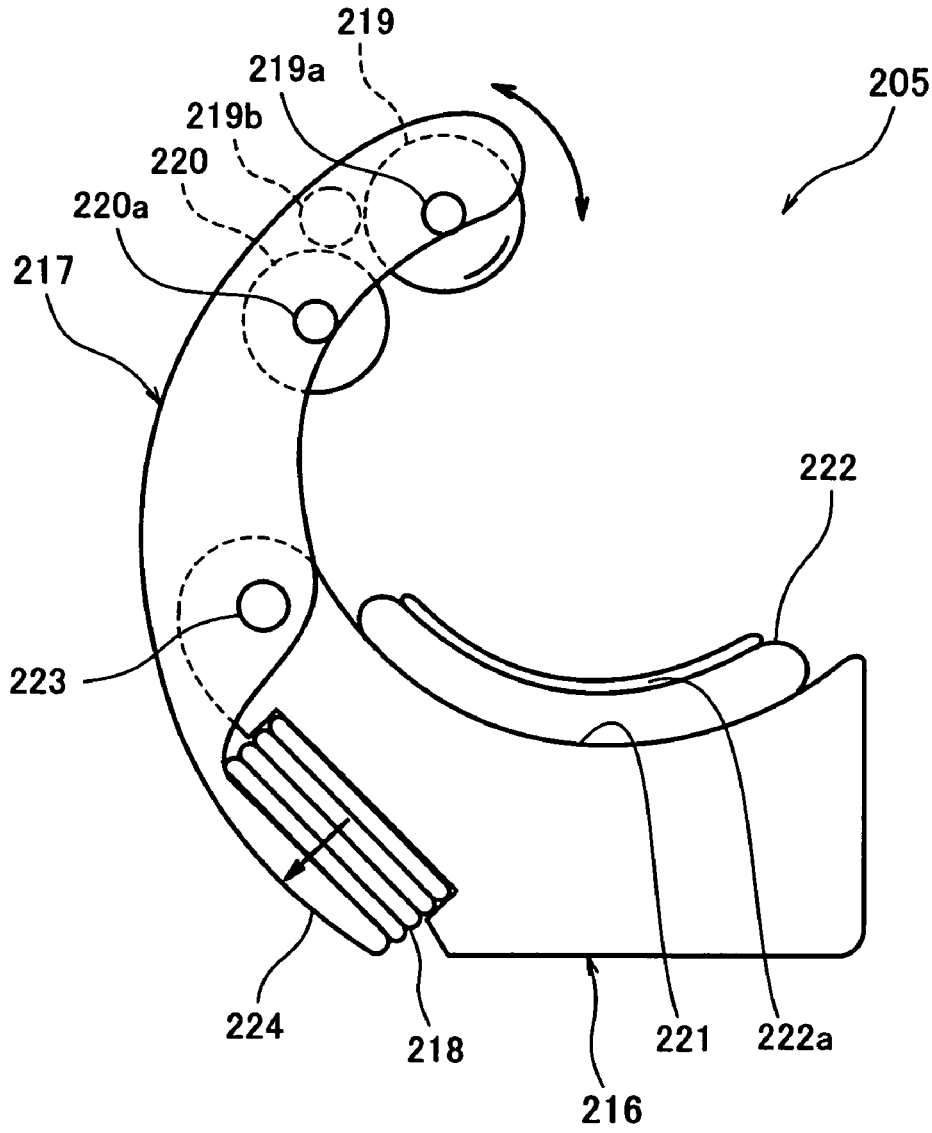
FIG. 19 is a front view illustrating the construction of an armrest of the massaging apparatus according to embodiment 6 of the present invention.

FIG. 19 is a front view illustrating the construction of the armrest 205 of the massaging apparatus 201 according to embodiment 6 of the present invention. As shown in FIG. 19, the armrest 205 mainly includes a support base 216, a rotation portion 217, an air bag 218, and rollers 219 and 220. The armrest 205 has a structure as described below that has the substantially the same construction as that of one of the two portions obtained by dividing the above-described footrest 204 at the edge line between the two concave-shaped circular arc faces 212.

The support base 216 has an upper face that is provided as the one concave-shaped circular arc face 221 having the axis forward and backward. This concave-shaped circular arc face 221 is used to support the forearm of the user. The air bag 222 is fixed to the concave-shaped circular arc face 221. When being supplied with air, the air bag 222 can be expanded to provide stimulation to the forearm of the user. The heating element 222*a* having the same construction as that of the above-described heating element 213*a* is provided on the surface of the air bag 222.

The support base 216 has at the outer side thereof the rotation portion 217 that can be rotated in the left-and-right direction by the pivot 223 forward and backward. This rotation portion 217 has a substantially circular arc plate shape and is arranged such that the concave-shaped inner face is provided to be opposed to the concave-shaped circular arc face 221 so as to conform in shape to the forearm of the user.

The rotation portion 217 is provided with the roller 219 at an upper end thereof that is rotatable by the pivot 219*a* that is substantially in parallel with the pivot 223. A roller 220 is rotatably attached by the pivot 220*a* at a position of the rotation portion 217 which is slightly lower than the position where the roller 219 is attached. In the vicinity of these rollers 219 and 220, a vibrator 219*b* that has the same construction as that of the above-described vibrator 210*b* is provided.

The rotation portion 217 is pivotally mounted to the support base 216 at the middle of the circumference direction (up-and-down direction) of the circular arc thereof. The part of the rotation portion 217 rearward of this pivot 223 is the pushed portion 224. A face of this pushed portion 224 opposed to the support base 216 has a substantially flat face to which the air bag 218 having the same construction as that of the above-described air bag 209 is fixed. This air bag 218 is fixed to a concave portion provided to a part of the support base 216 opposed to the pushed portion 215. The support base 216 and the rotation portion 217 are provided with a spring (not shown) for biasing the rotation portion 217 in the open direction.

This structure allows, when the user sits on the massaging apparatus 201, the rotation portion 217 to be opened as in the case of the footrest 204, thus allowing the arm portion to be placed on the armrest 205 in an easy manner.

Figure 20:
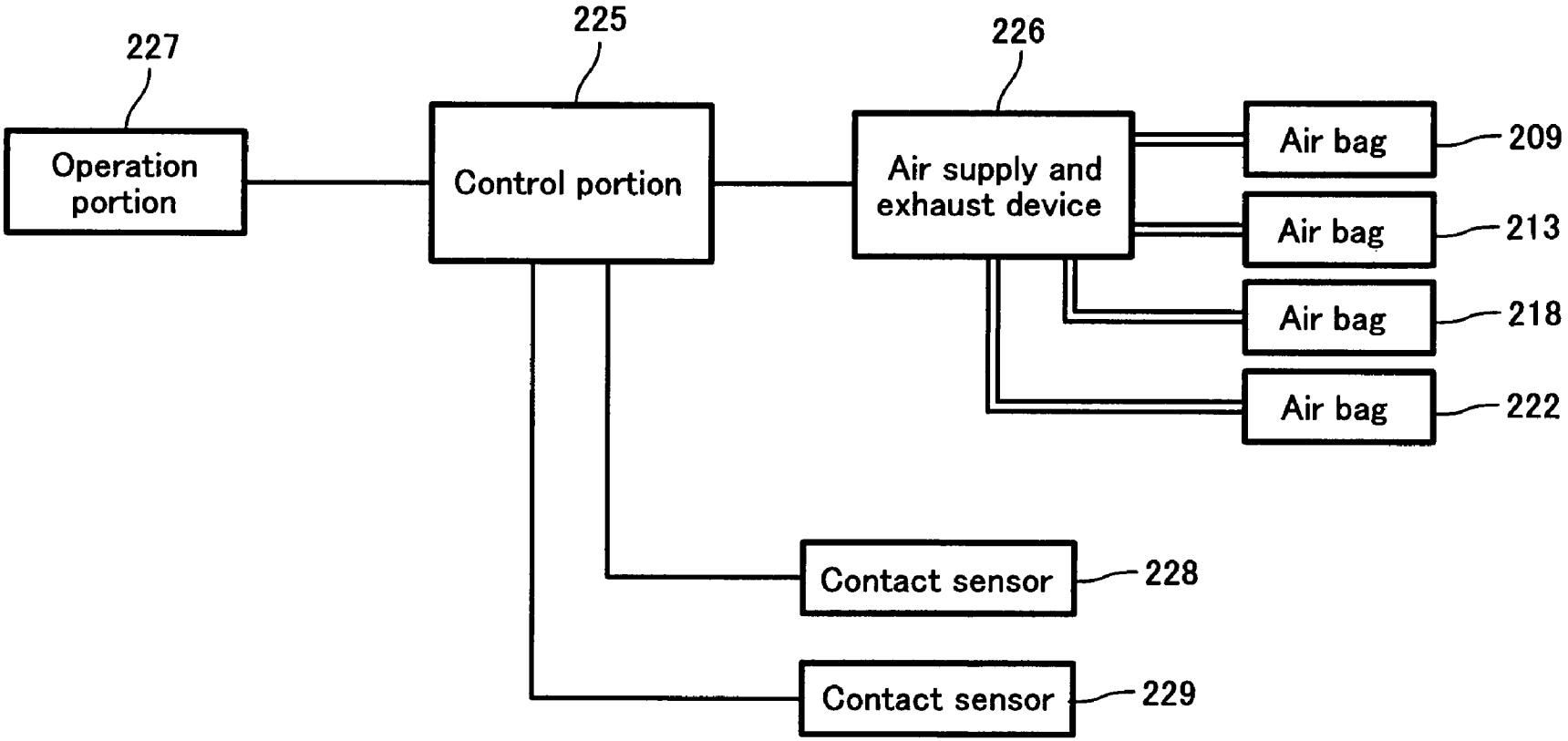
FIG. 20 is a block diagram illustrating the construction of the massaging apparatus according to embodiment 6 of the present invention.

FIG. 20 is a block diagram illustrating the construction of the massaging apparatus 210 according to embodiment 6 of the present invention. As shown in FIG. 20, the massaging apparatus 201 includes therein a control portion 225. This control portion 225 is provided by a CPU, ROM, RAM, and timer or the like and can execute a control program as described later to control the respective connected devices.

The control portion 225 is connected with an air supply and exhaust device 226. This air supply and exhaust device 226 is provided by a switching valve (e.g., electromagnetic valve) and an air pump or the like and is connected via an air hose to the above-described air bags 209, 213, 218, and 222. The air supply and exhaust device 226 also can supply air to or exhaust air from the air bags 209, 213, 218, and 222 in an individual manner.

The control portion 225 is also connected to the operation portion 227 for accepting an operation instruction from the user (e.g., remote controller). The operation portion 227 includes a plurality of button switches. One or a plurality of the button switches can be selected and depressed by the user to instruct the massaging apparatus 201 to perform an operation.

The roller 210 of the footrest 204 and the roller 219 of the armrest 205 are provided with the contact sensors 228 and 229 (e.g., limit switch), respectively. These contact sensors 228 and 229 are connected to the control portion 225 and detect when the rollers 210 and 219 have a contact with the leg portion or arm portion of the user to send a detection signal to the control portion 225.

The other operations of the massaging apparatus 201 according to embodiment 6 are the same as those of the massaging apparatus 1 of embodiment 1 and thus the same components are provided with the same reference numerals and will not be described further.

Figure 21:
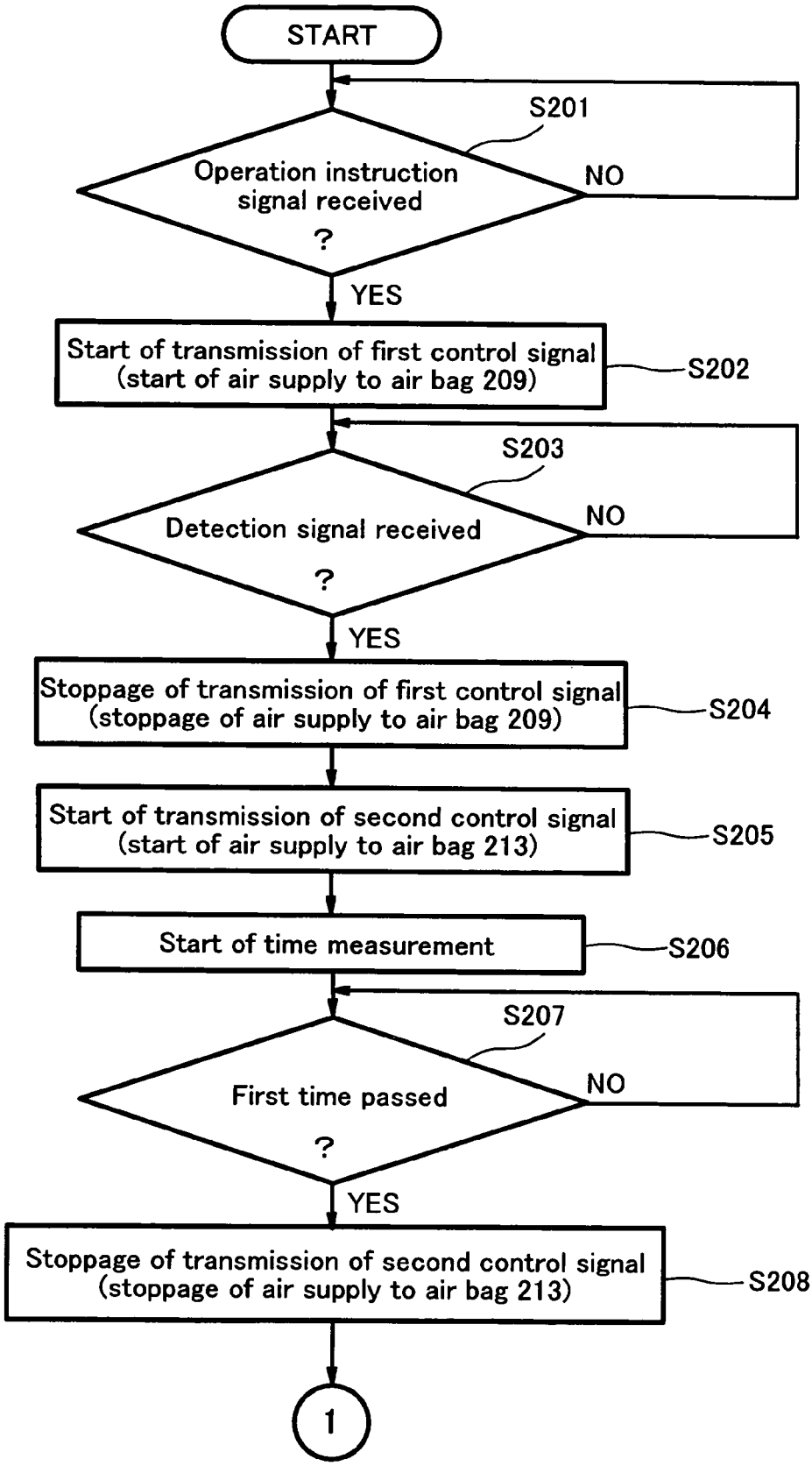
FIG. 21 is a flowchart illustrating the processing procedure of a control portion included in the massaging apparatus according to embodiment 6 of the present invention.
Figure 22:
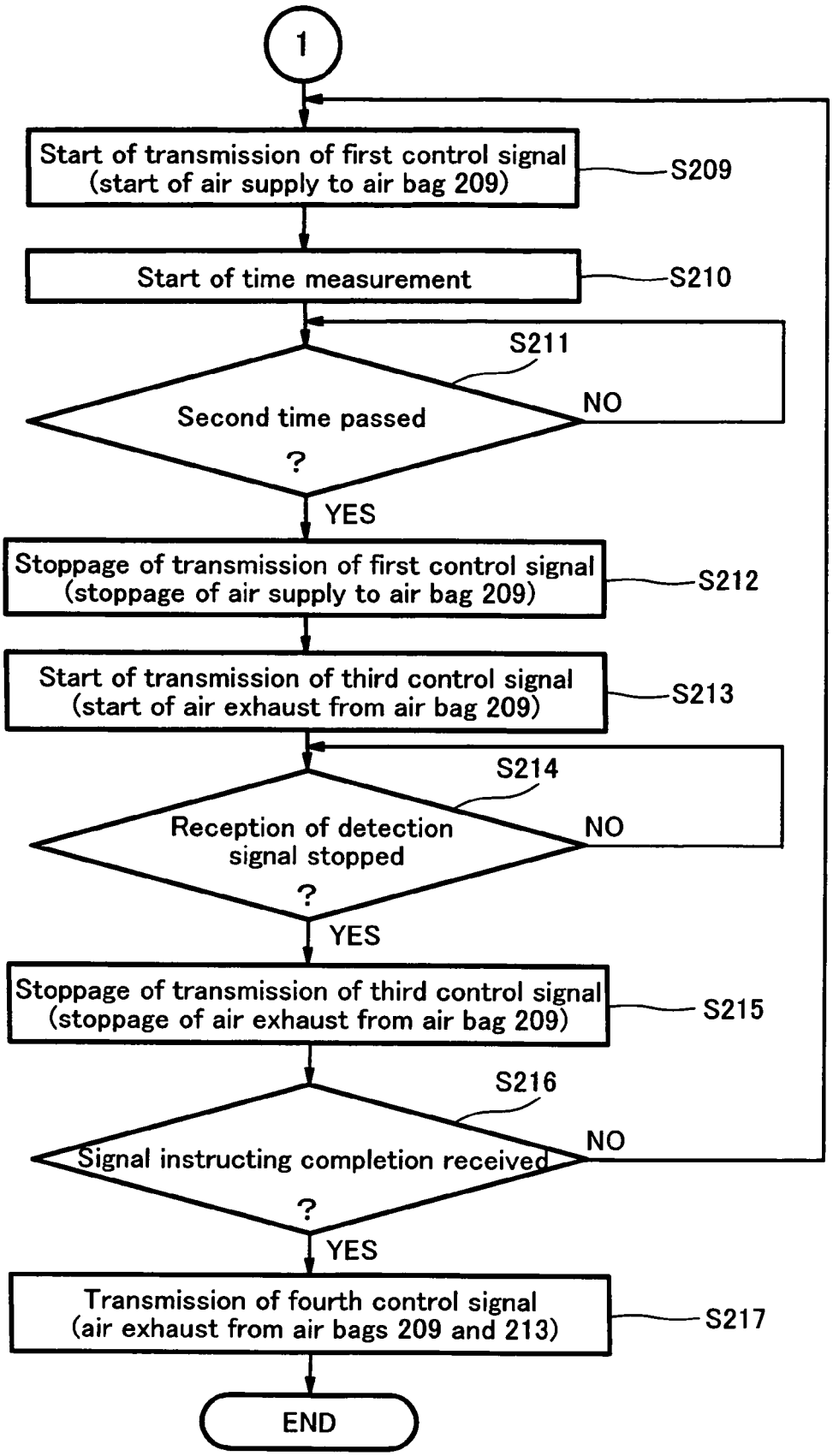
FIG. 22 is a flowchart illustrating the processing procedure of the control portion owned by the massaging apparatus according to embodiment 6 of the present invention.

Next, the operation of the massaging apparatus according to embodiment 6 will be described based on the processings by the control portion 225. FIGS. 21 and 22 are a flowchart illustrating the processing procedure by the control portion 225. Firstly, the control portion 225 determines whether or not an instruction from the user to start the operation of the footrest 204 is given (Step S201). When the user performs an operation to instruct the operation portion 227 to start the operation of the footrest 204, the operation portion 227 accepts this operation instruction to generate an operation instruction signal representing this operation instruction and this instruction signal is given to the control portion 225. When the control portion 225 does not receive the operation instruction signal in Step S201 (No in S201 of FIG. 21), then the control portion 225 repeats the processing of Step S201.

When the control portion 225 receives the operation instruction signal in Step S201 (Yes in S201 of FIG. 21), the control portion 225 starts transmitting to the air supply and exhaust device 226, in order to expand the air bag 209, the first control signal for causing the air supply and exhaust device 226 to supply air to the air bag 209 (Step S202). While receiving this first control signal, the air supply and exhaust device 226 keeps supplying air to the air bag 209, thus expanding the air bag 219 to rotate the rotation portion 208 in the close direction.

When the lower thigh of the user has a contact with the roller 210, the contact sensor 228 detects this to generate a detection signal. The control portion 225 determines whether or not the control portion 225 receives this detection signal (Step 203). When the control portion 225 does not receive the detection signal (NO in Step 203 of FIG. 21), the control portion 225 repeats the processing of Step S203. When the control portion 225 receives the detection signal in Step S203 (YES in Step 203 of FIG. 21), the control portion 225 stops the transmission of the first control signal to the air supply and exhaust device 226 (Step S204). When the air supply and exhaust device 226 does not receive the first control signal any more, the air supply and exhaust device 226 stops the air supply to the air bag 209. This stops the expansion of the air bag 209 to stop the rotation portion 208 at a position at which the roller 210 has a contact with the lower thigh of the user.

Next, the control portion 225 starts transmitting to the air supply and exhaust device 226, in order to expand the air bag 213 for the predetermined first time, the second control signal for causing the air supply and exhaust device 226 to supply air to the air bag 213 (Step S205) and starts timekeeping (Step S206). While receiving this second control signal, the air supply and exhaust device 226 keeps supplying air to the air bag 213, thus expanding the air bag 213 to allow the backside of the calf of user to be pushed up by the air bag 213, thus allowing the lower thigh of the user to be suspended above the concave-shaped arc face 212.

The control portion 225 determines whether or not the first time has passed since the start of the timekeeping (Step S207). When the first time has not passed since the start of the timekeeping (No in S207 of FIG. 21), then the control portion 225 repeats the processing of Step S207. When the first time has passed since the start of the timekeeping (Yes in S207 of FIG. 21), then the control portion 225 stops the transmission of the second control signal to the air supply and exhaust device 226 (Step S208). When the air supply and exhaust device 226 does not receive the second control signal any more, the air supply and exhaust device 226 stops the air supply to the air bag 213, thus stopping the expansion of the air bag 213.

Next, the control portion 225 again starts transmitting the first control signal to the air supply and exhaust device 226 (Step S209) to start timekeeping again (Step S210). This allows the rollers 210 and 211 to press the lower thigh of the user. By expanding the air bag 213 to subsequently expand the air bag 209, the user feels that the pressure stimulation by the air bag 213 to the lower thigh is smaller than the pressure stimulation by the rollers 210 and 211 to the lower thigh.

Next, the control portion 225 determines whether or not the predetermined second time has passed since the start of the timekeeping of Step 210 (Step S211). When the second time has not passed since the start of the timekeeping (No in S211 of FIG. 22), then the control portion 225 repeats the processing of Step S211. On the other hand, when the second time has passed since the start of the timekeeping in Step S211 (Yes in S211 of FIG. 22), then the control portion 225 stops the transmission of the first control signal (Step S212) and starts transmitting the third control signal for causing the air supply and exhaust device 226 to exhaust air from the air bag 209 (Step S213). While receiving this third control signal, the air supply and exhaust device 226 keeps exhausting air from the air bag 209. This causes the air bag 209 to have contraction to rotate the rotation portion 208 in the open direction by the biasing force by the spring. When the roller 210 is moved away from the lower thigh of the user, the contact sensor 228 stops the transmission of the detection signal.

Next, the control portion 225 determines whether or not the detection signal from the contact sensor 228 is stopped or not (Step S214). When the detection signal is continuously received by the control portion 225 in Step S214 (No in S214 of FIG. 22), then the processing of Step S214 is repeated.

When the detection signal is stopped (YES in Step S214 of FIG. 22), the control portion 225 stops the transmission of the third control signal to the air supply and exhaust device 226 (Step S215). When the air supply and exhaust device 226 does not receive the third control signal any more, the air supply and exhaust device 226 stops the air exhaust from the air bag 209. This stops the contraction of the air bag 209 to stop the rotation portion 208 at a position at which the roller 210 does not have a contact with the lower thigh of the user.

Next, the control portion 225 determines whether or not the instruction for the completion of the operation is given by the user (Step S216). When the user operates the operation portion 227 to give the instruction for the completion of the operation, this instruction is accepted by the operation portion 227 and the operation portion 227 generates a completion instruction signal representing this completion instruction to give this completion instruction signal to the control portion 225.

When the completion instruction signal is not given to the control portion 225 in Step 216 (No in S216 of FIG. 22), then the processing returns to Step S209. This allows, after the air exhaust from the air bag 209, the processing to be returned to Step S209, thus expanding the air bag 209 again to cause the rollers 210 and 211 to repeatedly press and release the lower thigh of the user. This also allows, while the rollers 210 and 211 having a contact with the lower thigh of the user, the rollers 210 and 211 to repeatedly press and release the lower thigh of the user, thus preventing the rollers 210 and 211 from being unnecessarily away from the lower thigh of the user.

When the control portion 225 receives the completion instruction signal in Step S216 (Yes in S216 of FIG. 22), then the control portion 225 sends to the air supply and exhaust device 226 the fourth control signal for causing the air supply and exhaust device 226 to exhaust air in both of the air bag 209 and the air bag 213 (Step S217) to complete the processing. This causes the air bag 209 and 213 to have contraction to rotate the rotation portion 208 in the open direction until the limitation is reached.

While the operation as described above is being provided by the footrest 204, the above-described vibrator 210 and/or the heating element 213*a* also can be driven. This can provide a further improvement of the massaging effects (e.g., promotion of blood circulation of leg portion or reduction of fatigue of the user).

Although embodiment 6 described a construction for simple explanation in which Step S216 determines whether or not the completion instruction signal is received, the processing can be actually interrupted whenever the completion instruction signal is received from the operation portion 227 so long as the processings from S201 to S215 are being performed, thus providing the air exhaust from the air bags 209 and 213 immediately to complete the processing.

The present invention is also not limited to the above construction in which the air bag 213 is expanded to lift the lower thigh of the user from the concave-shaped circular arc face 212 to subsequently expand (or extend) the air bag 209, thus causing the rollers 210 and 211 to press the lower thigh of the user. Another construction also may be used in which the air bag 209 is expanded to subsequently expand the air bag 213 or another construction also may be used in which the air bags 209 and 213 are expanded simultaneously. The order of the expansion of the air bags 209 and 213 also can be selectively changed. As a result, various stimulations can be provided to the user.

The control of the operation of the armrest 205 by the control portion 225 is substantially the same as that of the footrest 204 as described above and thus will not be described further.

Although embodiment 6 described a construction in which the massaging apparatus 201 includes both of the footrest 204 and the armrest 205, the present invention is not limited to this construction. Another construction also may be used in which the massaging apparatus 201 includes only the footrest 204 or the armrest 205.

Embodiment 7

Figure 23:
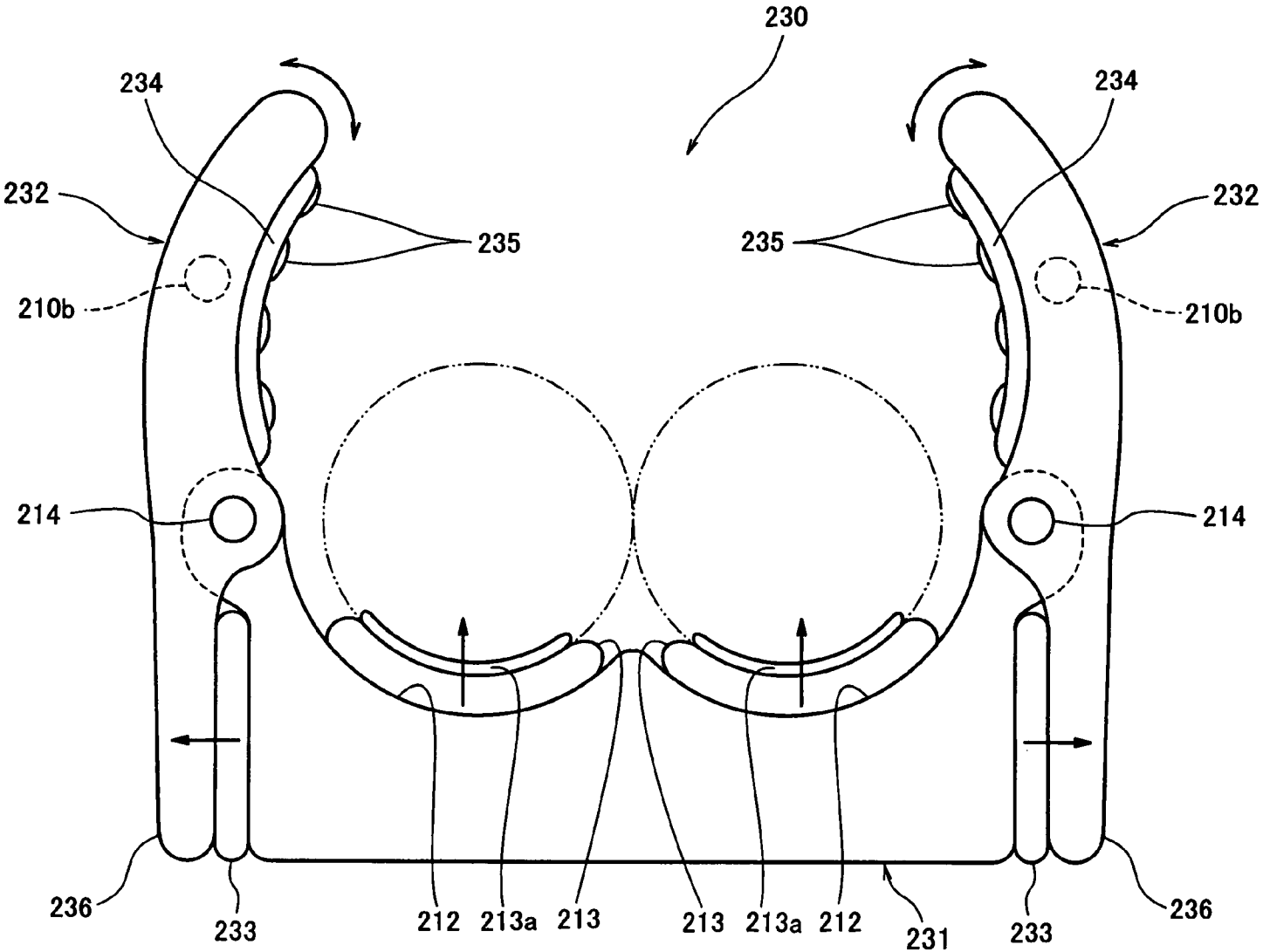
FIG. 23 is a top view illustrating the construction of a footrest owned by the massaging apparatus according to embodiment 7 of the present invention.

FIG. 23 is a top view illustrating the construction of a footrest owned by the massaging apparatus according to embodiment 7 of the present invention. As shown in FIG. 23, a footrest 230 according to embodiment 7 mainly includes a support base 231, rotation portions 232, air bags 233, and massaging elements 234. The support base 231 has both side faces forming a flat face substantially orthogonal to the back face, respectively. The air bags 233 are attached to these side surfaces, respectively.

The rotation portions 232 are provided on both lateral sides of the support base 207 so as to be rotatable around the pivots 214. Apart of the rotation portion 232 that is forward of the pivot 214 has a substantially circular arc plate-like shape. The rotation portion 232 is arranged such that the concave-shaped inner face thereof is opposed to the concave-shaped circular arc face 212 so as to conform in shape to the lower thigh of the user. A part of the rotation portion 232 that is rearward of the pivot 214 is a pushed portion 236 having a flat plate shape smoothly continued from the circular arc shape of the forward part. This pushed portion 236 has an inner face that is opposed to the side face of the support base 231 and that is fixed with the air bag 233. Specifically, the air bag 233 is provided between the side face of the support base 231 and the pushed portion 236. The air bag 233 is provided by a bag having no fold lines.

When air is supplied to the air bag 233, the air bag 233 is expanded to rotate the rotation portion 232 in the close direction. The support base 231 and the rotation portion 232 are provided with a spring (not shown) for biasing the rotation portion 232 in the open direction. Thus, when air is exhausted from the air bag 233, the respective rotation portions 232 are opened until the limitation is reached, thus providing an easy placement of the lower thigh of the user. In this way, the air bag 233 and the spring constitute the driving portion according to the present invention.

Although embodiment 7 provided the driving portion by the air bag 233 and the spring, the present invention is not limited to this. For example, the driving portion also may be provided by other actuators (e.g., electric motor, electric cylinder, fluid cylinder).

A massaging element 24 as a massaging element of the present invention is provided on the inner face of the circular arc plate-like part of the rotation portion 232 The massaging element 234 has a substantially sheet-like shape one face of which has a plurality of spherical projections 235. The massaging element 234 is attached to the rotation portion 232 so that these projections 235 are projected toward the concave-shaped circular arc face 212. The massaging element 234 as described above is made of a material having an elasticity corresponding to that of a thumb of a human (e.g., rubber, sponge).

Although embodiment 7 provided the footrest 230 having an integrated structure for holding left and right legs, the present invention is not limited to this. The footrest 230 also may have another construction in which a portion for holding a left leg and a portion for holding a right leg are provided separately.

Figure 24:
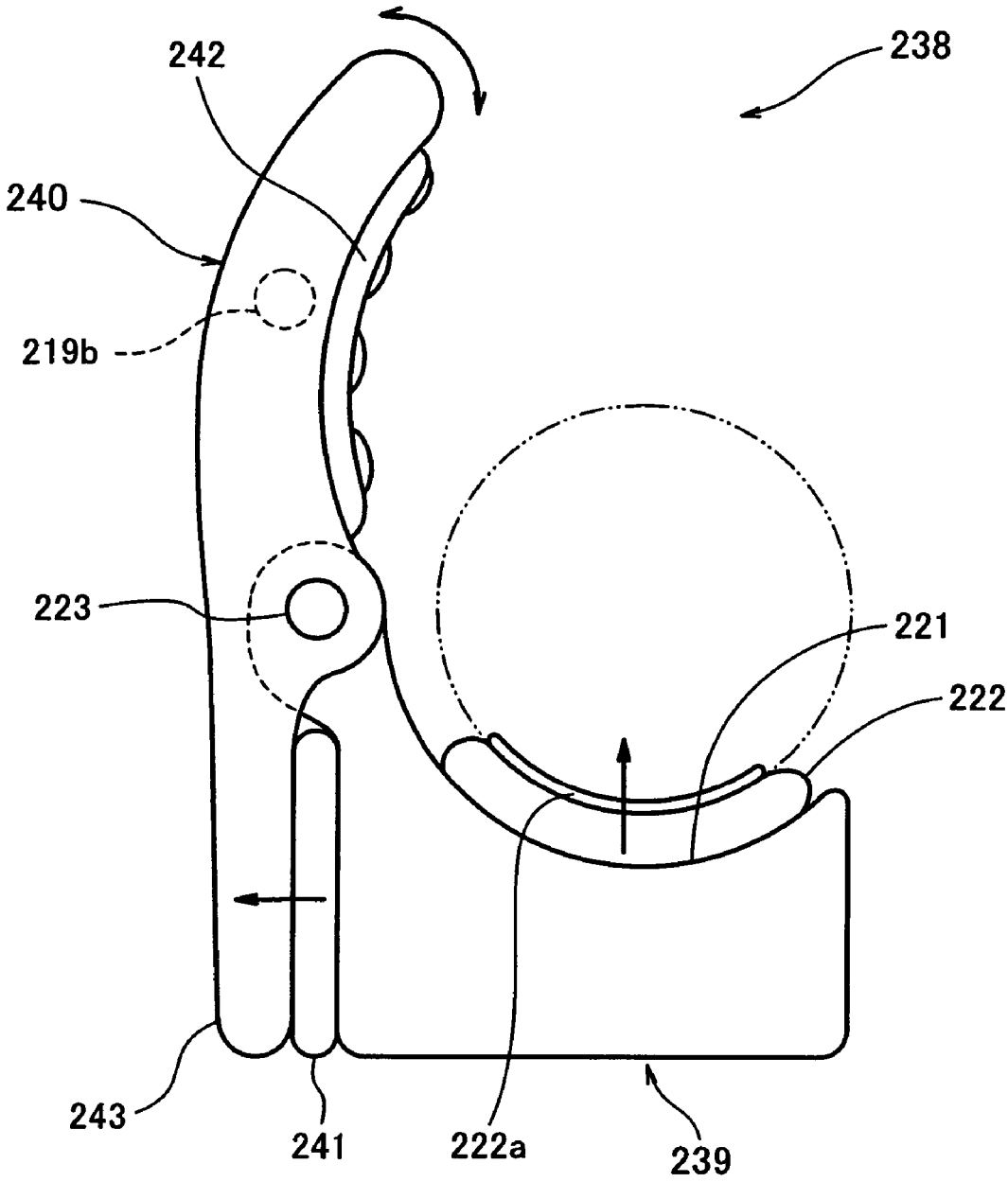
FIG. 24 is a front view illustrating the construction of an armrest owned by the massaging apparatus according to embodiment 7 of the present invention.

FIG. 24 is a front view illustrating the construction of an armrest owned by the massaging apparatus according to embodiment 7 of the present invention. As shown in FIG. 24, an armrest 238 mainly includes a support base 239, a rotation portion 240, an air bag 241, and a massaging element 242. The armrest 238 has a structure as described below that has the substantially the same construction as that of one of the two portions obtained by dividing the above-described footrest 230 at the edge line between the two concave-shaped circular arc faces 212.

The support base 239 has an outer side face that is a substantially vertical flat surface. The air bag 241 is fixed to the outer side face. The rotation portion 240 is provided on the outer side face of the support base 239 so as to be rotatable around the pivot 223. A part of this rotation portion 240 that is upper of the pivot 223 has a substantially circular arc plate-like shape the concave-shaped inner face thereof is provided to be opposed to the concave-shaped circular arc face 221 so as to conform in shape to the forearm of the user.

The circular arc plate-like part of the rotation portion 240 is attached on an inner face thereof with the massaging element 242 having the same construction as that of the above-described massaging element 234.

A part of the rotation portion 240 that is rearward of the pivot 223 is the pushed portion 243 having a flat plate shape smoothly continued from the circular arc shape of the forward part. This pushed portion 243 has an inner face that is opposed to the outer side face of the support base 239 and that is fixed with the air bag 241. Specifically, the air bag 241 is provided between the outer side face of the support base 239 and the pushed portion 243. The air bag 241 is provided by a bag having no fold lines as in the case of the air bag 233. The support base 239 and the rotation portion 240 are also provided with a spring (not shown) for biasing the rotation portion 240 in the open direction.

The other components of the massaging apparatus according to embodiment 7 are the same as those of the massaging apparatus 201 according to embodiment 6 and thus are provided with the same reference numerals and will not be described further.

The control of the operation of the footrest 230 and the armrest 238 of the massaging apparatus according to embodiment 7 is substantially the same as that of the footrest 204 and the armrest 205 of the massaging apparatus according to embodiment 6 and thus will not be described further.

Although embodiment 7 described a construction in which the massaging apparatus includes both of the footrest 230 and the armrest 238, the present invention is not limited to this construction. Another construction also may be used in which the massaging apparatus includes only the footrest 230 or the armrest 238.

Embodiment 8

Figure 25:
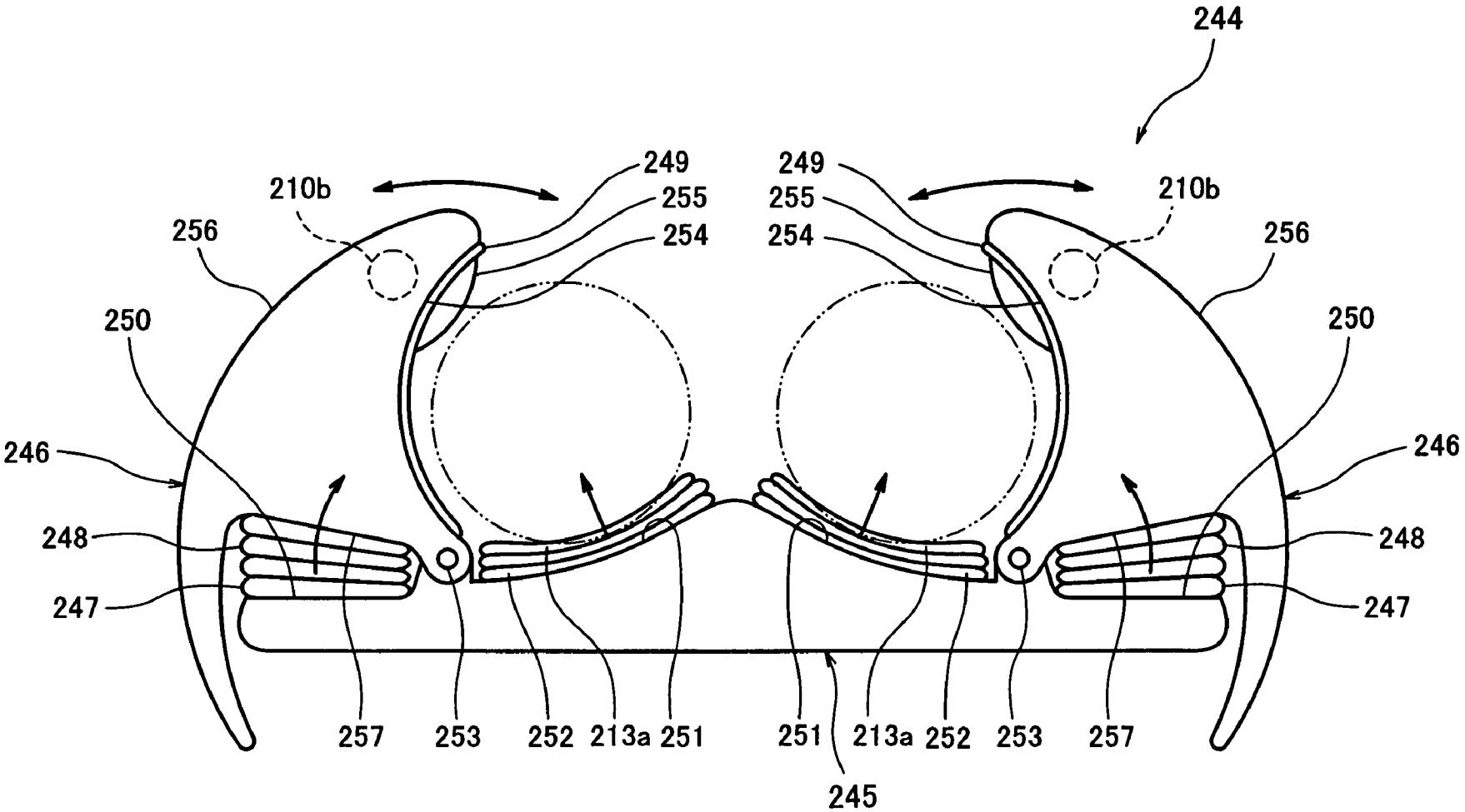
FIG. 25 is a top view illustrating the construction of a footrest owned by the massaging apparatus according to embodiment 8 of the present invention.

FIG. 25 is a top view illustrating the construction of a footrest owned by the massaging apparatus according to embodiment 8 of the present invention. As shown in FIG. 25, a footrest 244 according to embodiment 8 mainly includes a support base 245, rotation portions 246, air bags 247 and 248, and massaging elements 249. The support base 245 has a center part protruded forward and is configured to be gradually inclined from the top thereof to form a concave-shaped and substantially plate-like shape. Both ends of the support base 245 are flat faces facing forward and these parts are attachment faces 250. Air bags 247 are fixed to these attachment faces 250.

The air bag 247 has an accordion-like shape that is flat when being folded and is fixed with the air bag 248 having the same construction in a superposed manner. This air bag 247 is also fixed to the attachment face 250 at the face opposite to the face to which the air bag 248 is fixed.

Both lateral sides of the center protruding portion of the support base 245 have concave-shaped faces 251. This concave-shaped face 251 constitutes the support face of the present invention. These concave-shaped faces 251 support the calf of the user and the air bags 252 are respectively fixed to the surfaces thereof. When air is supplied to the air bags 252, the air bags 252 can be expanded to provide stimulation to the calf of the user.

Parts at which the concave-shaped faces 251 of the support base 245 is connected to the attachment faces 250 respectively include portions protruding in the forward direction. The portions are penetrated by the pivots 253. These pivots 253 are respectively provided with the rotation portions 246 so that the rotation portions 246 are rotatable. The left and right rotation portions 246 have the concave-shaped circular arc faces 254 at a part forward of the position at which the rotation portions 246 are pivotally mounted to the pivot 253. The respective circular arc faces 254 are provided to be opposed to each other. The circular arc face 254 as described above is adhered with the massaging element 249 serving as the massaging portion of the present invention. The massaging element 249 has a substantially sheet-like shape. The massaging element 249 includes the rounded projection 255 on one face thereof. The massaging element 249 is attached to the rotation portion 246 so that this projection 255 is protruded inwardly. The massaging element 249 as described above is made of a material having an elasticity corresponding to that of a thumb of a human (e.g., rubber, sponge).

At the substantially opposite side of the circular arc face 254 of the rotation portion 246, the outer face 256 and the pushed face 257 are provided. Specifically, the circular arc face 254 is provided to the inner side of the footrest 244 while the outer face 256 and the pushed face 257 are provided to the outer side of the footrest 244. The pushed face 257 is a flat face that is continued from the circular arc face 254 to sandwich the pivot 253 and is provided to face the substantially rearward direction. The pushed face 257 as described above is opposed to the above-described attachment face 250 and the air bag 248 is fixed thereto. When the air bag 247 and/or the air bag 248 are/is expanded, the pushed face 257 is pushed in the forward direction to move the rotation portion 246 around the pivot 253. In this way, the pushed face 257 constitutes the pushed portion according to the present invention.

The support base 245 and the rotation portion 246 are provided with a spring (not shown) for biasing the rotation portion 246 in the open direction. Thus, when air is exhausted from the air bags 247 and 248, the respective rotation portions 246 are opened to both sides until the limitation is reached, thus providing an easy placement of the lower thigh of the user. In this way, the air bags 247 and 248 and the spring constitute the driving portion according to the present invention.

Although embodiment 8 used the air bags 247 and 248 and the spring to constitute the driving portion according to the present invention, the present invention is not limited to this. For example, the driving portion also may be provided by another actuator (e.g., electric motor, electric cylinder, fluid cylinder).

Although embodiment 8 provided the footrest 244 having an integrated structure for holding left and right legs, the present invention is not limited to this. The footrest 244 also may have another construction in which a portion for holding a left leg and a portion for holding a right leg are provided separately.

Figure 26:
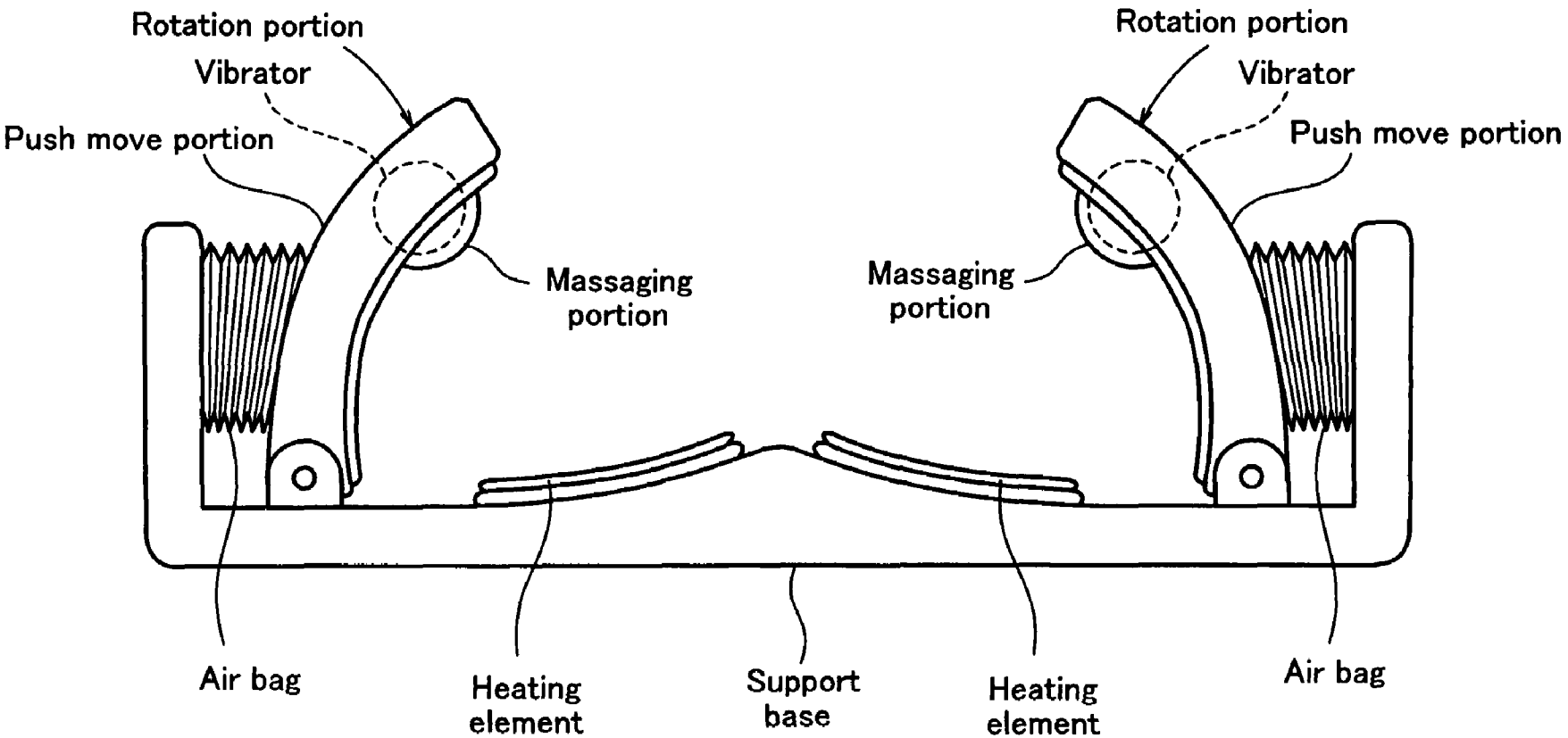
FIG. 26 is a schematic top view illustrating another exemplary construction of the footrest of the massaging apparatus according to the present invention.

FIG. 26 is a schematic top view illustrating another exemplary construction of the footrest of the massaging apparatus according to the present invention. As shown in FIG. 26, another construction also may be used in which the rotation portion is provided to have a curved plate-like shape and the concave-shaped circular arc face is provided with the massaging element and a convex circular arc face substantially opposite to this circular arc face is used as a pushed portion adapted to be pushed by the expansion of an air bag.

The massaging apparatus according to embodiment 8 allows the air bag 247 to be expanded until the lower thigh of the user has a contact with the massaging element 249 so that the expansion and contraction of the air bag 248 are repeated from this status, thereby stimulating the lower thigh of the user as if the lower thigh is pressed by fingers with a fixed time interval. The expansion coefficient of the air bag 247 is adjusted to adjust the strength of the massaging stimulation. The other controls of the operation of the footrest 244 of the massaging apparatus according to embodiment 8 are substantially the same as those of the footrest 204 of the massaging apparatus according to embodiment 6 and thus will not be described further.

Figure 27:
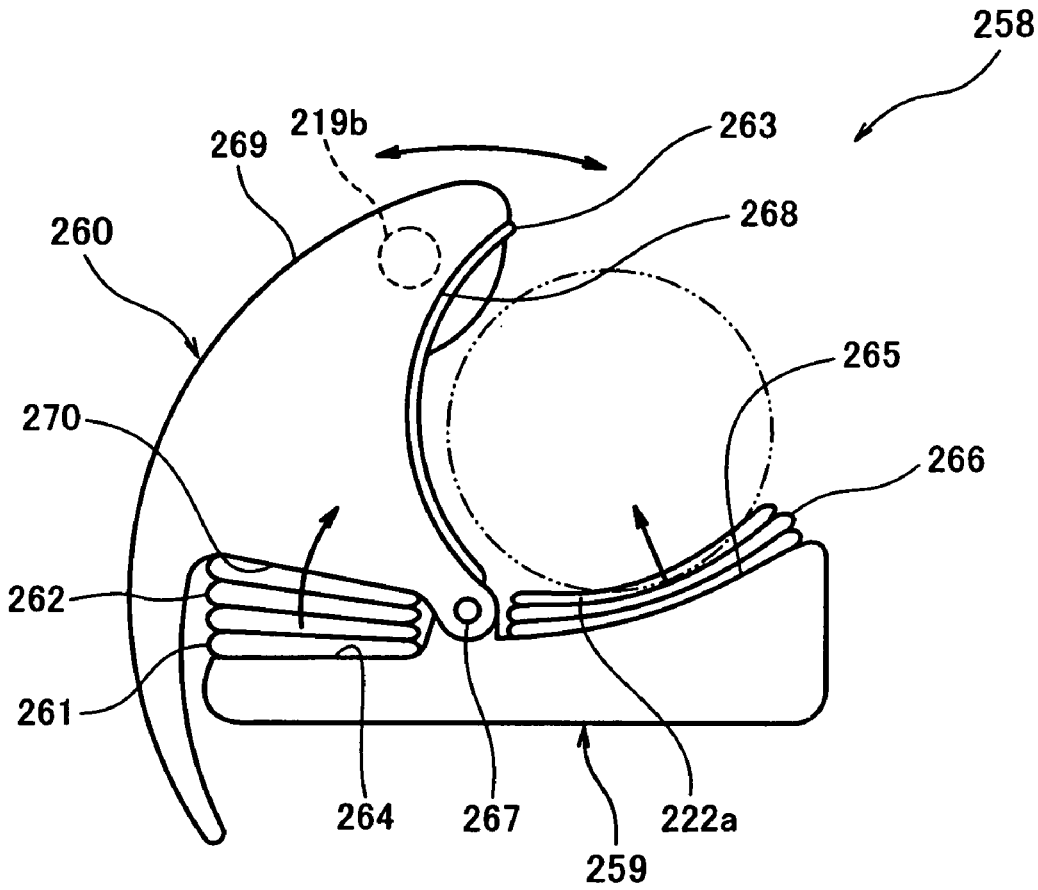
FIG. 27 is a front view illustrating the construction of an armrest owned by the massaging apparatus according to embodiment 8 of the present invention.

FIG. 27 is a front view illustrating the construction of the armrest owned by the massaging apparatus according to embodiment 8 of the present invention. As shown in FIG. 27, an armrest 258 mainly includes a support base 259, a rotation portion 260, air bags 261 and 262, and a massaging element 263. The armrest 258 has a structure as described below that has the substantially the same construction as that of one of the two portions obtained by dividing the above-described footrest 244 at the edge line at the center of the support base 259.

One lateral end of the support base 259 is protruded upwardly and a part from the top to the other lateral end has a substantially plate-like shape that is loosely inclined to draw a concave shape. The support base 259 as described above is attached to the base 202*b* (see FIG. 17) so that the one end protruding upwardly is positioned at the inner side of the massaging apparatus.

The other lateral end of the support base 259 has a flat face facing upward. This part serves as an attachment face 264 of the air bag 261. The air bags 261 and 262 have the same constructions as those of the above-described air bags 247 and 248.

The upper face of the support base 259 is a concave-shaped face 265. This concave-shaped face 265 constitutes the support face of the present invention. The concave-shaped face 265 as described above supports the forearm of the user and an air bag 266 is fixed to the surface thereof. The expansion of this air bag 266 can provide stimulation to the forearm of the user.

A part of the support base 259 at which the concave-shaped face 265 is connected to the attachment face 264 has a portion projecting in the upward direction. This portion is penetrated by a pivot 267. The pivot 267 as described above is provided with the rotation portion 260 provided to be rotatable. The rotation portion 260 has a part that is upper of a part at which the rotation portion 260 is pivotally mounted with the pivot 267. This part has a concave-shaped circular arc face 268. The massaging element 263 having the same construction as that of the massaging element 249 is attached to the concave-shaped circular arc base 268.

The rotation portion 260 has the same construction as that of the above-described rotation portion 246. The substantially opposite side of the circular arc face 268 has an outer face 269 and a pushed face 270. The pushed face 270 is opposed to the attachment face 264 of the support base 259 and the air bag 262 is fixed theretor. When the air bag 261 and/or the air bag 262 are/is expanded, the pushed face 270 is pushed upwardly to rotate the rotation portion 260 around the pivot 267. In this way, the pushed face 270 constitutes the pushed portion according to the present invention.

The support base 259 and the rotation portion 260 are provided with a spring (not shown) for biasing the rotation portion 260 in the open direction. Thus, when air is exhausted from the air bags 261 and 262, the rotation portion 260 is opened until the limitation is reached, thus providing an easy placement of the lower thigh of the user. In this way, the air bags 261 and 262 and the spring constitute the driving portion according to the present invention.

The control of the operation of the armrest 258 is substantially the same as that of the footrest 244 as described above and thus will not be described further.

The other components of the massaging apparatus according to embodiment 8 are the same as those of the massaging apparatus 201 according to embodiment 6 and thus are provided with the same reference numerals and will not be described further.

Although embodiment 8 described a construction in which the massaging apparatus includes both of the footrest 244 and the armrest 258, the present invention is not limited to this construction. Another construction also may be used in which the massaging apparatus includes only the footrest 244 or the armrest 258.

Embodiment 9

Figure 28:
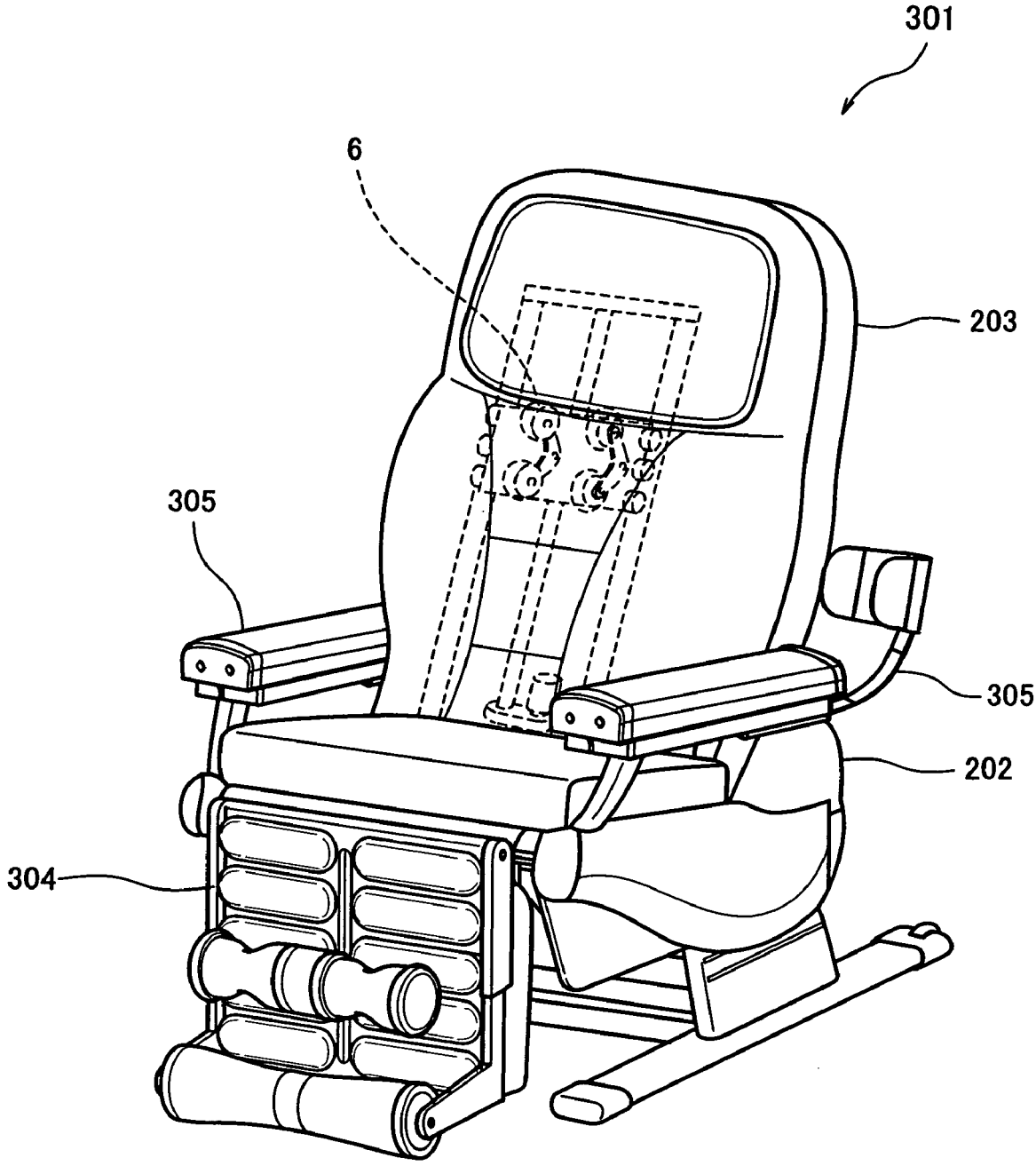
FIG. 28 is a perspective view illustrating the entire construction of the massaging apparatus according to embodiment 9 of the present invention.

FIG. 28 is a perspective view illustrating the entire construction of the massaging apparatus according to embodiment 9 of the present invention. As shown in FIG. 28, in a massaging apparatus 301 according to embodiment 9, the front side of the upper part of the seat 202 is pivotally mounted with the upper end portion of a footrest 304 for massaging the ankle and calf of the user. This allows the footrest 304 to be rotatable around the upper end portion forward and backward.

The armrests 305 are fixedly mounted to the bases 202*b* at both lateral sides of the backrest 203, respectively. These armrests 305 extend from both lateral sides of the backrest 203 in the forward direction so as to be used as elbowrests when the user sits on the massaging apparatus 301.

Figure 29A:
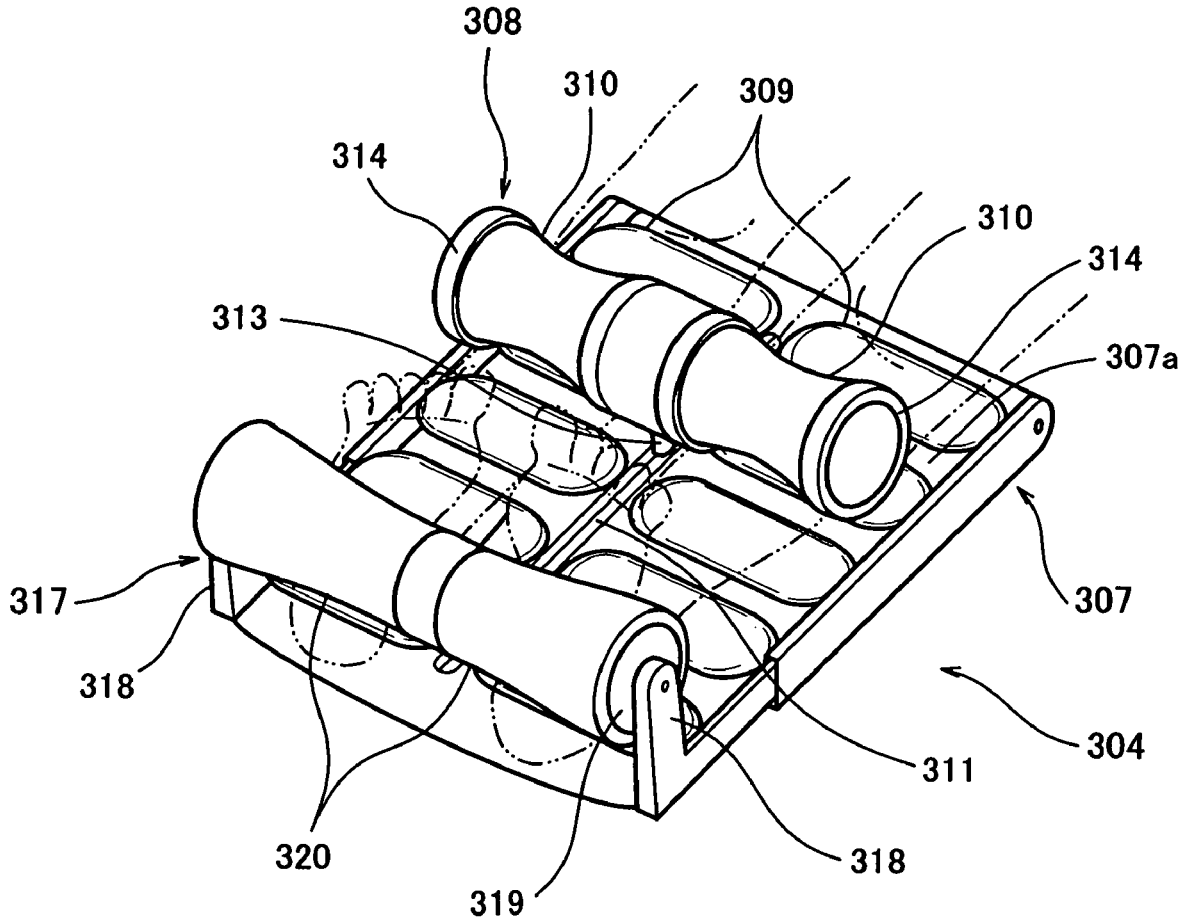
FIGS. 29(*a*) and 29(*b*) illustrate the construction of the footrest of the massaging apparatus according to embodiment 9 of the present invention.
Figure 29B:
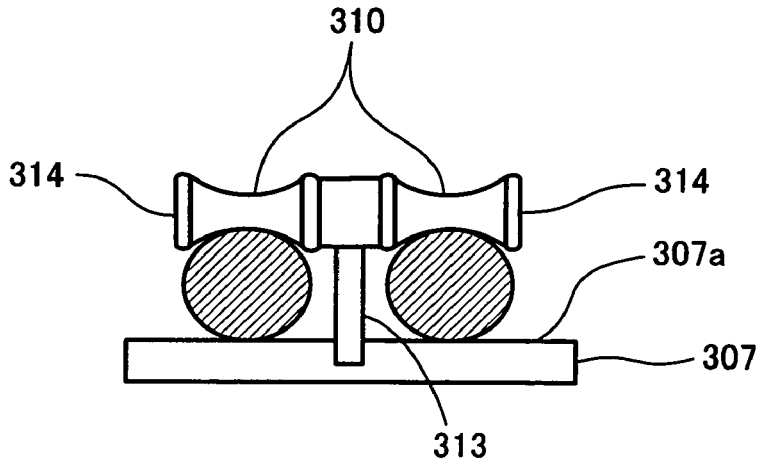

Next, the footrest 304 and the armrest 305 will be described further in detail with regards to the construction. FIGS. 29(*a*) and 29(*b*) illustrate the construction of the footrest 304 of the massaging apparatus 301 according to embodiment 9 of the present invention. FIG. 29(*a*) is a perspective view showing the appearance while FIG. 29(*b*) is a top view showing when the footrest is used. As shown in FIG. 29(*a*), the footrest 304 mainly includes a support base 307, a movable portion (pressing portion) 308, and air bags 309 and 310 constituting the massaging portion according to the present invention. The support base 307 has a substantially plate-like shape and the upper end part thereof is pivotally mounted to a pivot (not shown) extending at the front end part of the seat 302 in the left-and-right direction. One plate face (front face) of the support base 307 is the support face 307*a* by which the substantial entirety of the lower thigh (calf) of the user is supported. The support base 307 as described above includes a lock mechanism (not shown). When the lock mechanism is actuated while the support base 307 being inclined with an arbitrary angle to the seat 202, the support base 307 can be maintained to be immovable.

A plurality of air bags 309 are fixed to the support face 307*a*. When air is supplied to these air bags 309 from the air supply and exhaust device 312 (see FIG. 33) comprising a pump or the like that is included in the massaging apparatus 301, the air bags 309 can be expanded to provide stimulation to the calf of the user.

Furthermore, sheet-like heating elements (not shown) are attached to the surfaces of the air bags 309. These heating elements can be structured to generate heat when being driven, thus heating the calf of the user.

At the center part of the support base 307 in the width direction, there is provided a vertically long slit-like opening 311 at which the movable portion 308 serving as a pressing portion according to the present invention is provided in a projecting manner. The movable portion 308 includes a coupling bar 313, rollers 314, and air bags 310. The coupling bar 313 extends in the direction substantially orthogonal to the support face 307*a* and one end thereof is inserted through the opening 311 to the inner part of the support base 307 and is connected to the output shaft of a motor 315 (see FIG. 33) included in the support base 307. This motor 305 constitutes the driving portion according to the present invention. This motor 315 can allow the movable portion 308 to move along the opening 311.

At the left and right of the projecting part of the coupling bar 313, the rollers 314 are provided, respectively. The rollers 314 are pivotally mounted the coupling bars 313 so as to be rotatable around the rotation axes extending in the left-and-right direction. The roller 314 is provided such that the center part of the circular cylinder has a substantially circular arc concavity and the circumference face is entirely provided with the air bag 310. The air bag 310 is connected to an air supply and exhaust device 312 (see FIG. 33) via an air hose (not shown) running through the coupling bar 313. When the air supply and exhaust device 312 is driven, the air bag 310 can have expansion and contraction to provide stimulation to the front face of the lower thigh of the user. The roller 314 is opposed to the support face 307*a* to have a space therebetween. This allows, as shown in FIG. 29(*b*), the lower thigh of the user to be massaged while being sandwiched between the roller 314 and the support face 307*a*.

The roller 314 having the circular arc concavity can conform in shape to the lower thigh of the user and the lower thigh can be pressed in a wide range. Furthermore, the lower thigh of the user generally has a contact only with the air bags 309 and 310 and thus a comfortable stimulation to the user can be provided to the lower thigh.

Figure 33:
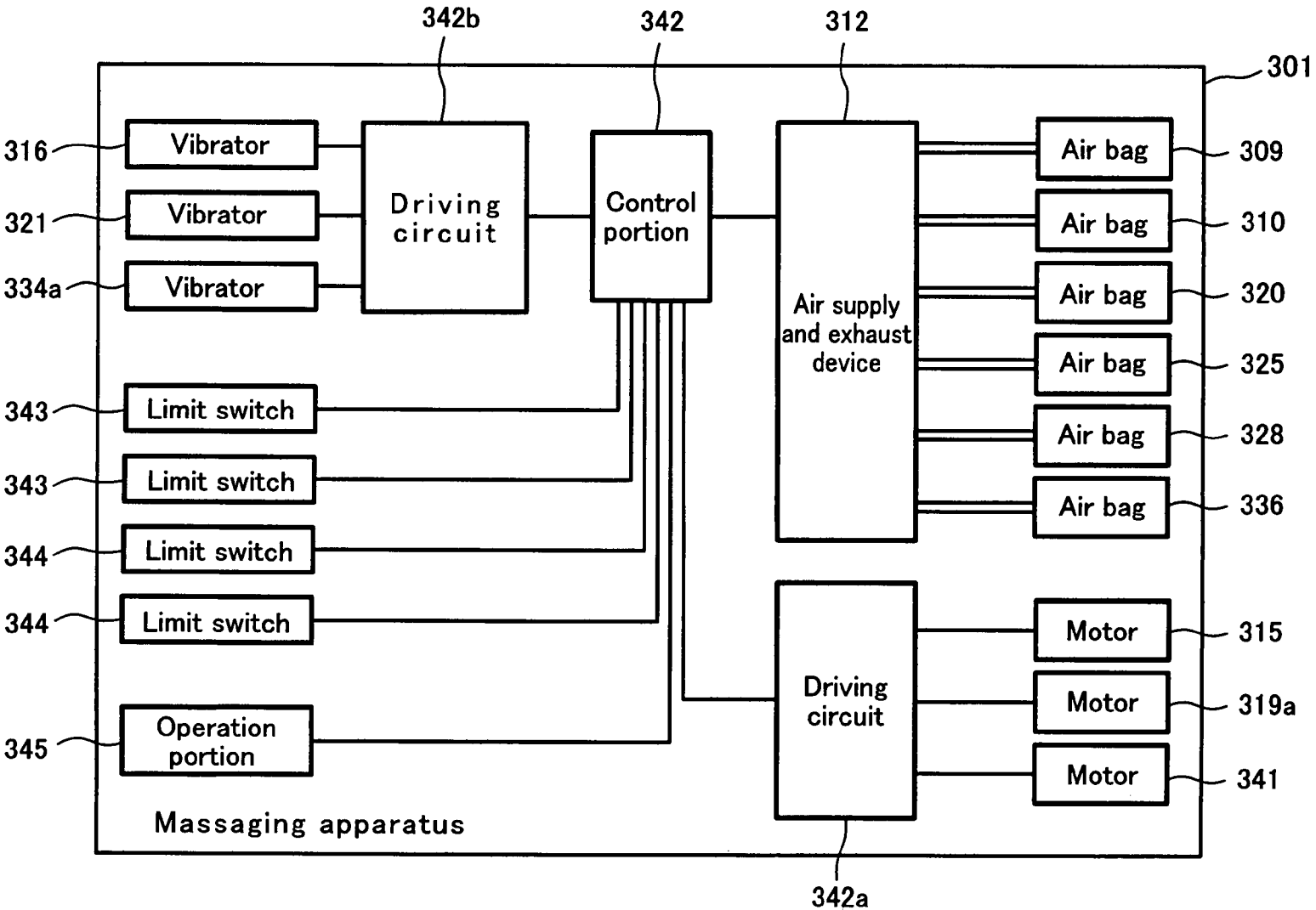
FIG. 33 is a block diagram illustrating a part of the construction of the massaging apparatus according to embodiment 9 of the present invention.

Furthermore, the roller 314 has therein the vibrator 316 (see FIG. 33). The operation of this vibrator 316 can vibrate the roller 314 to provide stimulation to the lower thigh of the user.

The support base 307 has at the lower end thereof the sole massaging portion 317. The sole massaging portion 317 includes protruding portions 318 respectively protruding in the forward direction from the lower ends of both side faces of the support base 307, substantially circular cylinder rollers 319 provided between the protruding portions 318, and air bags 320 provided at the left and right of the roller 319 in the circumference direction. The roller 319 is provided to have a distance to the support face 307*a* so that the roller 319 has a contact with the sole of the user when the lower thigh is put on the footrest 304. The roller 319 is connected to the motor 319*a* (see FIG. 33) via a gear or the like and is driven by this motor 319*a* to rotate. When using the massaging apparatus 301, the user inserts the lower thigh between the roller 314 and the support face 307*a* until the sole has a contact with the air bag 320. Then, the roller 319 can be rotated as described above to provide stimulation to the sole of the user. The air bag 320 is also connected via an air hose (not shown) to the air supply and exhaust device 312 (see FIG. 33). When the air supply and exhaust device 312 is driven, the air bag 320 can have expansion and contraction to provide stimulation to the sole of the user.

Furthermore, the roller 319 has therein a vibrator 321 (see FIG. 33). The operation of this vibrator 321 can vibrate the roller 319 to provide stimulation to the lower thigh of the user.

Sheet-like heating elements (not shown) are attached to the surface of the air bag 320. These heating elements are configured to generate heat when being driven, thus heating the sole of the user.

Figure 30:
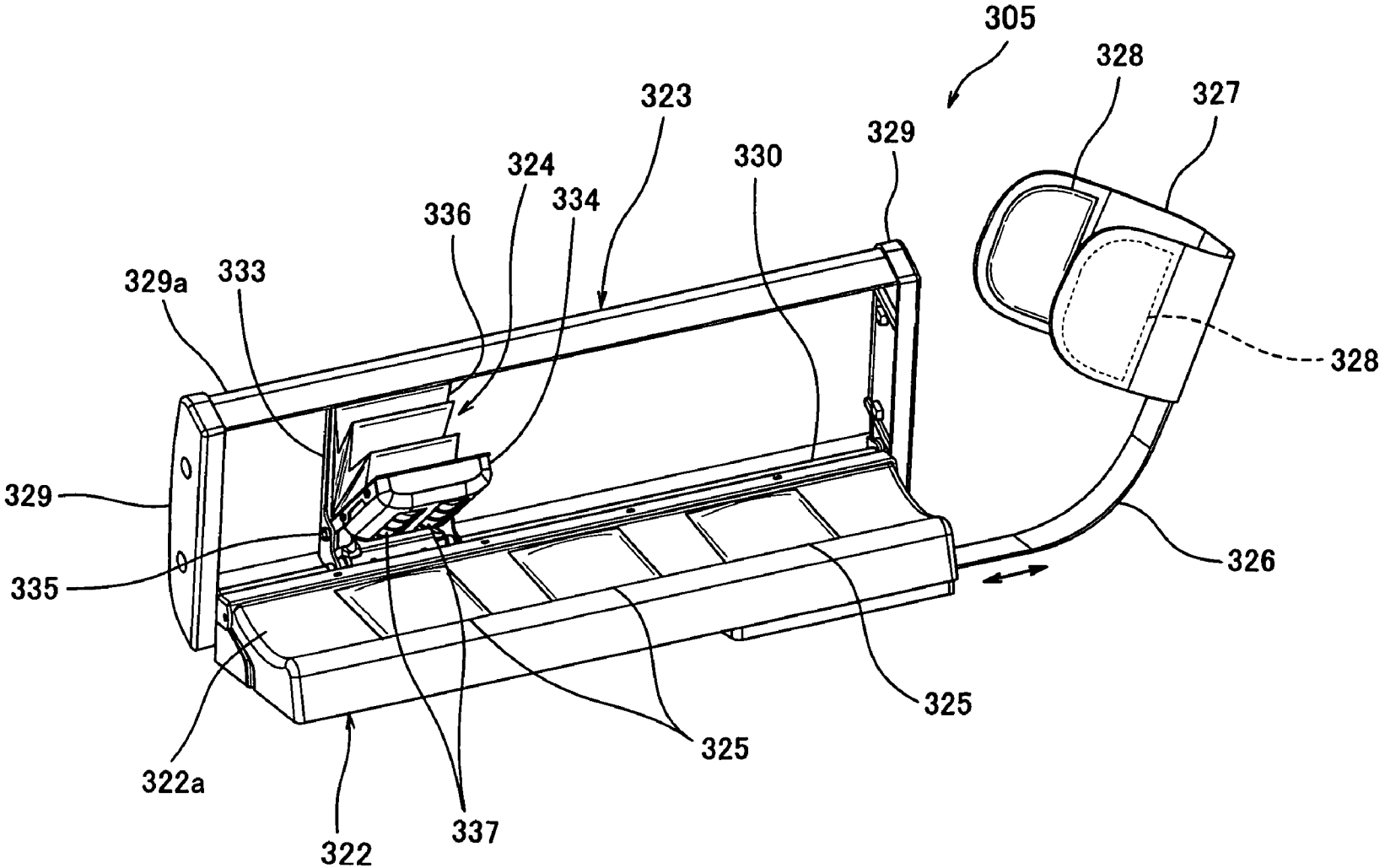
FIG. 30 is a perspective view showing the appearance of an armrest of the massaging apparatus according to embodiment 9 of the present invention.
Figure 31:
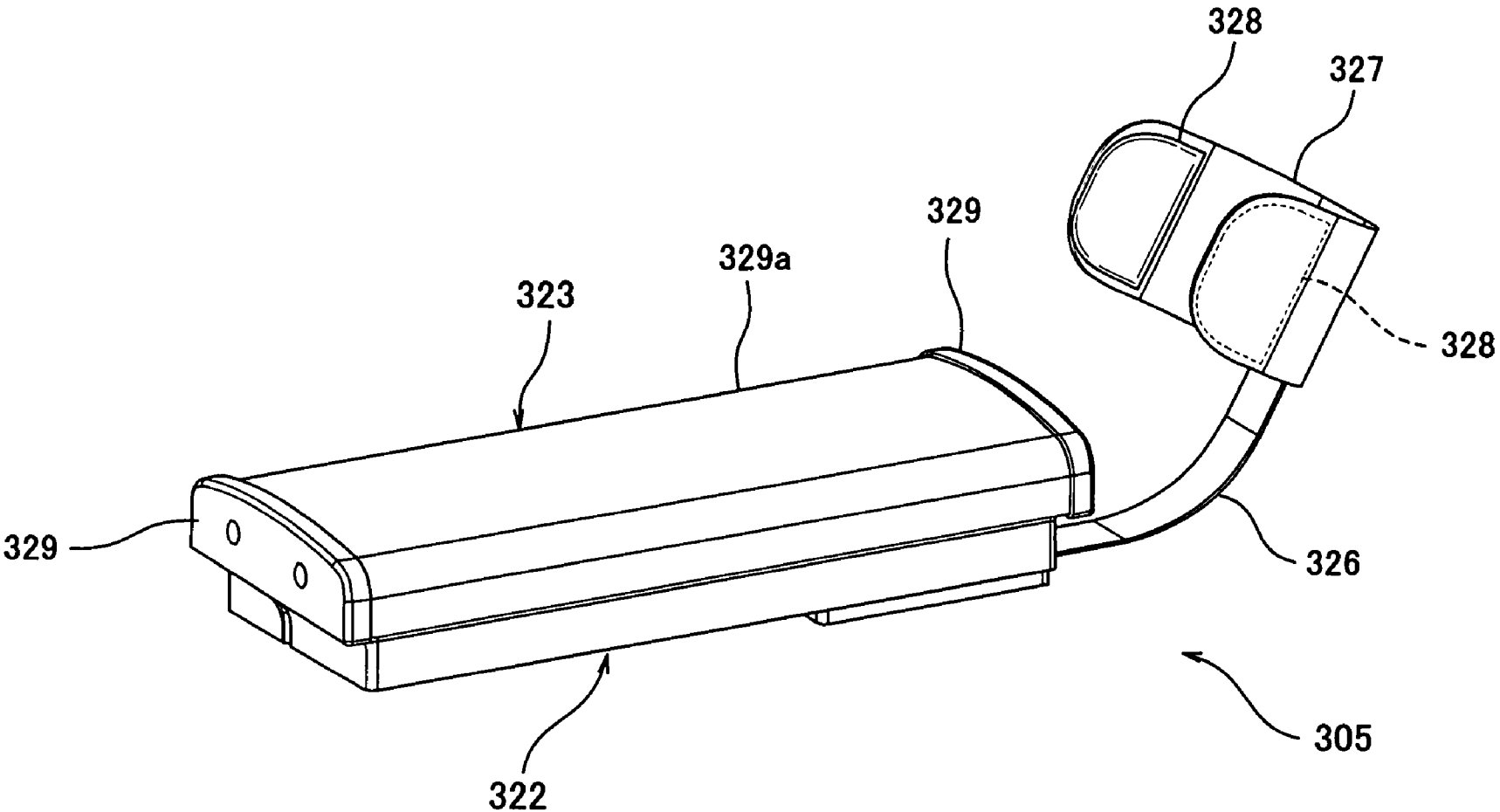
FIG. 31 is a perspective view showing the appearance of the armrest of the massaging apparatus according to embodiment 9 of the present invention.

FIGS. 30 and 31 are a perspective view showing the appearance of an armrest 305 of the massaging apparatus 301 according to embodiment 9 of the present invention. As shown in FIG. 30, the armrest 305 mainly includes a support base 322, a cover portion 323, a movable portion (pressing portion) 324, and air bags 325 constituting the massaging portion according to the present invention. The support base 322 has a substantially quadrangular plate extending forward and backward having a space therein and the upper face is the support face 322*a* that has a substantially circular arc groove-shaped concavity. The shape as described above allows, when the support base 322 is used as an armrest, the support face 322*a* to surely conform in shape to the shape of the forearm of the user to support the forearm. The support base 322 as described above is fixed to the backrest 203 so as to be always immovable to the backrest 203.

The three air bags 325 are arranged on the support face 322*a* forward and backward. These air bags 325 are connected via air hoses (not shown) to the air supply and exhaust device 312 (see FIG. 33). When the air supply and exhaust device 312 is driven, the air bags 325 can have expansion and contraction to provide stimulation to the forearm of the user.

Sheet-like heating elements (not shown) are attached to the surfaces of the air bags 325. These heating elements can be structured to generate heat when being driven, thus heating the forearm of the user.

Apart from the rear end of the support base 322 provides a long and thin and plate-like coupling member 326 that is provided by a flexible material and that is curved, at the middle part, in the upward direction. This coupling member 326 is attached at a rear end thereof with an upper arm support member 327 for supporting the upper arm of the user. The upper arm support member 327 is a substantially U-shaped plate member having the curved inner face for supporting the upper arm of the user. The air bags 328 are respectively fixed to two opposed parts at both ends of the upper arm support member 327. These air bags 328 are connected via air hoses (not shown) to the air supply and exhaust device 312 (see FIG. 33). When the air supply and exhaust device 312 is driven, the air bags 328 can have expansion and contraction to provide stimulation to the upper arm of the user.

The outer end of the support base 322 is coupled, in a hinged manner, with the cover portion 323 that is provided to be rotatable in the up-and-down direction. The cover portion 323 has a box-like shape the lower part thereof has an opening. As shown in FIG. 31, when the cover portion 323 is rotated in the downward direction until the limitation is reached, the entirety of the support face 322*a* can be covered by the cover portion 323 from the upper part (hereinafter this position of the cover portion 323 will be referred to as close position). The cover portion 323 in the close position is absorbed to the support base 322 by a certain amount of force by a magnet or the like (not shown). The cover portion 323 has an upper face that has a slightly rounded and substantially horizontal surface. When the user sitting on the massaging apparatus 301 does not receive the massage by the armrest 305, the cover portion 323 can be positioned at the close position as shown in FIG. 31 so that the upper face can be used as an armrest.

The cover portion 323 can be rotated from the close position to a position shown in FIG. 30 at which the cover portion 323 is inclined to the support face 322*a* with a predetermined angle (hereinafter this position of the cover portion 323 will be referred to as open position). This cover portion 323 can be retained at the open position by a lock mechanism (not shown).

Figure 32:
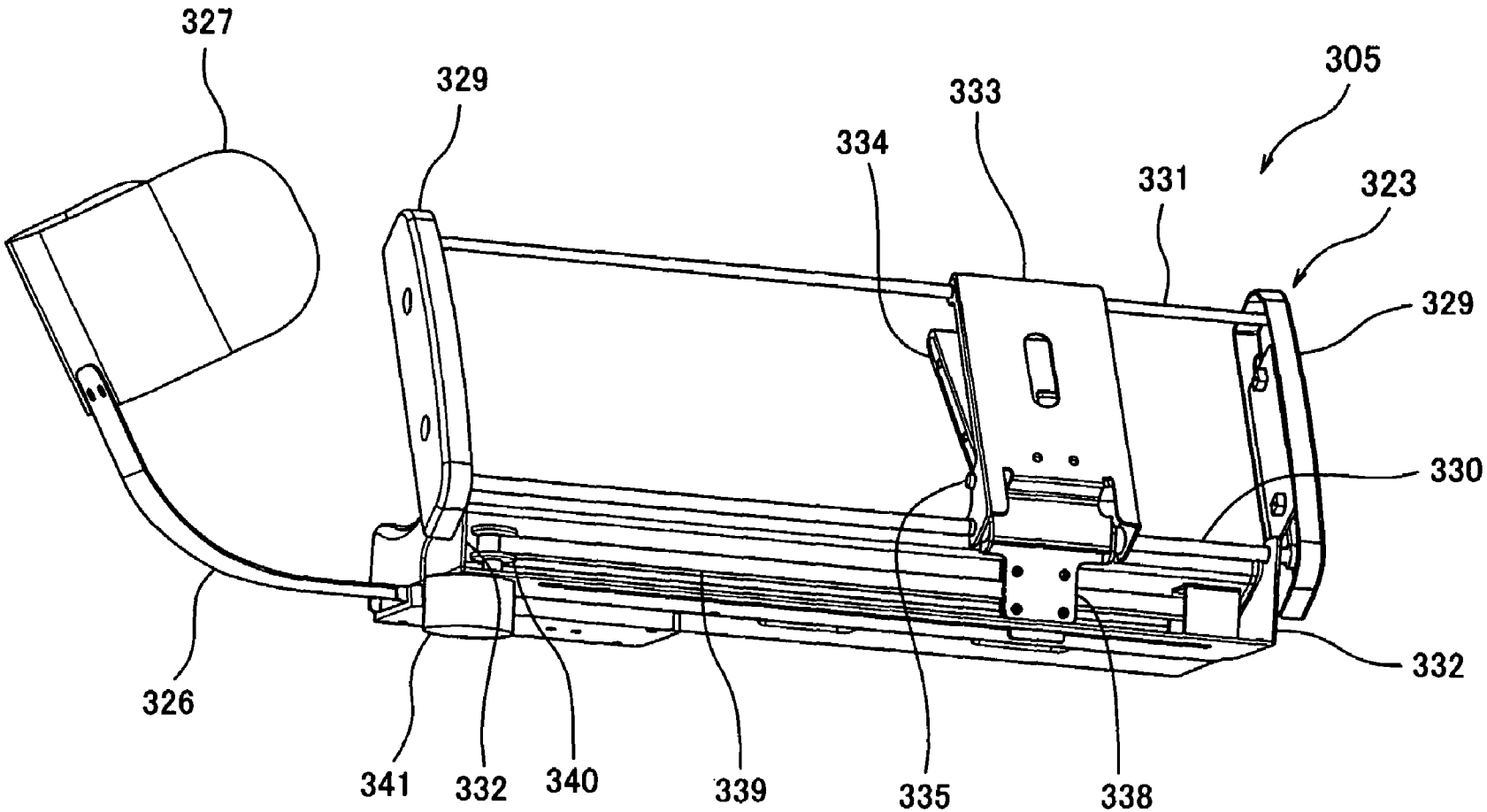
FIG. 32 is a partly cutaway perspective view showing the inner construction of the armrest of the massaging apparatus according to embodiment 9 of the present invention.

As shown in FIG. 30, a movable portion 324 serving as a pressing portion according to the present invention is provided inside the cover portion 323. FIG. 32 is a partly cutaway perspective view showing the inner construction of the armrest 305. As shown in FIG. 32, the cover portion 323 has a construction in which end members 329 are respectively provided at both ends in the longitudinal direction between which a plate member 329*a* (see FIG. 30 and FIG. 31) is provided. The end members 329 have therebetween two guide rails 330 and 331 having a space therebetween in the width direction. One guide rail 330 penetrates standing portions 332 provided from both ends of the support base 322 in the longitudinal direction to the upper part and also works as a rotational pivot of the cover portion 323. Both end members 329 have therebetween a movable element 333 that is one of components of the movable portion 324 and that is penetrated by these guide rails 330 and 331, respectively. This allows the movable element 333 to move between the end members 329 along the guide rails 330 and 331.

The movable portion 324 will be described in detail with regards to the construction. The movable element 333 and the support face 322*a* have therebetween a plate-like pressure member 334 that has a plate face having the substantially the same size as that of the movable element 333. The pressure member 334 is pivotally mounted to the movable element 333 by a pivot 335 that is in the vicinity of the guide rail 330 of the movable element 333 and that is in parallel with the guide rail 330 so that the pressure member 334 can be rotated to be close to and away from the support face 322*a*. Air bags 336 constituting the accordion-like driving portion according to the present invention are respectively attached to the opposed faces to the movable element 333 and the pressure member 334 can be opened or closed in a substantially fan-like manner. This air bag 336 is connected via an air hose (not shown) to the air supply and exhaust device 312 (see FIG. 33). This allows, when the air supply and exhaust device 312 is driven to cause the air bag 336 to have expansion and contraction, the pressure member 334 to be rotated to be close to and away from the support face 322*a*. In other words, the driving of the air supply and exhaust device 312 causes the movable portion 324 to be close to or away from the support face 322*a*.

The movable element 333 and the pressure member 334 are provided with a spring (not shown). This spring biases the pressure member 334 toward the movable element 333. Thus, when air is supplied to the air bag 36, the pressure member 334 is away from the movable element 333 against the biasing force by this spring and, when air is exhausted from the air bag 336, the pressure member 334 is moved toward the movable element 333 by the biasing force by this spring.

A plurality of rollers 337 are attached to the opposed face of the pressure member 334 to the support face 322*a* so as to be rotatable around the rotation axes extending in the direction substantially orthogonal to the longitudinal direction of the guide rails 330 and 331 (see FIG. 30). The rollers 337 are provided to be slightly protruded from the opposing face of the pressure member 334 to the support face 322*a*, thus allowing the rollers 337 to have a contact with the arm portion of the user when the pressure member 334 is pushed to the arm portion. The air bag 325 and the rollers 337 constitute the driving portion according to the present invention. In an actual case, the opposed face of the cover portion 323 to the support face 322*a* is adhered with a cloth to cover the entirety of the movable portion 324. However, the cloth is omitted in the drawing for simplicity.

The pressure member 334 has therein the vibrator 334*a* (see FIG. 33). The operation of this vibrator 334*a* can vibrate the pressure member 334, thus providing stimulation to the forearm of the user.

The movable portion 324 includes an extension portion 338 extending to the inner part of the support base 322. The extension portion 338 is fixed to a part of a circular belt 339. The belt 339 is engaged with pulleys 340 respectively provided in the vicinity of both ends of the internal space of the support base 322 forward and backward (only one of the pulleys is shown in FIG. 31). One of the pulleys 340 is coupled to output shaft of a motor 341 attached to the support base 322. In this way, the motor 341 constitutes the driving portion according to the present invention. This allows, when the motor 341 is driven, the movable portion 324 to move forward and backward to allow, when the pressure member 334 is pushed to the arm portion of the user, the movable portion 324 to move to roll the rollers 337 on the arm portion of the user, providing a so-called rubbing kneading. The support face 322*a* and the pressure member 334 can sandwich the forearm of the user while the forearm is being massaged. This prevents the forearm of the user from escaping in the direction along which the pressure member 334 and the air bag 325 apply a pressure and surely provides the pressure stimulation by the pressure member 334 and the air bag 325 to the forearm of the user.

FIG. 33 is a block diagram illustrating a part of the construction of the massaging apparatus 301 according to embodiment 9 of the present invention. As shown in FIG. 33, the massaging apparatus 301 includes therein a control portion 342. This control portion 342 is provided by a CPU, ROM, RAM, and a timer for example and can execute a control program as described later to control the operations of the connected devices, respectively.

The control portion 342 is connected with the air supply and exhaust device 312 so that the control portion 342 can control the operation of the air supply and exhaust device 312. This air supply and exhaust device 312 is provided by a switching valve (e.g., electromagnetic valve) and an air pump or the like and is communicated via an air hose to the above-described air bags 309, 310, 320, 325, 328, and 336. The air supply and exhaust device 312 also can be provided to supply air to or to exhaust air from the respective air bags 309, 310, 320, 325, 328, and 336, in an individual manner.

The control portion 342 is also connected, via the driving circuit 342*a*, with a motor 315 for moving the movable portion 308, the motor 319*a* for rotating the roller 319, and the motor 341 for moving the movable portion 341, respectively, thereby controlling the operations of the motors 315, 319*a*, and 341, respectively.

The control portion 342 is also connected, via the driving circuit 342*b*, with the vibrators 316, 321, and 334*a*, respectively, thereby controlling the operations of the vibrators 316, 321, and 334*a*, respectively.

Furthermore, the support base 307 includes therein the two limit switches 343. One of the limit switches 343 is provided to detect when the movable portion 308 reaches one end of the moving range while the other of the limit switches 343 is provided to detect when the movable portion 308 reaches the other end of the moving range. The respective limit switches 343 are connected to the control portion 342 to transmit a detection signal to the control portion 342.

The support base 322 also includes therein the two limit switches 344. The respective limit switches 344 can be used to detect when the movable portion 324 reaches the ends of the moving range. The respective limit switches 344 are connected to the control portion 342 to transmit a detection signal to the control portion 342.

The control portion 342 is also connected to the operation portion 345 for accepting the operation instruction from the user (e.g., remote controller). The operation portion 345 includes a plurality of button switches. The user can select and depress one or a plurality of these button switches to instruct the massaging apparatus 301 to perform an operation.

Although FIG. 33 described the massaging apparatus 301 such that the massaging apparatus 301 has only one armrest 305 for simplicity, one massaging apparatus 301 in an actual case includes two armrests 305.

The other components of the massaging apparatus according to embodiment 9 are the same as those of the massaging apparatus 201 according to embodiment 6 and thus are provided with the same reference numerals and will not be described further.

Next, the massaging apparatus 301 according to embodiment 9 of the present invention will be described with regards to the operation. The user sits on the massaging apparatus 301 to use the operation portion 345 to input an operation instruction. When the user inputs an instruction for starting the massage by the footrest 304, then a signal representing this is transmitted to the control portion 342. Then, the control portion 342 transmits, to the air supply and exhaust device 312, the motors 315 and 319*a*, and the vibrators 316 and 321, control signals for providing the operation controls as described below, respectively.

The control portion 342 controls the air supply and exhaust device 312 to operate to repeat the expansion and contraction of the air bags 309 and 310 with a predetermined time interval. On the other hand, the control portion 342 controls the motor 315 to be rotated with a predetermined rotation rate in one direction to subsequently control, after receiving the detection signal from the limit switch 343, the motor 315 to be rotated in another direction.

The control portion 342 controls the motor 319*a* to be rotated with a fixed rotation rate in a fixed direction and controls the vibrators 316 and 321 to be vibrated with a fixed cycle.

When the user inputs an instruction to start the massage by the armrest 305, then a signal representing this is transmitted to the control portion 342. Then, the control portion 342 transmits to the air supply and exhaust device 312, the motor 341, and the vibrator 334, control signals for providing the operation controls as described below, respectively. The control portion 342 controls the air supply and exhaust device 312 to operate to repeat the expansion and contraction of the air bags 325 and 328 with a predetermined time interval and to operate to provide the expansion of the air bag 336 to a certain pressure. On the other hand, the control portion 342 controls the motor 341 to be rotated with a predetermined rotation rate in one direction to subsequently control, after receiving the detection signal from the limit switch 344, the motor 341 to be rotated in another direction.

The control portion 342 controls the operation of the vibrator 334*a* so that the vibrator 334*a* is vibrated with a fixed cycle.

The operation control of the devices as described above is an example. Another operation control is also possible. For example, the motor 319*a* also may be rotated while the rotation rate being changed.

Although embodiment 9 described a construction in which the massaging apparatus 301 includes both of the footrest 304 and the armrest 305, the present invention is not limited to this construction. Another construction also may be used in which the massaging apparatus 301 includes only the footrest 304 or the armrest 305.

Although the footrest 304 and the armrest 305 in the above description had different constructions, the massaging apparatus 301 also may have an armrest having the same construction as that of the footrest 304 or a footrest having the same construction as that of the armrest 305.

Although the construction in which the movable portions 308 and 324 are moved by the motors 315 and 341 has been described, the present invention is not limited to this. For example, another construction also may be used in which the movable portions 308 and 324 are moved by an actuator different from a motor (e.g., air cylinder).

Embodiment 10

Figure 34A:
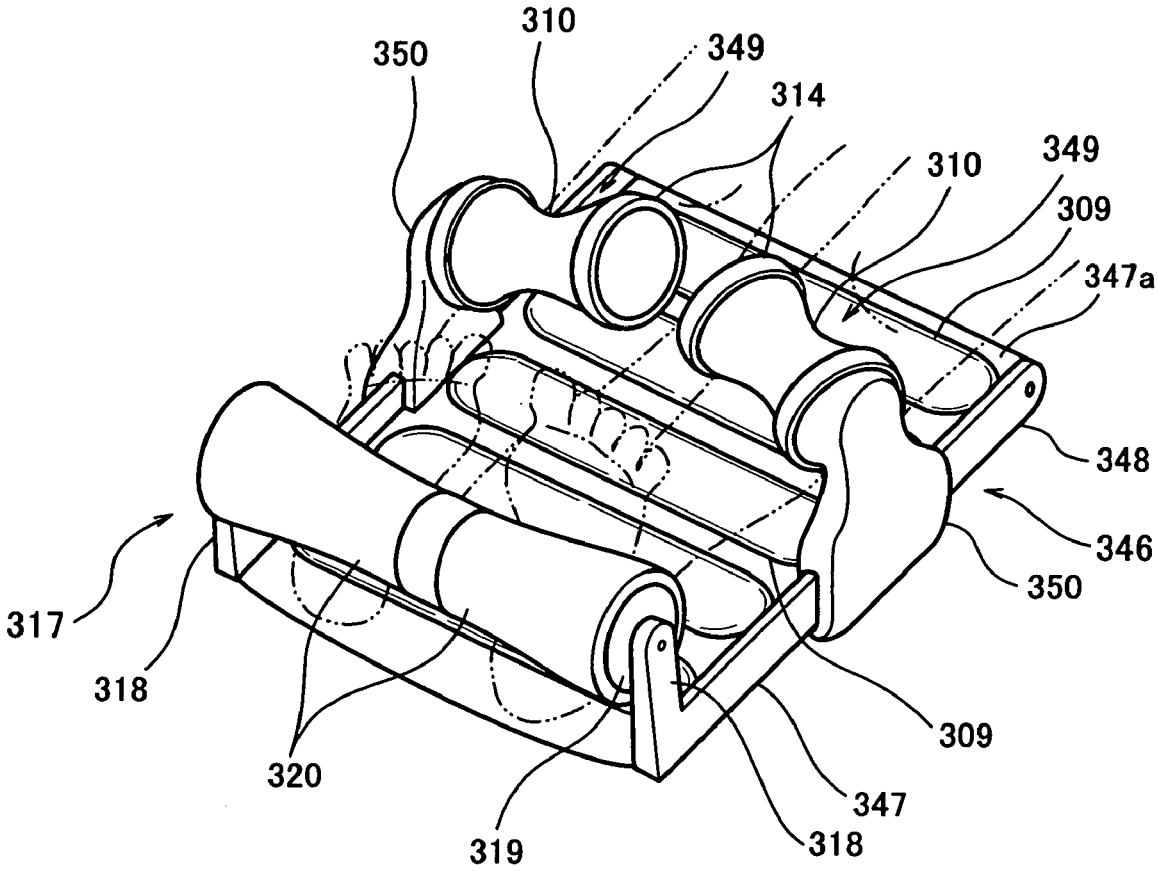
FIGS. 34(*a*) and 34(*b*) illustrate the construction of the footrest of the massaging apparatus according to embodiment 10 of the present invention.
Figure 34B:
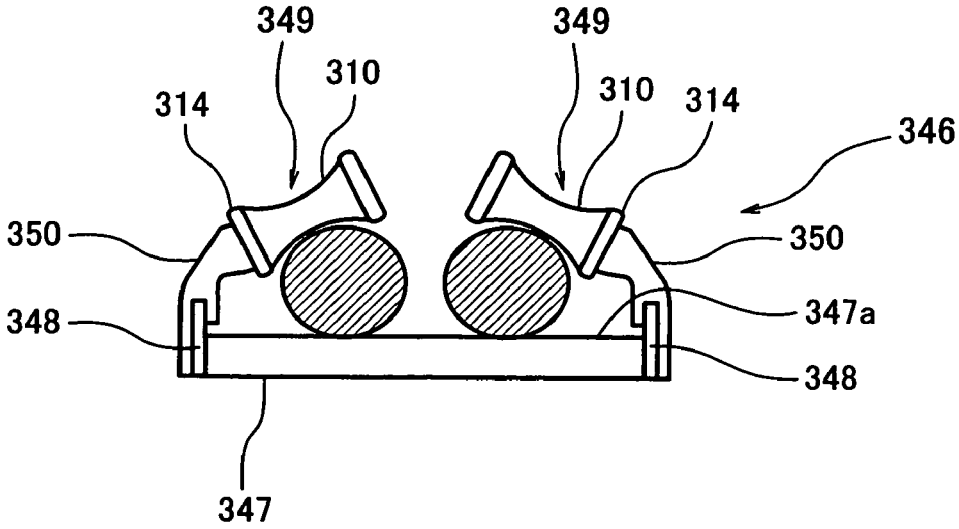

FIGS. 34(*a*) and 34(*b*) illustrate the construction of a footrest 346 of the massaging apparatus according to embodiment 10 of the present invention. FIG. 34(*a*) is a perspective view showing the appearance while FIG. 34(*b*) is a top view showing when the footrest is used. The footrest 346 according to embodiment 10 includes a support base 347 that has a substantially the same shape as that of the support base 307 according to embodiment 9 except the opening 311. The support base 347 has at the left and right ends guide rails 348 that are engaged with movable elements 350 included in movable portions 349. The movable element 350 can be moved along the guide rail 348 in the longitudinal direction of the guide rail 348 (i.e., in the up-and-down direction).

The movable portion 349 has a construction in which the roller 314 is pivotally mounted to the movable element 350. The movable element 350 is protruded in the forward direction from a part at which the movable element 350 is engaged with the guide rail 348. The roller 314 is provided to be opposed to a support face 347*a* of the support base 347 to have a distance therebetween and pivotally mounted to be rotatable, at the front end part of the movable element 350, around a rotation axis that is slightly inclined to the support face 347*a* and that extends in the substantially left-and-right direction.

The movable portion 349 as described above is connected to the output shaft of the motor 315 included in the support base 347 and is moved along the guide rail 348 by the operation of the motor 315.

The other components of the massaging apparatus according to embodiment 10 are the same as those of the massaging apparatus 301 according to embodiment 9 and thus are provided with the same reference numerals and will not be described further.

Although embodiment 10 described a construction in which the massaging apparatus includes the footrest 346, the present invention is not limited to this construction. Another construction also may be used in which the massaging apparatus includes an armrest having the same construction as that of the footrest 346.

Embodiment 11

Figure 35:
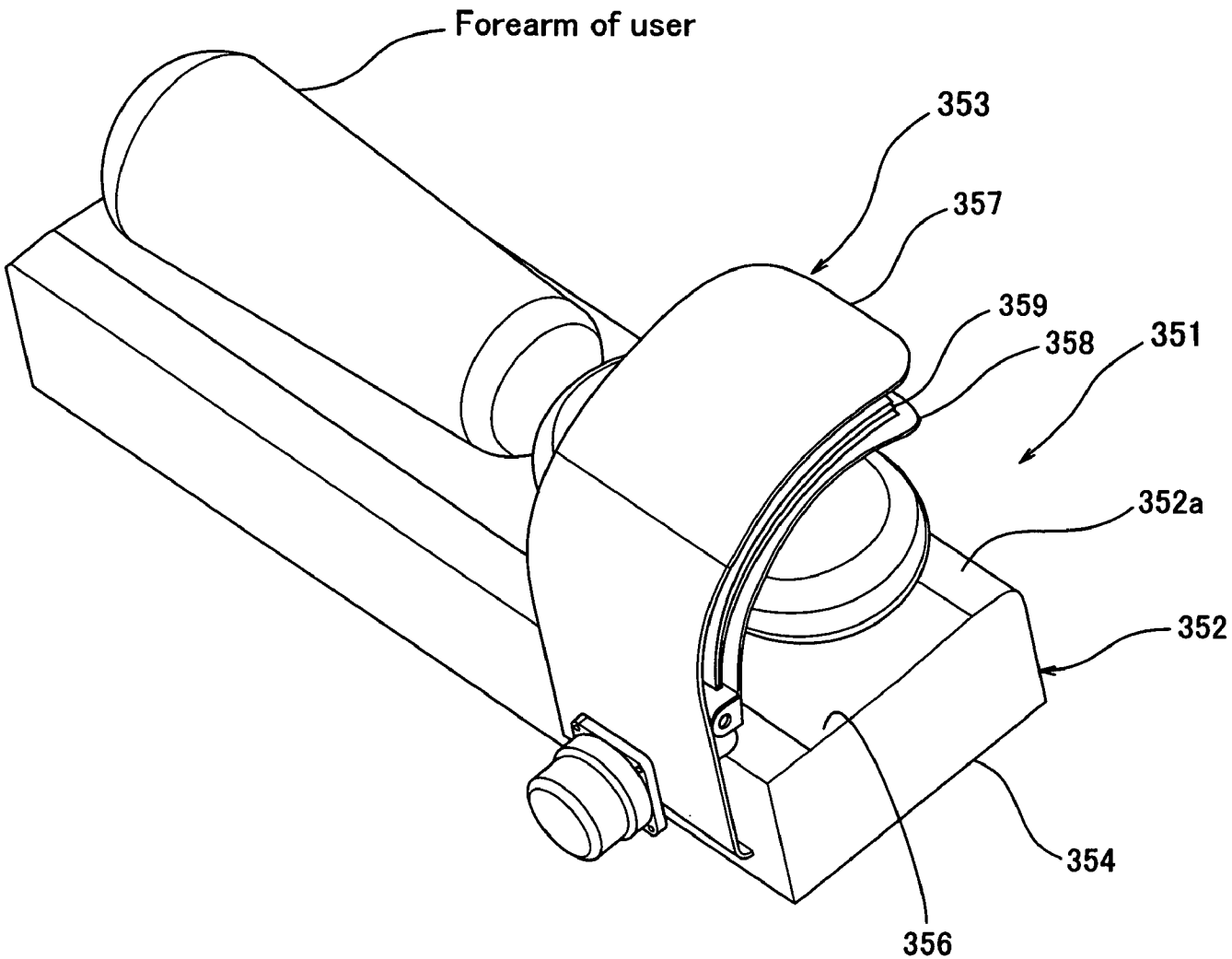
FIG. 35 is a perspective view showing the appearance of an armrest of the massaging apparatus according to embodiment 11 of the present invention.
Figure 36:
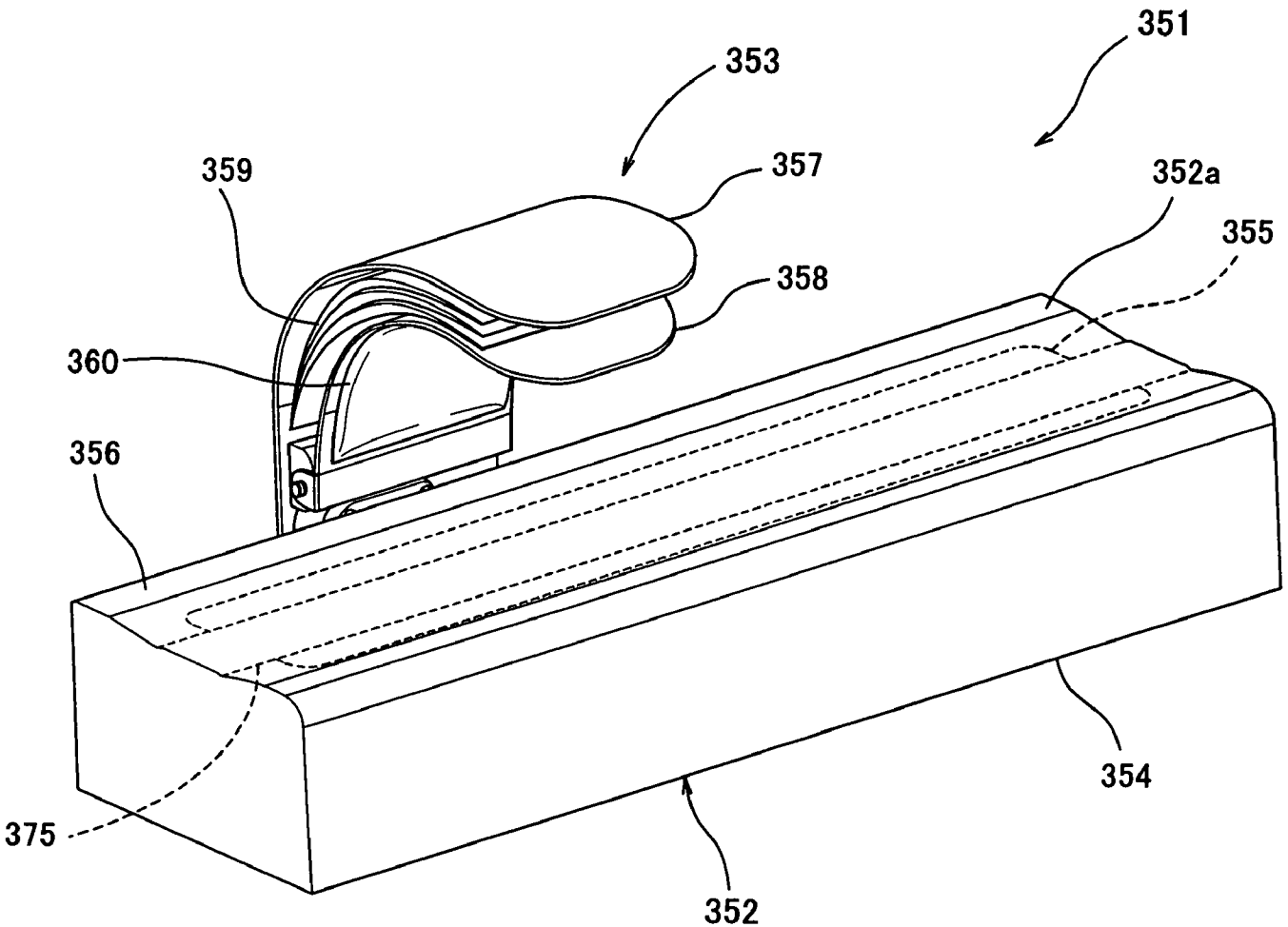
FIG. 36 is a perspective view showing the appearance of the armrest of the massaging apparatus according to embodiment 11 of the present invention.

FIG. 35 and FIG. 36 are a perspective view showing the appearance of an armrest 351 of the massaging apparatus according to embodiment 11 of the present invention. As shown in FIG. 35 and FIG. 36, the armrest 351 according to embodiment 11 mainly includes a support base 352 and a movable portion 353. The support base 352 has a box-like housing 354 that has a space therein and that extends forward and backward. The housing 354 includes an opening 355 extending in the substantially entire length of the upper face forward and backward. The upper face of the housing 354 is adhered with a cloth cover 356 so that this opening 355 is sealed. The support base 352 as described above is fixed to the backrest 203 so as to be always immovable to the backrest 203.

The movable portion 353 is provided so as to be protruded from the outer side of the support base 352 in the upward direction. The movable portion 353 is entirely curved to have a substantially circular arc shape so as to cover the support face 352*a* (that is the upper face of the support base 352) to have a space therebetween. The movable portion 353 includes a first member 357 configured such that an upper portion of a plate-shaped member is curved in circular shape and a lower portion is bent substantially at a right angle to be opposed to the curved upper portion. The first member 357 is configured to have a middle part that is in parallel with the side face of the housing 354, to have an upper part that covers the upper face of the housing 354, and to have the lower part that is provided to be inserted to the inner part of the housing 354 from a slit-like opening (not shown) that is provided at the side face of the housing 354 and that extends forward and backward.

A second member 358 having a shape obtained by bending a plate-like member along the curved face of the first member 357 is provided on inner side of the curved part of the first member 357 that is at the upper part of the support face 352*a*. The second member 358 as described above has the lower end that is pivotally mounted to a part slightly upper of the support face 352*a* of the curved inner face of the first member 357 by an axis extending forward and backward. This allows the second member 358 to be rotated to be close to or away from the support face 352*a*.

The air bags 359 constituting the driving portion according to the present invention are attached to the opposed faces of the first member 357 and the second member 358. The air bag 359 has one end having an accordion-like shape to be developed in a substantially fan-like manner. The air bag 359 is connected via an air hose (not shown) to the air supply and exhaust device 312 (see FIG. 40). This allows, when the air supply and exhaust device 312 is driven, the air bag 359 to have expansion and contraction to cause the second member 358 to be rotated to be close to and away from the support face 352*a*. In other words, the driving of the air supply and exhaust device 312 allows the movable portion 353 to be close to or away from the support face 352*a*. The first member 357 and the second member 358 are provided with a spring (not shown) for biasing the second member 358 toward the first member 357. Thus, when air is supplied to the air bag 359, the second member 358 is moved away from the first member 357 against the biasing force by this spring and, when air is exhausted from the air bag 359, the biasing force by this spring biases the second member 358 toward the first member 357.

Two air bags 360 are attached to the opposed face of the second member 358 that is opposed to the support face 352*a*. These air bags 360 are also connected via an air hose (not shown) to the air supply and exhaust device 312 (see FIG. 40). The air bag 360 as described above constitutes the massaging portion according to the present invention. The driving of the air supply and exhaust device 312 allows the air bag 360 to have expansion and contraction to have a contact with the arm portion of the user to give pressure stimulation thereto.

Sheet-like heating elements (not shown) are attached to the surfaces of the air bags 360. These heating elements are configured to generate heat when being driven, thus heating the forearm of the user.

Figure 37:
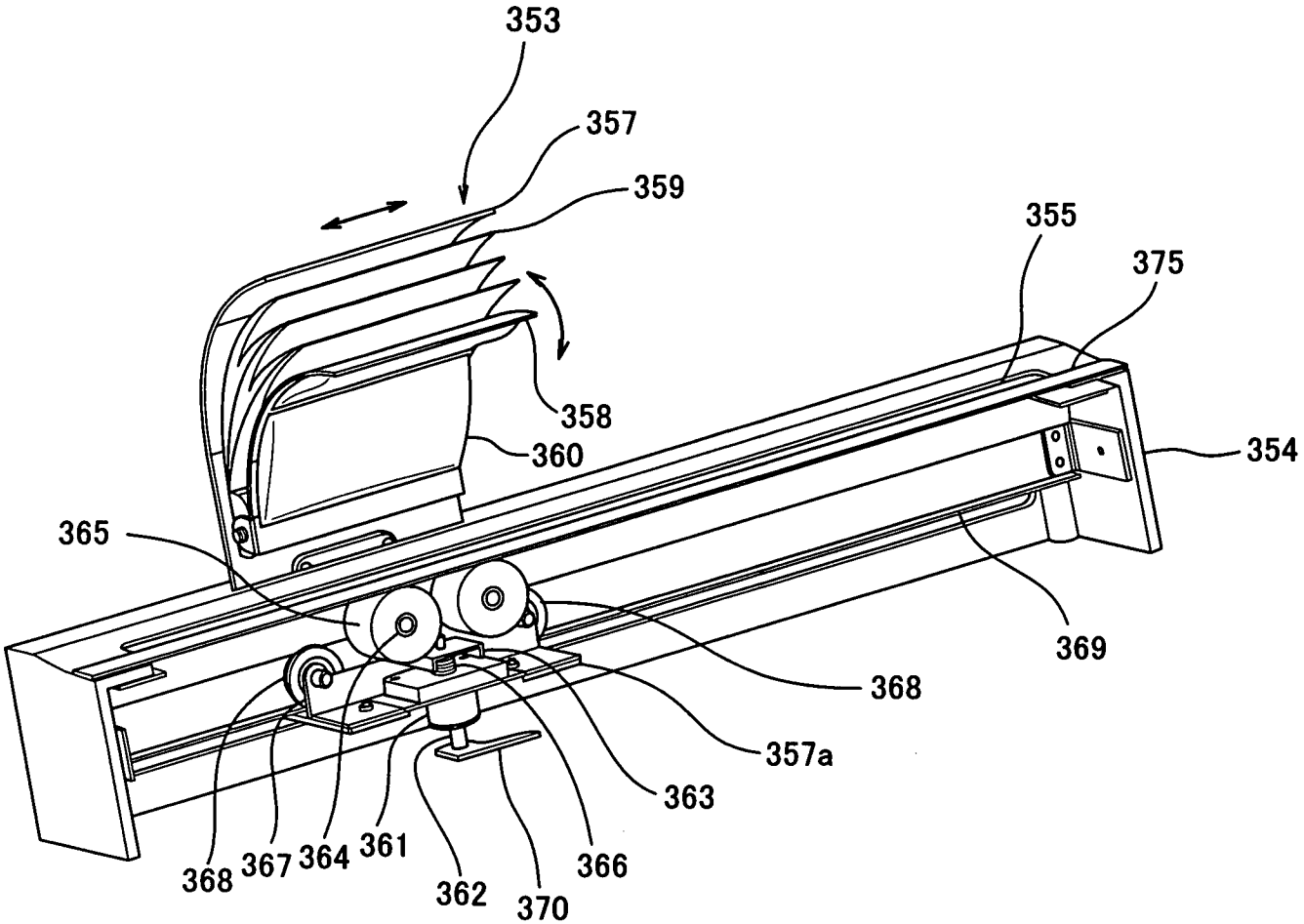
FIG. 37 is a partly cutaway perspective view showing the inner construction of the armrest of the massaging apparatus according to embodiment 11 of the present invention.
Figure 38:
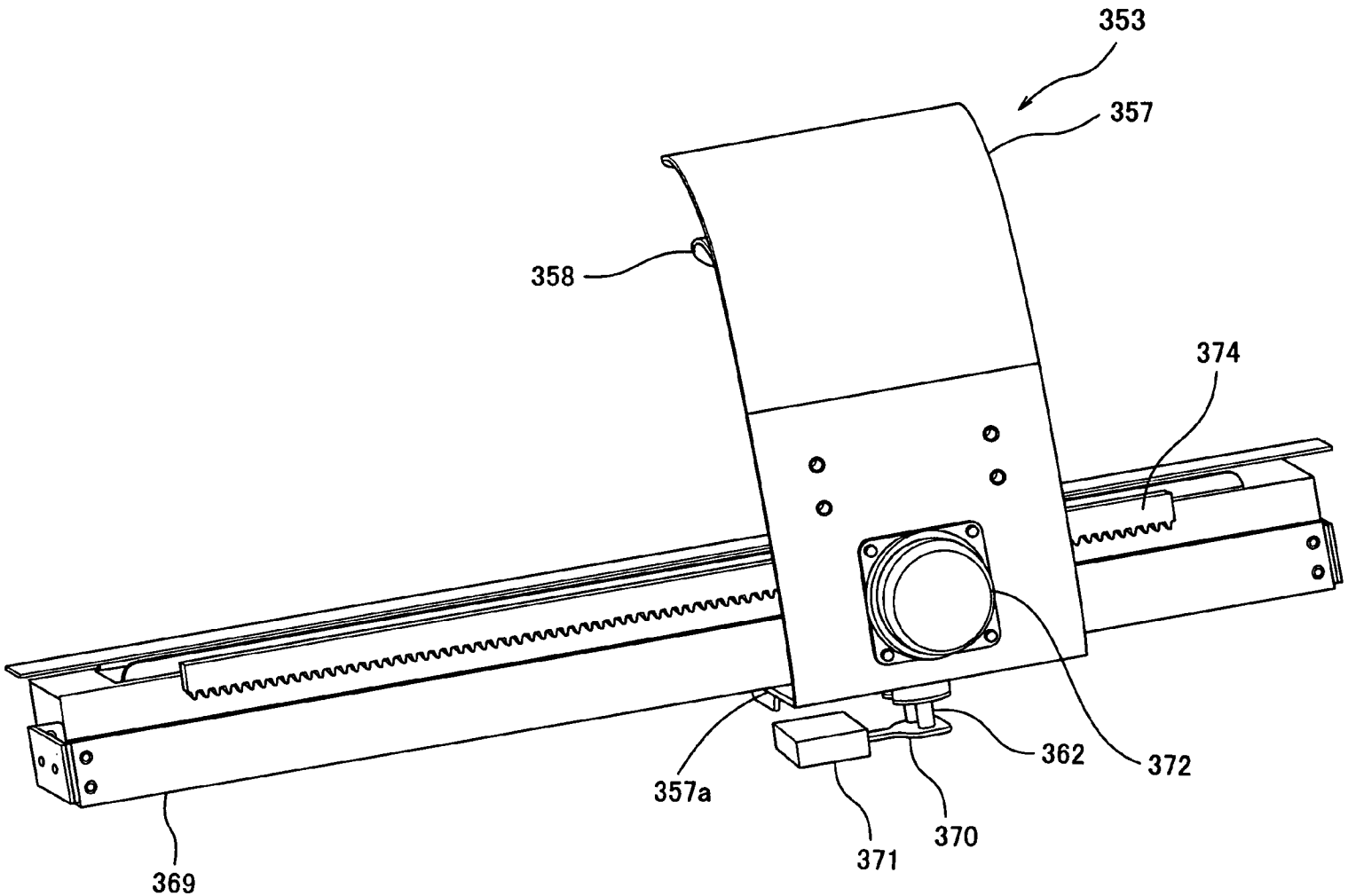
FIG. 38 is a partly cutaway perspective view showing the inner construction of the armrest of the massaging apparatus according to embodiment 11 of the present invention.
Figure 39:
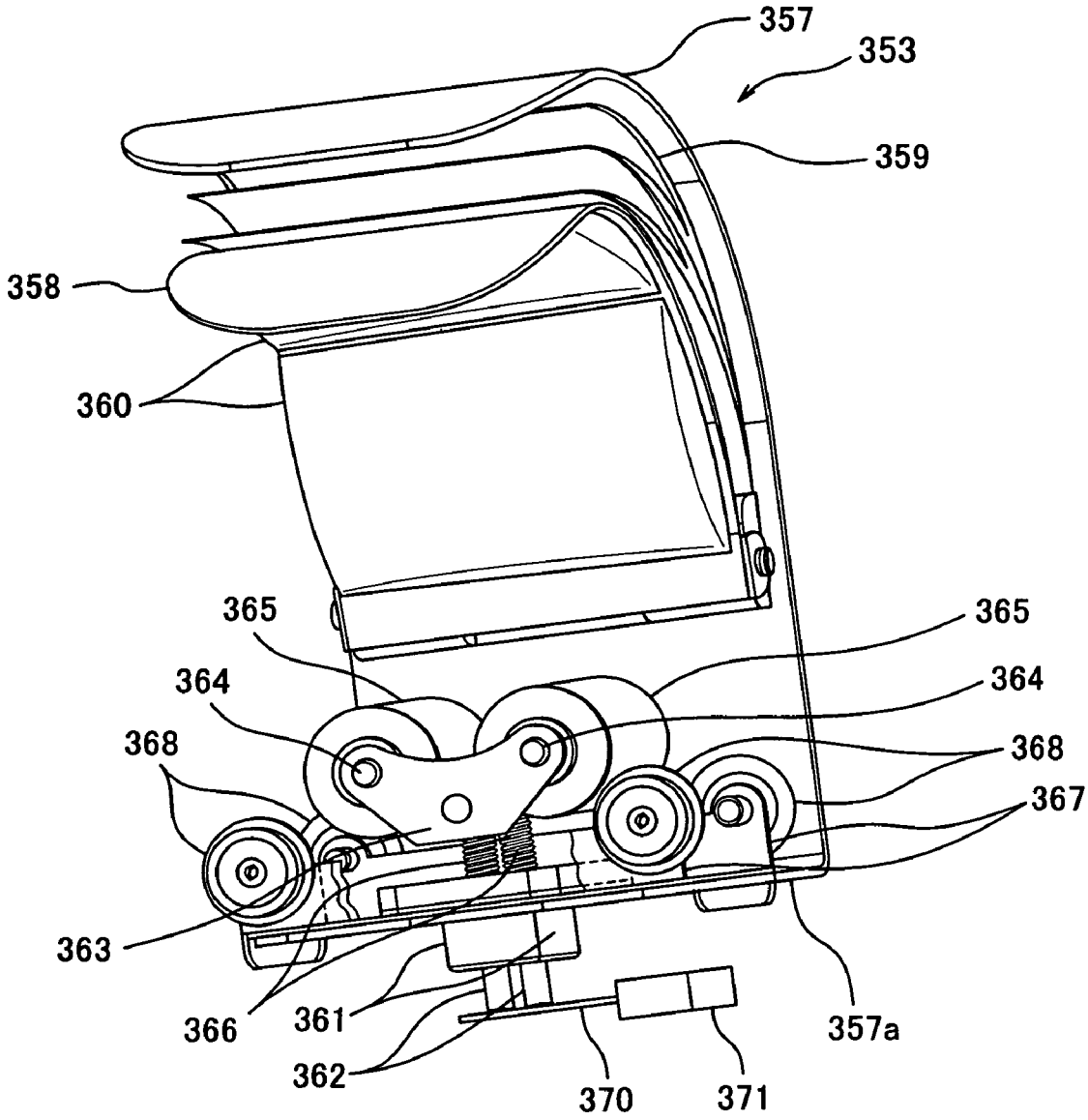
FIG. 39 is a perspective view showing the construction of a movable portion owned by the armrest of the massaging apparatus according to embodiment 11 of the present invention.

FIG. 37 and FIG. 38 are a partly cutaway perspective view showing the inner construction of the armrest 351. FIG. 39 is a perspective view showing the construction of the movable portion 353. As shown in FIG. 37 and FIG. 39, the first member 357 has at the lower part a horizontal part 357*a*. The horizontal part 357*a* is provided with the guide 361 that has a shape in which a quadrangular plate is provided with two cylindrical projections. This horizontal part 357*a* includes two circular holes (not shown). The respective circular holes are penetrated by the cylindrical projections of the guide 361 and the quadrangular plate-like flange part has a close contact with the upper face of the horizontal part 357*a* while the guide 361 being fixed to the horizontal part 357*a*. The guide 361 includes two circular holes coaxial with the cylindrical projections and these circular holes are penetrated by the guide bars 362 with a little play. A pivot member 363 is fixed to the upper end of the guide bar 362. This pivot member 363 has parts opposed to each other in the left-and-right direction between which two pivots 364 parallel to each other are arranged forward and backward. The respective pivots 364 pivotally support two rollers 365.

The pivot member 363 and the guide 361 have therebetween a spring 366 penetrated by the guide bar 362. This spring 366 biases the pivot member 363 in the upward direction.

At the left and right sides of the guide 361 in the horizontal part 357*a*, the protruding portions 367 that are upwardly protruded are provided. Four rollers 368 are mounted to the protruding portions 367 to be rotatable around pivots extending rightward and leftward. The outer sides of the respective protruding portions 367 are provided with guide rails 369 extending forward and backward. These guide rails 369 are fixed to the inner wall of the housing 354. The rollers 368 rotatably engage with the respective guide rails 369, thereby allowing the movable portion 353 to move forward and backward.

The lower part of the guide bar 362 is protruded from the lower end of the guide 361 and the lower end of the guide bar 362 has a contact with the detection plate 370 provided in a substantially horizontal direction. The detection plate 370 is connected to the limit switch 371. The limit switch 371 is provided to be in an off status when the detection plate 370 is in a free status. When the detection plate 370 is pushed in the downward direction, the off status is changed to an on status, which is detected. Thus, when the roller 365 is pushed in the downward direction against the biasing force by the spring 366, the guide bar 362 is moved in the downward direction along the guide 361 and the detection plate 370 is pushed in the downward direction, thereby turning on the limit switch 371.

As shown in FIG. 38, a motor 372 is attached to an outer side surface of a portion of the first member 357 which is slightly above the horizontal part 357*a* such that an output shaft (thereof) penetrates therethrough. A pinion gear (not shown) is fixed to the output shaft of the motor 372. This pinion gear is meshed with a rack 374 fixed to the inner part of the housing 354. The rack 374 is provided to be parallel to the guide rail 369. Thus, the operation of the motor 372 allows the first member 357 to move forward and backward. In this way, the motor 372 constitutes the driving portion according to the present invention.

As shown in FIG. 37, the housing 354 has at the upper part the opening 355. The roller 365 is provided to be opposed to this opening 355. The support band 375 is attached to the upper face of the housing 354 such that the support band 375 seals this opening 356 for preventing the forearm of the user from being dropped. This support band 375 is a cloth band extending forward and backward and is attached to the housing 354 to cover the entire length of the opening 355 with a certain amount of tensile force. The above-described cloth cover 356 is attached to the upper face of the housing 354 so as to cover the support band 375 and the opening 355 (see FIG. 36).

Figure 40:
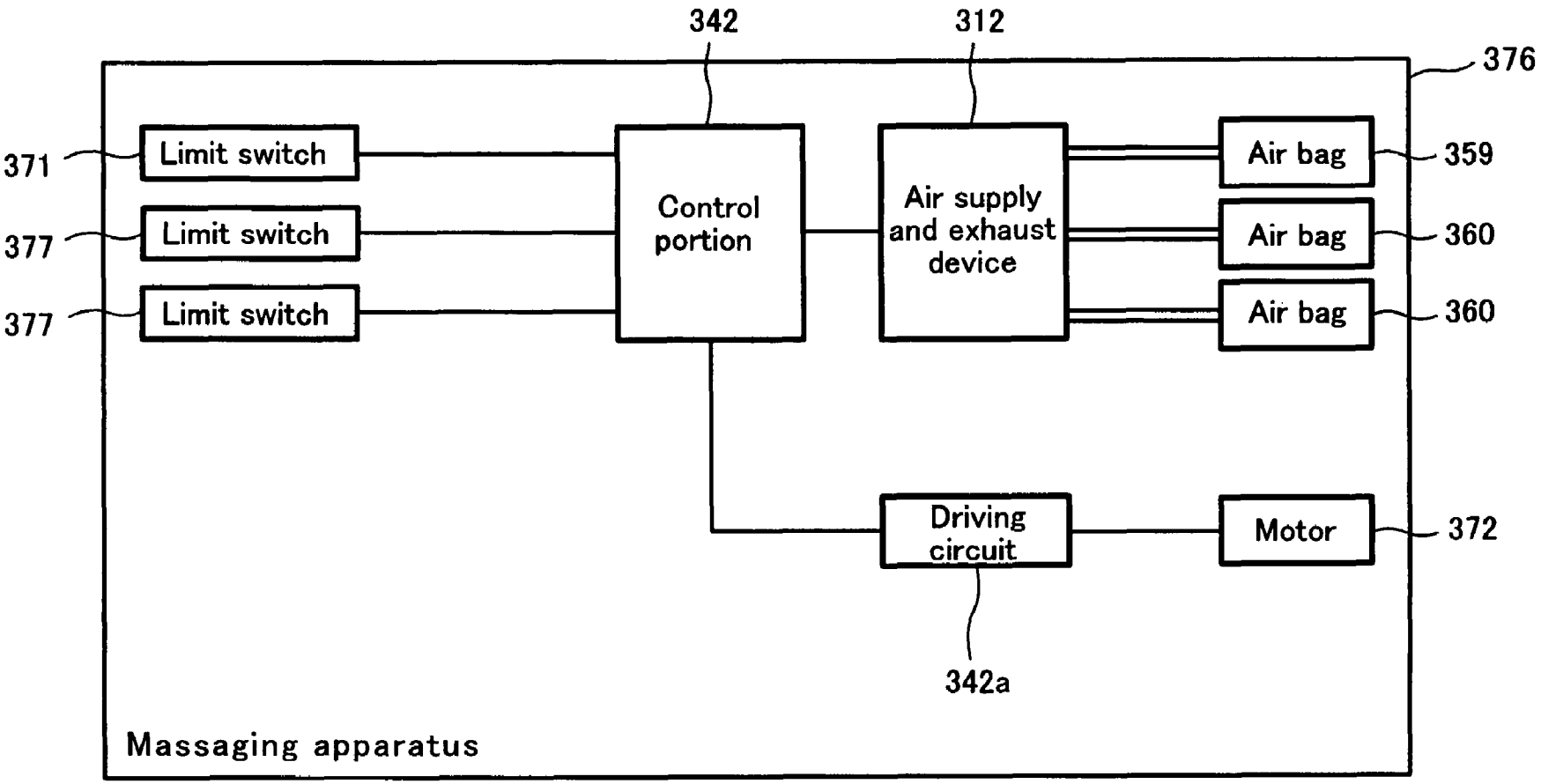
FIG. 40 is a block diagram showing a part of the construction of the massaging apparatus according to embodiment 11 of the present invention.

FIG. 40 is a block diagram showing a part of a construction of a massaging apparatus 376 according to embodiment 11 of the present invention. In the massaging apparatus 376 according to embodiment 11, the air supply and exhaust device 312 is attached via an air hose to the above-described air bags 359 and 360. This air supply and exhaust device 312 can supply air to or exhaust air from the air bags 359 and 360 in an individual manner.

The control portion 342 is connected via the driving circuit 342*a* to the motor 372 for moving the movable portion 353, thus controlling the operation of the motor 372.

The control portion 342 is also connected with the limit switch 371 and two limit switches 377 provided independently of the limit switch 371. The limit switches 377 are included in the housing 354. One of the limit switches 377 detects when the movable portion 353 reaches one end of the moving range and the other of the limit switches 377 detects when the movable portion 353 reaches the other end of the moving range. The limit switches 371 and 377 as described above are provided to transmit a detection signal to the control portion 342.

Although FIG. 40 showed the massaging apparatus 376 including only one armrest 351 for simplicity, the massaging apparatus 376 in actual cases includes two armrests 351.

The other components of the massaging apparatus 376 according to embodiment 11 are the same as those of the massaging apparatus 301 according to embodiment 9 and thus are provided with the same reference numerals and will not be described further.

Next, the massaging apparatus 376 according to embodiment 11 will be described with regards to the operation. The user sits on the massaging apparatus 376 to put the forearm on the support base 352 of the armrest 351. Then, the forearm of the user pushes down the roller 365 to cause the limit switch 377 to be in an on status and a detection signal is transmitted to the control portion 342. While receiving this detection signal, the control portion 342 determines that the forearm of the user is on the support base 352 to drive the air supply and exhaust device 312 so as to cause the air bags 359 and 360 to have expansion and contraction.

The air bag 359 is used to adjust the massaging strength and keeps, after being supplied with a fixed amount of air, the current status (i.e., does not have expansion or contraction). The air bag 360 is used to directly provide stimulation to the forearm of the user and has expansion and contraction to change the pressure to the forearm of the user, thereby providing the massage in a rhythmical manner.

example, a fixed amount of air is supplied to the air bag 359 so that the air bag 359 is expanded to a certain level and air is supplied to the air bag 360. Then, the two air bags 360 sandwich the forearm of the user to subsequently exhaust air from the air bag 359 to use the force by the spring to draw the second member 358 toward the first member 357, thereby moving the air bags 360 sandwiching the forearm of the user away from the forearm of the user. Such an operation control allows the air bags 360 to press the forearm of the user while sandwiching the forearm of the user so that the respective air bags 360 are smoothly moved on the forearm of the user to change the position at which pressure is applied, thereby providing stimulation to the forearm of the user as if a so-called pull kneading is provided to the forearm of the user.

Another operation control also may be used in which, when the limit switch 371 is turned off before the limit switch 377 is turned on, then it is determined that the roller 365 reaches a point at which the forearm of the user does not exist in the moving range within which the roller 365 moves. Then, the control portion 342 causes the motor 372 to rotate in a reverse direction. Such a structure allows the movable portion 353 to have a reciprocating movement only within a part at which the forearm of the user exists in the moving range of the movable portion 353, thus preventing a waste of operation (e.g., preventing the movable portion 353 from being unnecessarily away from the forearm of the user).

Although embodiment 11 described a construction in which the massaging apparatus 367 includes the armrest 351, the present invention is not limited to this construction. Another construction also may be used in which the massaging apparatus 376 includes a footrest having the same construction as that of the armrest 351.

Embodiment 12

Figure 41:
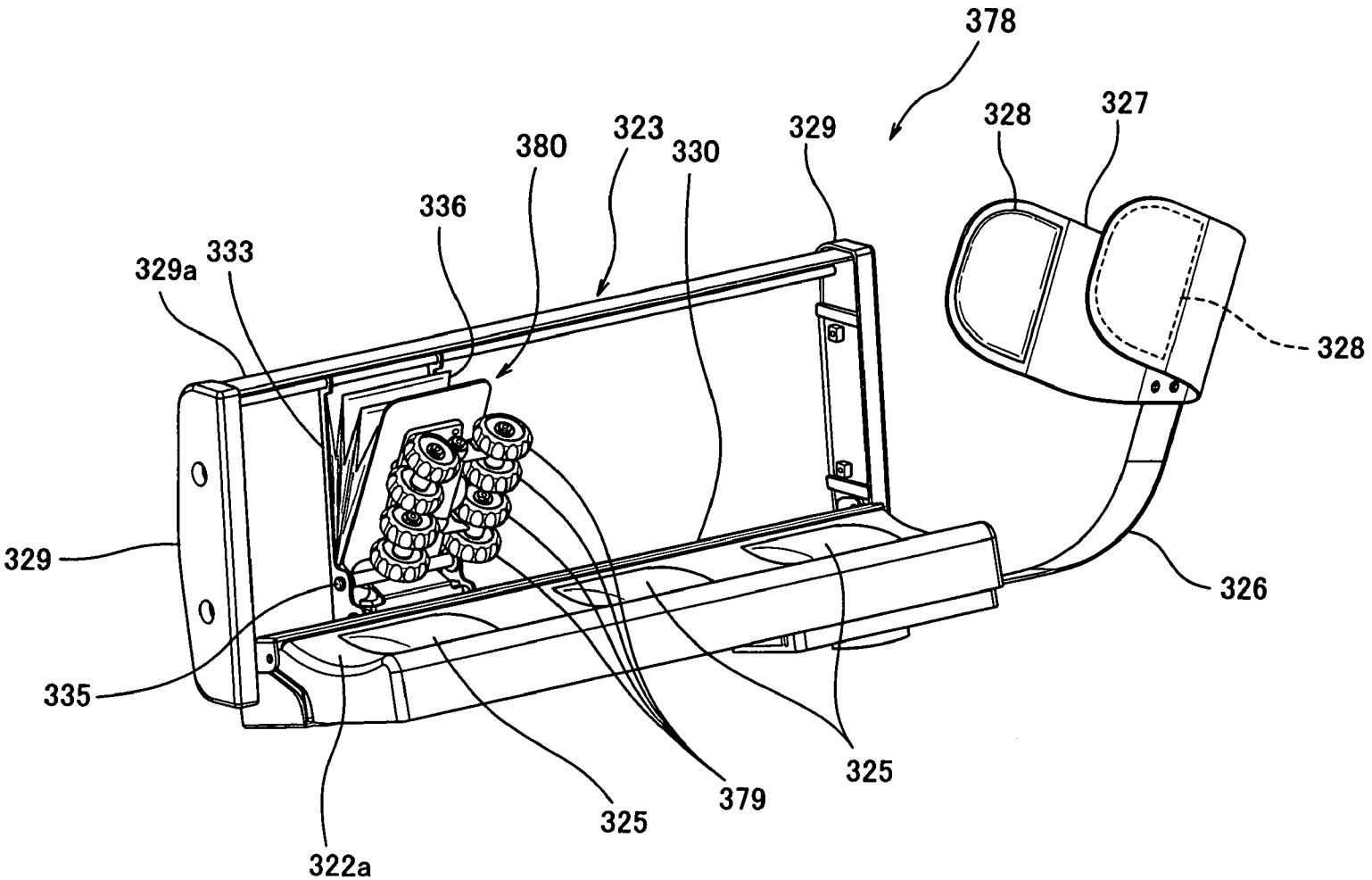
FIG. 41 is a perspective view showing the appearance of an armrest of the massaging apparatus according to embodiment 12 of the present invention.

FIG. 41 is a perspective view showing the appearance of an armrest 378 of the massaging apparatus according to embodiment 12 of the present invention. As shown in FIG. 41, the armrest 378 has, instead of the movable portion 324 of the armrest 305 according to embodiment 9, a movable portion (pressing portion) 380 including an eight wheel-like rollers 379. In embodiment 12, the air bag 325 and the roller 379 constitute the massaging portion according to the present invention. The other components of the massaging apparatus according to embodiment 12 are the same as those of the massaging apparatus 301 according to embodiment 9 and thus are provided with the same reference numerals and will not be described further.

Figure 42:
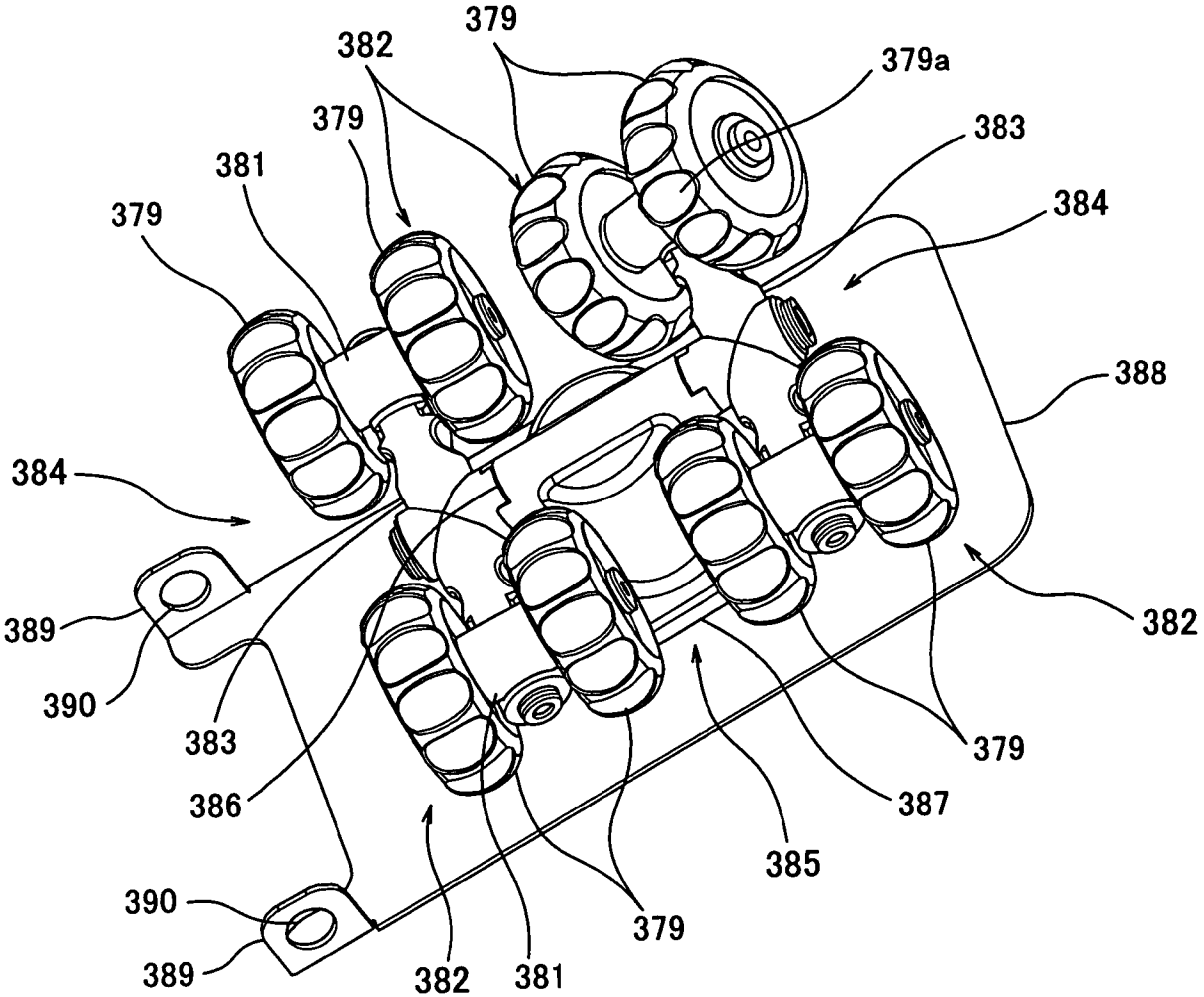
FIG. 42 is a perspective view showing the construction of a movable portion owned by the armrest of the massaging apparatus according to embodiment 12 of the present invention.

The following section will describe the detailed construction of the movable portion 380. FIG. 42 is a perspective view showing the construction of the movable portion 380. As shown in FIG. 42, the pair of rollers 379 is coaxially pivotally mounted to both ends of an axle 381, thus constituting a roller subunit 382. The center parts of the two roller subunits 382 in the longitudinal direction of the axle 381 are pivotally mounted to both ends of axles 383 respectively extending in the direction orthogonal to the respective axles 381, thus constituting a roller unit 384. The respective rollers 379 have at the outer circumference the plurality of concave portions 379*a* provided to have an equal interval thereamong along the entire width of the roller 379 in the rotation direction of the roller 379.

The two roller units 384 have therebetween a support base 385 to be orthogonal to the axles 383. The center parts of the respective axles 383 in the longitudinal direction are pivotally mounted to both ends of the shaft part 386 extending from this support base 385. The support base 385 includes a seat part 387 having a shape in which one end of a columnar part has a collar-like bracket and a shaft part 386 extending in a direction that extends from the other end of the columnar part of the seat part to be orthogonal to the axial direction of the column and that is orthogonal to the direction along which the movable portion 380 is moved (forward and backward). The support base 385 is attached such that a bracket part is attached to the center part of a plate-like base plate 388. The base plate 388 is a flat plate having a substantially rectangular plate face and the ends of the respective longer sides of the rectangular shape include the bearing parts 389 opposed to each other. The bearing part 389 includes the circular hole 390. The base plate 388 is attached to the movable element 333 while this circular hole 390 being penetrated by the above-described pivot 335. This allows, when the air bag 336 has expansion and contraction, the base plate 388 to be rotated to be close to and away from the support face 322*a*. In other words, the driving of the air supply and exhaust device 312 allows the movable portion 380 to be moved to be close to and away from the support face 322*a*.

The movable element 333 and the base plate 388 are provided with a spring (not shown) for biasing the base plate 388 toward the movable element 333. This allows, when air is applied to the air bag 336, the base plate 388 to be away from the movable element 333 against the biasing force by this spring and allows, when air is exhausted from the air bag 336, the base plate 388 to be moved toward the movable element 333 by the biasing force by this spring.

The movable portion 380 having the structure as described above allows the entirety of the roller unit 384 to be rotated around the shaft part 386 of the support base 385. The entirety of the roller subunit 382 also can be rotated around the axle 383. Furthermore, the respective roller 379 can be rotated around the axle 381. This allows, when the arm portion of the user is pushed to the movable portion 380, the movable portion of the movable portion 380 as described above to be operated so that the roller 379 is moved along the arm portion of the user, thus allowing the respective roller 379 to have a contact with the arm portion of the user. The shaft part 386 extends in a direction orthogonal to the direction along which the movable portion 380 is moved. Thus, the axle 381 is also provided to extend in a direction orthogonal to the direction along which the movable portion 380 is moved. This allows, when the movable portion 380 is moved forward and backward, the respective roller 379 to be rolled on the arm portion of the user, thus providing the arm portion of the user with a mechanical stimulation. A projection part between the neighboring concave portions 379*a* is pressed to the arm portion of the user, thus providing a strong stimulation to the arm portion of the user to further improve the massaging effect.

Although embodiment 12 described the massaging apparatus having the armrest 378, the present invention is not limited to this. The massaging apparatus also may have a footrest having the same construction as that of the armrest 378.

Although embodiments 9 to 12 as described above described constructions in which the armrests 305, 351, and 378 are all fixed to the backrest 203, the present invention is not limited to this. For example, other constructions also may be used in which the armrests 305, 351, and 378 can be slid forward and backward to the backrest 203 or can be inclined in the up-and-down direction. In such a case, a lock mechanism for fixing the front-and-rear position or the inclining angle of the armrests 305, 351, and 378 may be provided so that the armrest can be immovable to the backrest 203. This allows the position of the armrests 305, 351, and 378 to be adjusted so that the user can take a more comfortable posture and the forearm of the user in this posture can be supported reliably.

Embodiment 13

Figure 43:
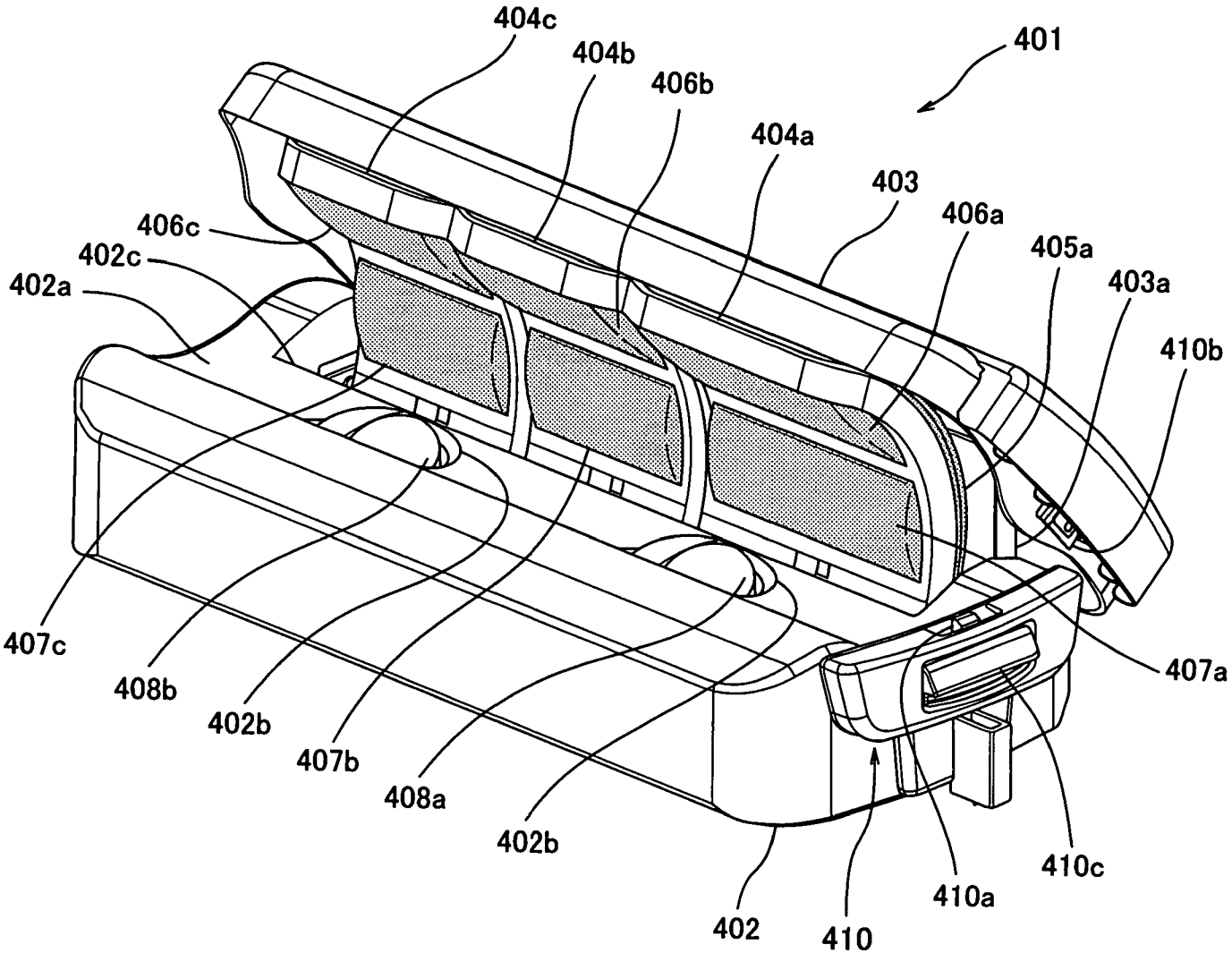
FIG. 43 is a perspective view showing the appearance of an armrest of the massaging apparatus according to embodiment 13 of the present invention.
Figure 44:
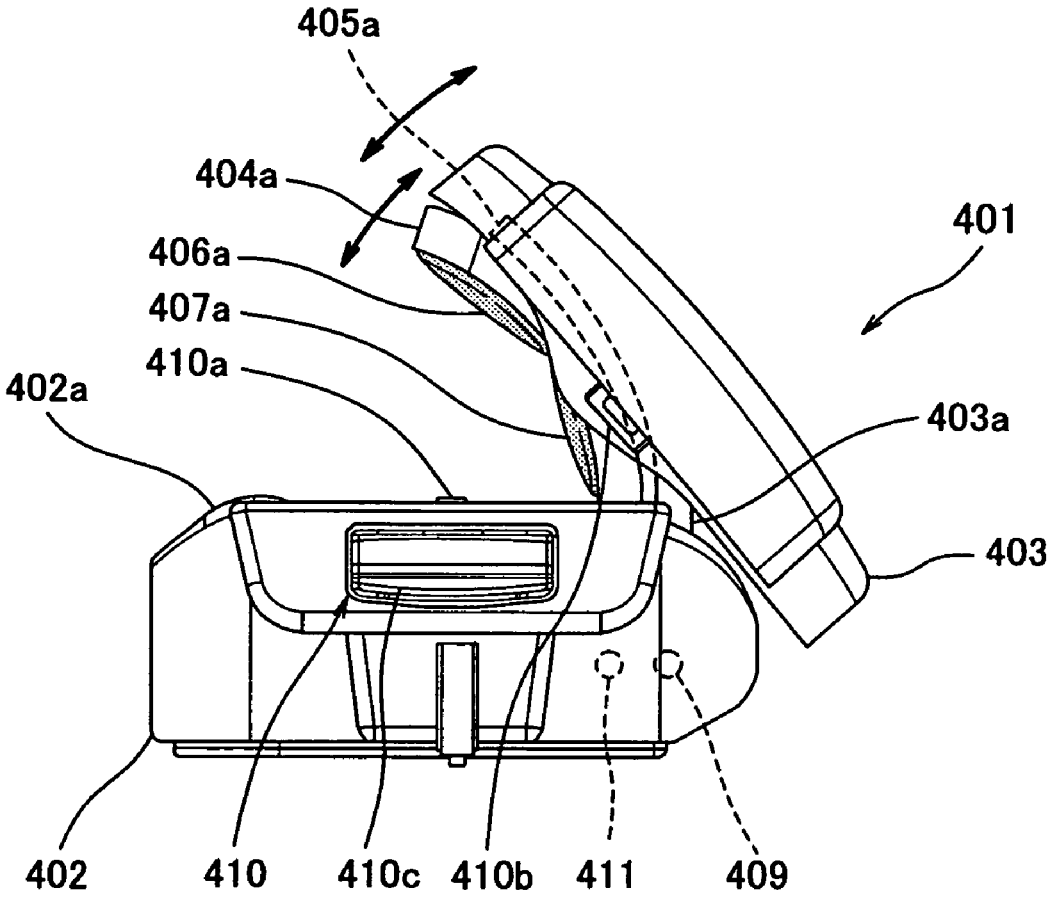
FIG. 44 is a front view showing the construction of the armrest of the massaging apparatus according to embodiment 13 of the present invention.

A massaging apparatus 400 according to embodiment 13 has a construction in which the massaging apparatus 301 according to embodiment 9 includes, instead of the armrest 305, an armrest 401 as described below. FIG. 43 is a perspective view showing the appearance of the armrest 401 of the massaging apparatus 400 according to embodiment 13 of the present invention. FIG. 44 is a front view showing the construction of the massaging apparatus 401. As shown in FIG. 43, the armrest 401 mainly includes a support base 402, a cover portion 403, pressing portions 404*a* to 404*c*, air bags 405*a* to 405*c*, air bags 406*a* to 406*c*, air bags 407*a* to 407*c*, and vibrators 408*a* and 408*b*. The support base 402 has a substantially quadrangular plate-like shape that includes therein a space and that extends forward and backward. The support base 402 has at the upper face a support face 402*a* that has a substantially circular arc groove-like concavity. Such a shape allows, when the support base 402 is used as an armrest, the support face 402*a* to conform in shape to the forearm of the user, thus supporting the forearm in a stable manner. The support base 402 as described above is fixed to the backrest 203 so that the support base 402 is maintained to be immovable to the backrest 203.

The support face 402*a* includes two holes 402*b* arranged forward and backward. These holes 402*b* include therein the respective vibrators 408*a* and 408*b* so that the upper parts thereof protrude from the support face 402*a*. The operation of the respective vibrators 408*a* and 408*b* can provide vibrating stimulation to the lower part of the forearm of the user provided on the support face 402*a*.

The support base 402 as described above has, at the outer end (i.e., right end for the support base 402 for the right hand armrest 401 or left end for the support base 402 for the left hand armrest 401), the back portion 402*c* that has an opening in the upward direction and that extends forward and backward.

The cover portion 403 is provided above the support base 402. The cover portion 403 has a box-like shape the entire lower part of which has an opening. A support arm 403*a* is provided to protrude from the opening. A support arm 403*a* has a substantially plate-like shape that extends forward and backward and that is protruded to have an inclining angle of about 45 degrees to the upper face of the cover portion 403. As shown in FIG. 44, this support arm 403*a* is inserted to the back portion 402*c* and the end portion at the insertion side is pivotally mounted by a rotation axis 409 to the support base 402. The rotation axis 409 is provided at the inner side of the back portion 402*c* and in the vicinity of the outer end of support base 402. This allows the cover portion 403 to be rotated around the rotation axis 409 in a direction along which the cover portion 403 is moved to be close to and away from the support face 402*a*.

The cover portion 403 can be rotated until the limitation is reached so that the entirety of the support face 402*a* is covered by the cover portion 403 from the upper part (hereinafter this position of the cover portion 403 will be referred to as close position). The cover portion 403 in the close position is fixed to the support base 402 by a lock mechanism 410. The lock mechanism 410 as described above has an engagement nail 410*a* provided at the front end of the support base 402 and an engagement concave portion 410*b* provided at the front end of the cover portion 40. When the engagement nail 410*a* is engaged with the engagement concave portion 410*b*, the cover portion 403 is locked at the close position. The engagement nail 410*a* is biased by a spring (not shown) in the direction in which the engagement is not cancelled. This prevents, when the engagement nail 410*a* is engaged with the engagement concave portion 410*b*, this engagement from being cancelled easily.

The cover portion 403 has an upper face that is slightly rounded and that is substantially horizontal. This allows, when the user sitting on the massaging apparatus 400 does not receive a massage by the armrest 401, the cover portion 403 to be positioned at the close position to use the upper face as an armrest.

The lock mechanism 410 has a lock cancellation button 410*c* provided at the support base 402. This button 410*c* is associated with the above-described engagement nail 410*a* so that, when the button 410*c* is depressed, the engagement nail 410*a* is moved in a direction along which the engagement with engagement concave portion 410*b* is cancelled. This allows, when the engagement nail 410*a* is engaged with the engagement concave portion 410*b* and the button 410*c* is depressed, the engagement between the engagement nail 410*a* and the engagement concave portion 410*b* to be cancelled to rotate the cover portion 403 in the upward direction.

Then, the cover portion 403 can be rotated from the close position to the position shown in FIG. 44 in which the cover portion 403 is inclined to the support face 402*a* with about 45 degrees (hereinafter this position of the cover portion 403 will be referred to as open position). As shown in FIG. 44, when the cover portion 403 is in the open position, the support arm 403*a* extends in a substantially vertical direction. The cover portion 403 as described above can be retained at the open position by a lock mechanism (not shown).

As shown in FIG. 43, three pressing portions 404*a* to 404*c* are arranged inside the cover portion 403 in this order in the direction from forward to rearward. The respective pressing portions 404*a* to 404*c* are a plate curved to have a substantially circular arc-like shape and the respective concave face is opposed to the support face 402*a*. The base end sides of the respective pressing portions 404*a* to 404*c* are inserted to the back portion 402*c* so that the respective base end is pivotally supported by a rotation axis 411 extending forward and backward that is provided at the inner side of the above-described rotation axis 409 in the left-and-right direction of the support base 402 (i.e., left side of the rotation axis 409 for the support base 402 of the right hand armrest 401 or right side of the rotation axis 409 for the support base 402 of the left hand armrest 401). This allows the respective pressing portions 404*a* to 404*c* to rotate around the rotation axis 411 in the direction along which the pressing portions 404*a* to 404*c* are moved to be close to and away from the support face 402*a*.

The pressing portion 404*a* has a longer length forward and backward than those of the pressing portions 404*b* and 404*c*. As shown in FIG. 44, the respective pressing portions 404*a* to 404*c* and the cover portion 403 have therebetween the air bags 405*a* to 405*c* (only the air bag 405*a* is shown in FIG. 44). These air bags 405*a* to 405*c* have the same construction as that of the air bag 336 of embodiment 9. Specifically, in the respective bag, one accordion-like end that can be developed is faced to the tip end side of the pressing portions 404*a* to 404*c* and the other end that cannot be developed is faced to the base end side of the pressing portions 404*a* to 404*c* so that the development direction is substantially the same as the rotation direction of the pressing portions 404*a* to 404*c* while the air bags 405*a* to 405*c* being attached to the pressing portions 404*a* to 404*c* and the cover portion 403. This allows, when the cover portion 403 is in the open position, the respective air bags 405*a* to 405*c* to have expansion and contraction to allow the pressing portions 404*a* to 404*c* to be rotated such that the pressing portions 404*a* to 404*c* are moved to be close to and away from the respective support face 402*a*.

The pressing portions 404*a* to 404*c* are provided to be opposed to the substantially full face of the support face 402*a*. Thus, the pressing portions 404*a* to 404*c* and the support face 402*a* can sandwich, by moving the pressing portions 404*a* to 404*c* toward the support face 402*a* while the forearm of the user being placed on the support face 402*a*, the forearm of the user for the entire length thereof. This allows the support face 402*a* to be used as an armrest and the forearm of the user to be sandwiched reliably.

As shown in FIG. 43, the air bags 406*a* and 407*a* are attached to the opposed face of the pressing portion 404*a* to the support face 402*a*. The air bag 406*a* is provided at the tip end side of the pressing portion 404*a* while the air bag 407*a* is provided at the base end side of the pressing portion 404*a* so that the respective air bags 406*a* and 407*a* are attached to a pressing portion 404*a* so as not to be superposed to each other. The air bags 406*a* and 407*a* are attached to the opposed face of the pressing portion 404*b* to the support face 402*a* in the same manner. The air bags 406*c* and 407*a* are attached to the opposed face of the pressing portion 404*c* to the support face 402*a* in the same manner. In this way, embodiment 13 uses the air bags 406*a* to 406*c* and 407*a* to 407*c* and the vibrators 408*a* and 408*b* to constitute the massaging portion according to the present invention and uses the air bags 405*a* to 405*c* to constitute the driving portion according to the present invention.

Figure 45:
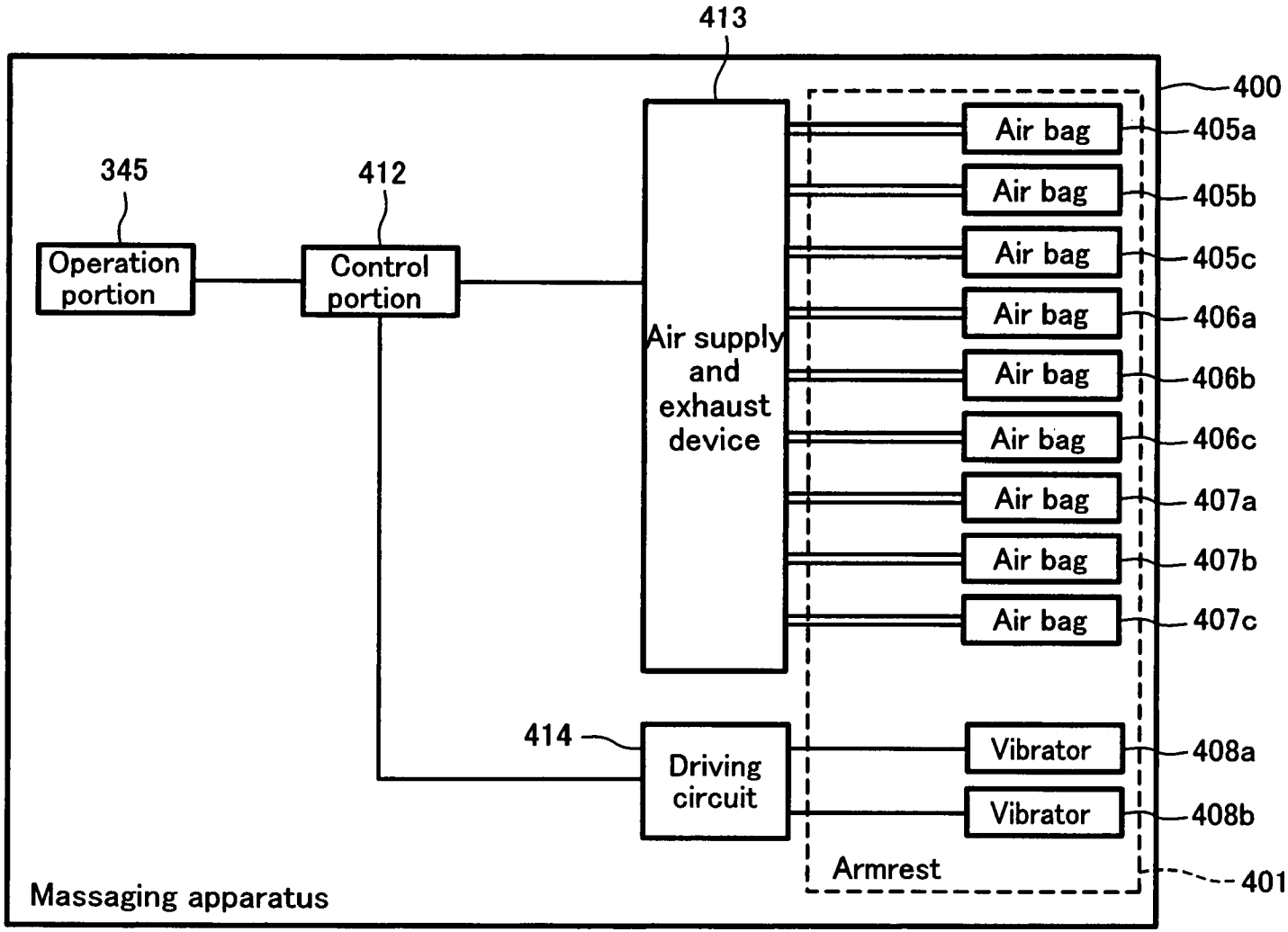
FIG. 45 is a block diagram showing a part of the construction of the massaging apparatus according to embodiment 13 of the present invention.

FIG. 45 is a block diagram showing a part of the construction of the massaging apparatus 400 according to embodiment 13 of the present invention. As shown in FIG. 45, the massaging apparatus 400 includes therein a control portion 412. This control portion 412 is provided by a CPU, ROM, RAM, and a timer or the like and is provided to perform a control program as described later to control the operation of various devices connected thereto.

The control portion 412 is connected with an air supply and exhaust device 413 and is configured to control the operation of the air supply and exhaust device 413. This air supply and exhaust device 413 is provided by a switching valve (e.g., electromagnetic valve) and an air pump or the like and is communicated via air hoses to the above-described air bags 405*a* to 405*c*, 406*a* to 406*c*, and 407*a* to 407*c*. The air supply and exhaust device 413 also can supply air to or exhaust air from the air bags 405*a* to 405*c*, 406*a* to 406*c*, and 407*a* to 407*c* in an individual manner.

The control portion 412 is also connected with the vibrators 408*a* and 408*b* via a driving circuit 414, respectively so that the control portion 412 can control the operation of the vibrators 408*a* and 408*b*, respectively.

The control portion 412 is also connected to the operation portion 345 for accepting an operation instruction from the user (e.g., remote controller).

Although FIG. 45 only shows one armrest 401 for simplicity, one massaging apparatus 400 in actual cases includes two armrests 401.

The other components of the massaging apparatus 400 according to embodiment 13 are the same as those of the massaging apparatus 301 according to embodiment 9 and thus are provided with the same reference numerals and will not be described further.

Figure 46:
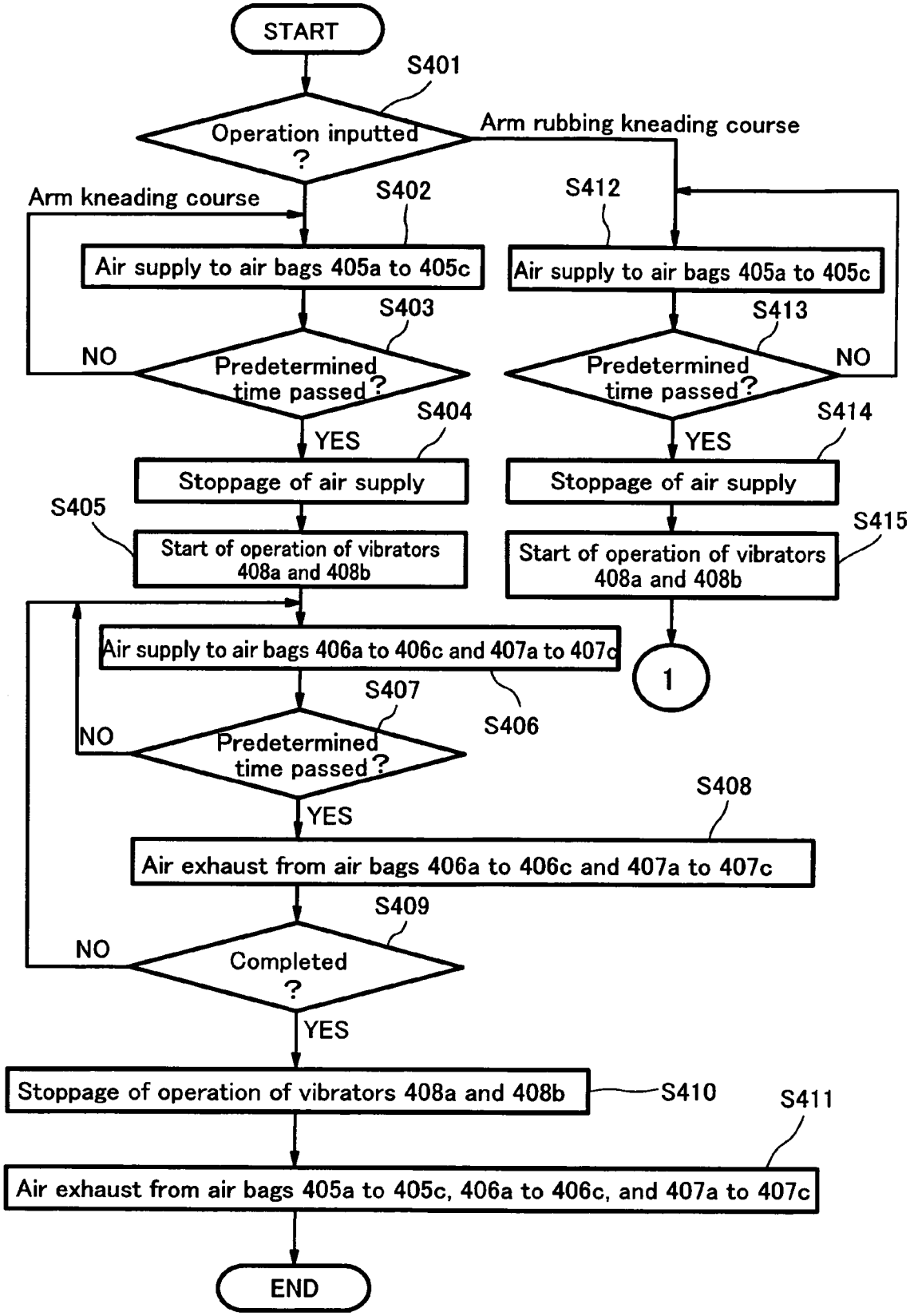
FIG. 46 is a flowchart showing an example of the flow of the operation of the armrest of the massaging apparatus according to embodiment 13 of the present invention.
Figure 47:
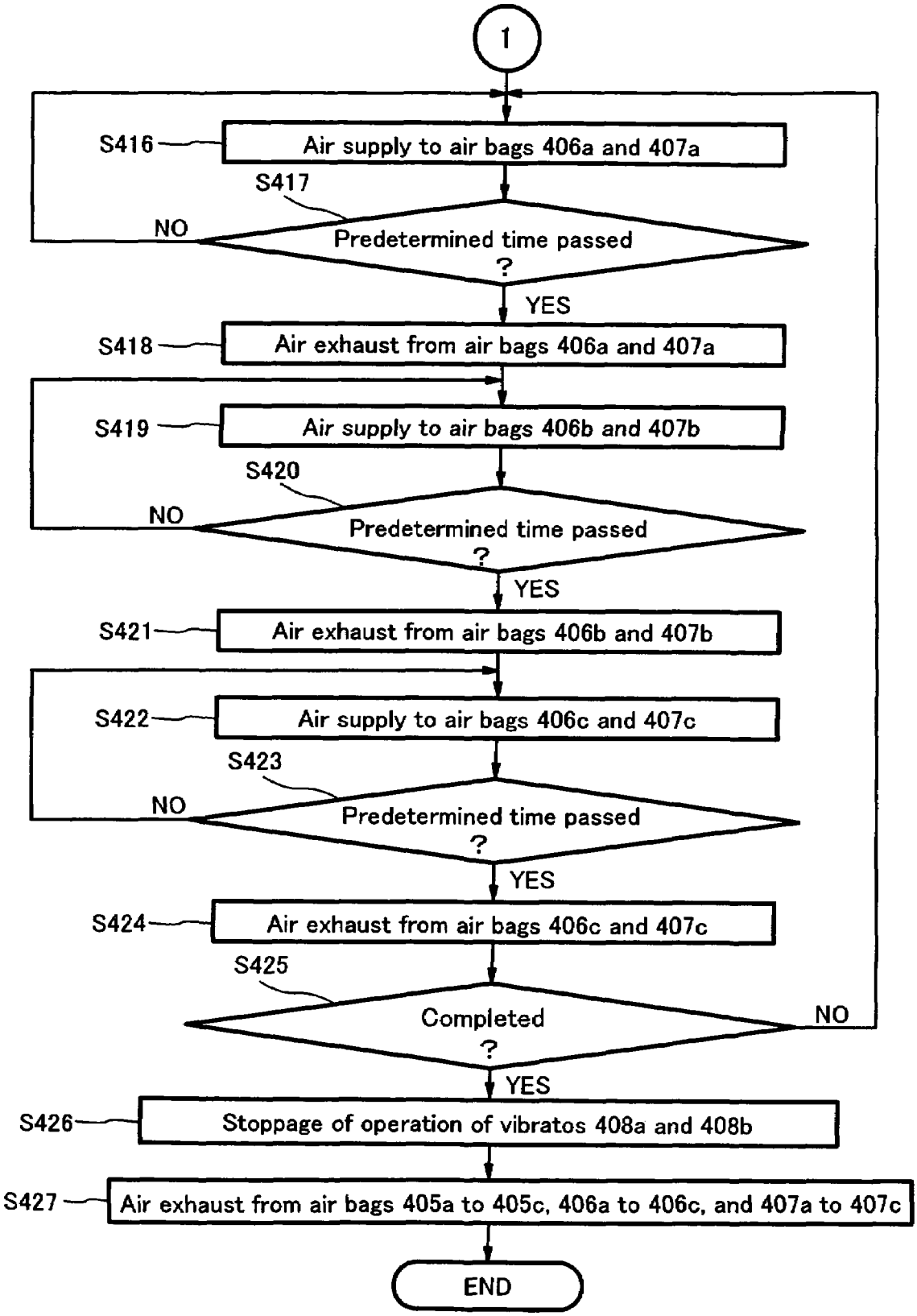
FIG. 47 is a flowchart showing an example of the flow of the operation of the armrest of the massaging apparatus according to embodiment 13 of the present invention when the armrest is operated.

Next, the massaging apparatus 400 according to embodiment 13 of the present invention will be described with regards to the operation. FIG. 46 and FIG. 47 are a flowchart showing an example of the flow of the operation of the armrest 401 of the massaging apparatus 400 according to embodiment 13 of the present invention. When the user sitting on the massaging apparatus 400 desires to receive a massage for the arm portion, the user depresses the buttons 410*c* of the lock mechanism 410 of the left and right armrests 401 to cancel the engagement of the cover portion 403*s*, thereby allowing the respective cover portions 403 to be rotated to the open position.

Figure 48:
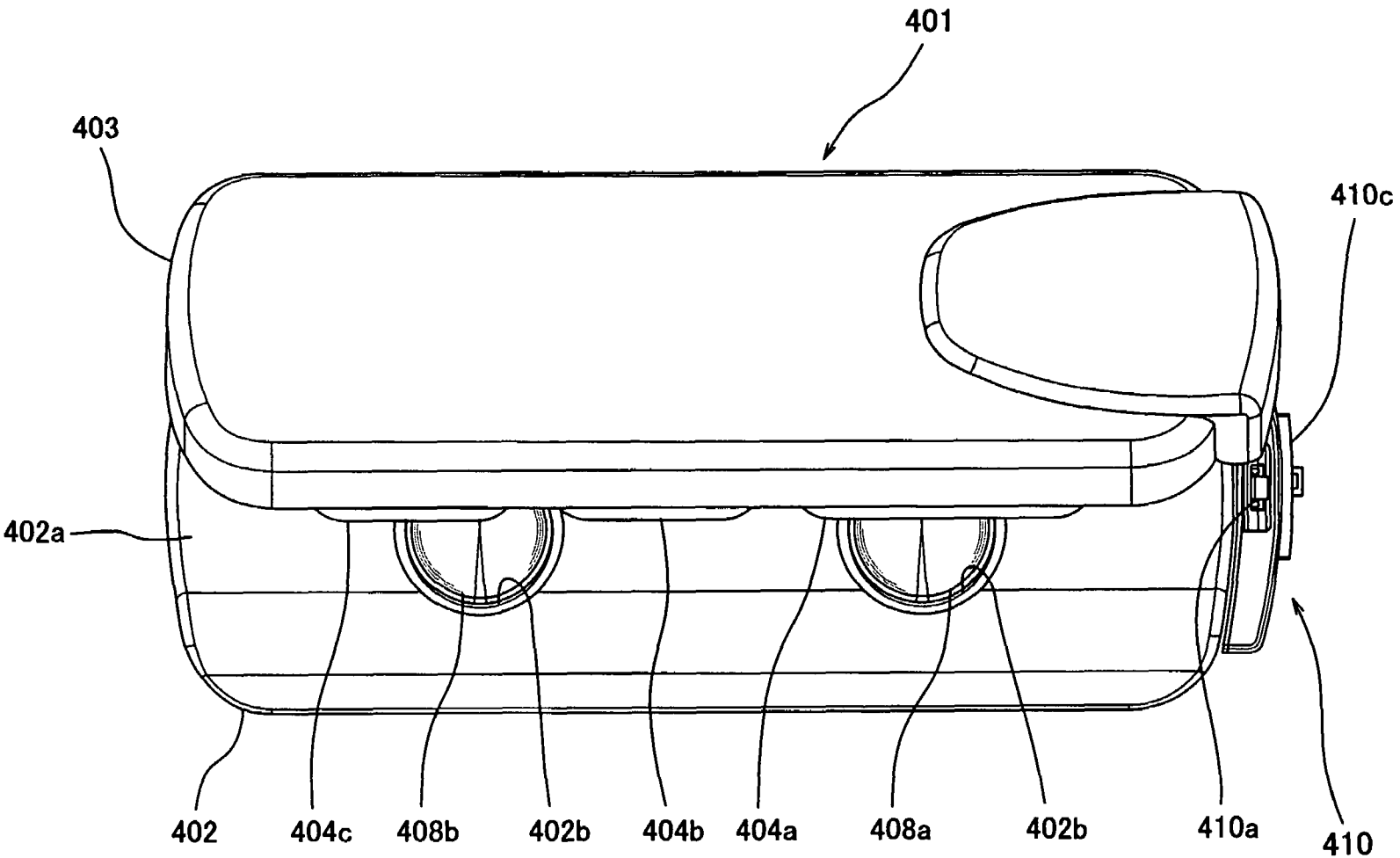
FIG. 48 is a top view illustrating the armrest of the massaging apparatus according to embodiment 13 of the present invention before the operation.
Figure 49:
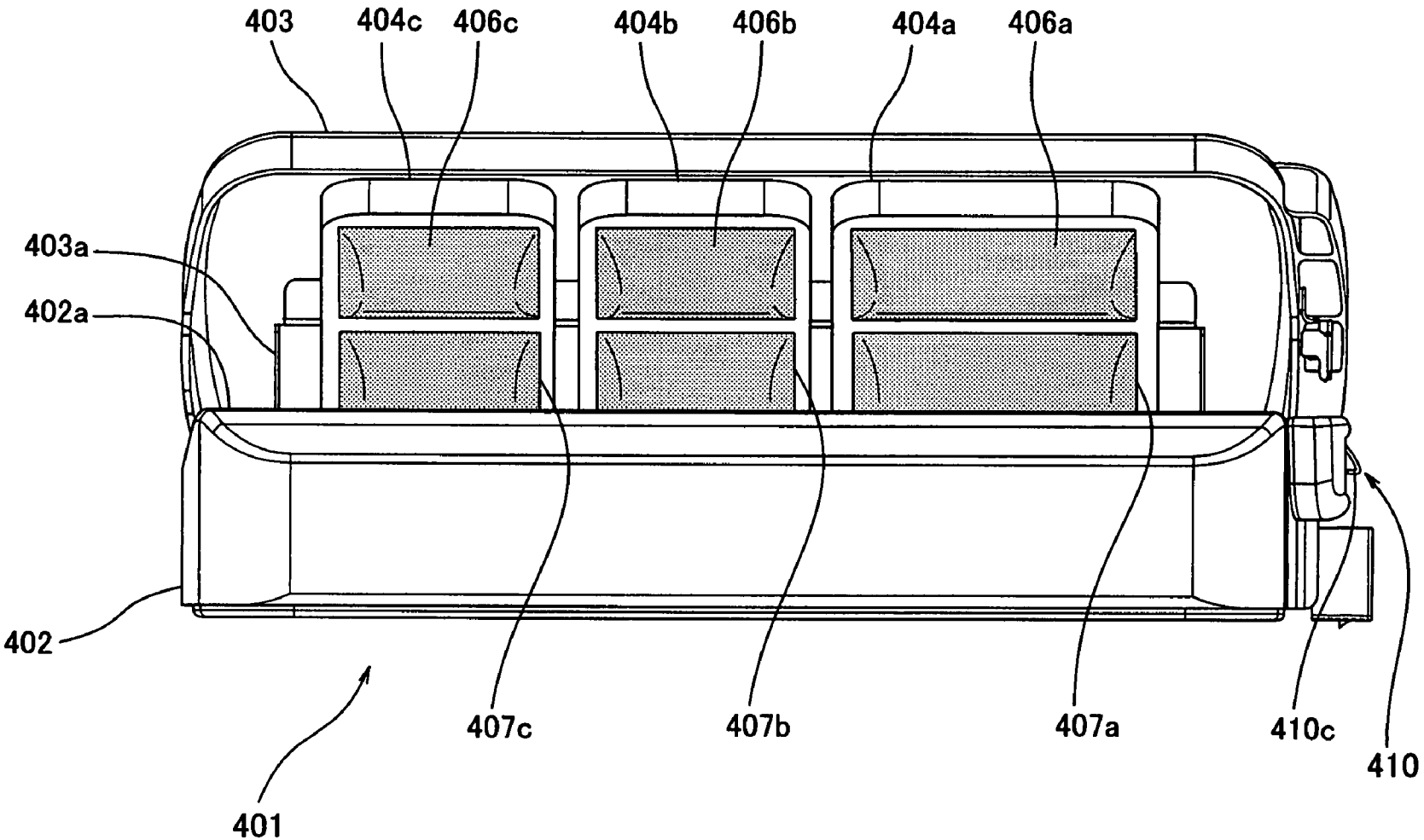
FIG. 49 is a side view illustrating the armrest of the massaging apparatus according to embodiment 13 of the present invention before the operation.

FIG. 48 is a top view illustrating the armrest 401 according to embodiment 13 of the present invention before the operation. FIG. 49 is a side view thereof. As shown in FIG. 48 and FIG. 49, in the armrest 401 before receiving an operation instruction from the user, the air bags 405*a* to 405*c*, 406*a* to 406*c*, and 407*a* to 407*c* are not expanded, thus allowing the pressing portions 404*a* to 404*c* at the position closest to the cover portion 403. As a result, the armrest 401 is provided such that the pressing portions 404*a* to 404*c* has an increased distance to the support face 402*a*, thus allowing the user to put the forearm into this space in an easy manner.

The user uses the operation portion 345 after putting the forearm into the space (or immediately before putting the forearm into the space) to input an operation instruction (Step S401). Embodiment 13 assumes that an arm kneading course and an arm rubbing kneading course are previously set in the massaging apparatus 400 as an arm massaging program. The arm kneading course and the arm rubbing kneading course are respectively associated with different operation keys of the operation portion 345. The user can depress the respective operation keys to instruct the massaging apparatus 400 to start the respective massaging programs.

When Step S401 receives an input of an operation for instructing the start of the arm kneading course ("arm kneading course" in Step S401), then a signal representing this is transmitted to the control portion 412. Then, the control portion 412 performs the processing as shown below.

Figure 50:
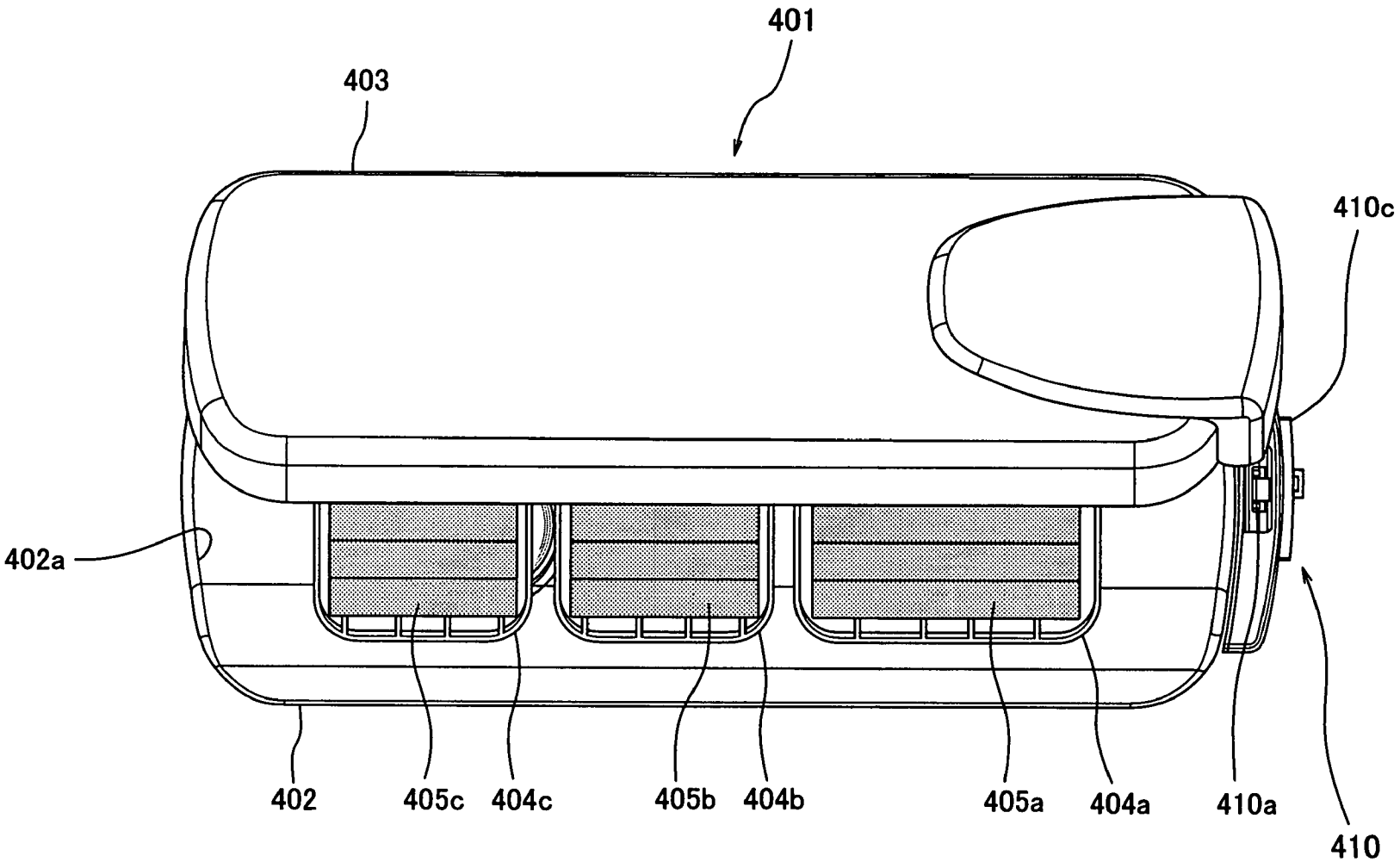
FIG. 50 is a top view of the armrest of the massaging apparatus according to embodiment 13 of the present invention showing when an arm kneading course is being performed.
Figure 51:
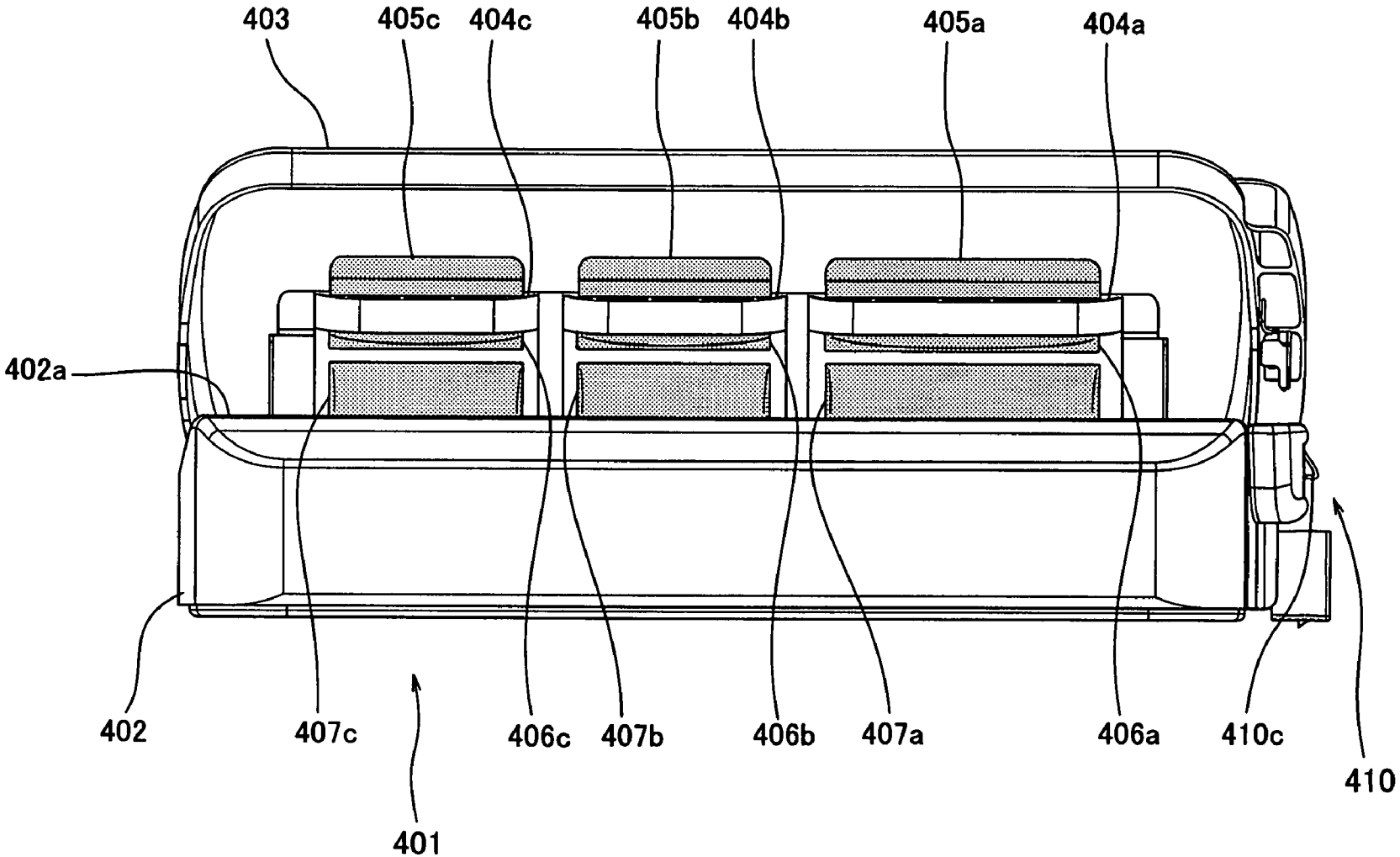
FIG. 51 is a side view of the armrest of the massaging apparatus according to embodiment 13 of the present invention showing when the arm kneading course is being performed.

FIG. 50 is a top view of the armrest 401 according to embodiment 13 of the present invention showing when the arm kneading course is being performed. FIG. 51 is a side view thereof. First, the control portion 412 transmits to the air supply and exhaust device 413 a control signal for causing the air supply and exhaust device 413 to supply air to the air bags 405*a* to 405*c* (Step S402). In accordance with this control signal, the air supply and exhaust device 413 supplies air to the air bags 405*a* to 405*c*, thus causing the air bags 405*a* to 405*c* to have expansion. Then, as shown in FIG. 50 and FIG. 51, the pressing portions 404*a* to 404*c* are rotated around the rotation axis 411 to be close to the support face 402*a*.

The control portion 412 determines whether or not a predetermined time has passed since the start of the air supply to the air bags 405*a* to 405*c* (Step S403). When the predetermined time has not passed (NO in Step S403), then the processing returns to Step S402. When the predetermined time has passed since the start of the air supply in Step S403 (YES in Step S403), then the control portion 412 controls the air supply and exhaust device 413 to stop the air supply to the air bags 405*a* to 405*c* (Step S404). As a result, the rotation of the pressing portions 404*a* to 404*c* is stopped.

Next, the control portion 412 transmits to the driving circuit 414 a control signal for operating the vibrators 408*a* and 408*b* with a predetermined vibration pattern (Step S405). The control portion 412 also transmits to the air supply and exhaust device 413 a control signal for causing the air supply and exhaust device 413 to supply air to the air bags 406*a* to 406*c* and 407*a* to 407*c* (Step S406). In accordance with this control signal, the air supply and exhaust device 413 supplies air to the air bags 406*a* to 406*c* and 407*a* to 407*c* to cause the air bags 406*a* to 406*c* and 407*a* to 407*c* to have expansion to press the forearm of the user. The vibration of the vibrators 408*a* and 408*b* is also started.

The operation of the armrest 401 in this manner allows the forearm of the user to be massaged while being sandwiched between the support face 402*a* and the pressing portions 404*a* to 404*c*. This can prevent the forearm of the user from escaping in the direction along which the pressure is applied by the air bags 406*a* to 406*c* and 407*a* to 407*c* to the forearm of the user and thus pressure stimulation by the air bags 406*a* to 406*c* and 407*a* to 407*c* can be reliably given to the forearm of the user. The pressing portions 404*a* to 404*c* also push the forearm of the user in the downward direction, thereby providing the vibrating stimulation by the vibrators 408*a* and 408*b* to the forearm of the user in a further effective manner.

The control portion 412 determines whether or not a predetermined time has passed since the start of the air supply to the air bags 406*a* to 406*c* and 407*a* to 407*c* (Step S407). When the predetermined time has not passed (NO in Step S407), then the processing returns to Step S406. When the predetermined time has passed since the start of the air supply in Step S407 (YES in Step S407), then the control portion 412 controls the air supply and exhaust device 413 to exhaust air from the air bags 406*a* to 406*c* and 407*a* to 407*c* (Step S408). This allows the air bags 406*a* to 406*c* and 407*a* to 407*c* to have contraction, thus reducing the pressure stimulation to the forearm of the user.

In the middle of the operation as described above, the user can input an instruction for instructing the operation portion 345 to complete the operation. When such an operation instruction is inputted, a signal representing this is transmitted to the control portion 412. After performing the processing in Step S408, the control portion 412 determines whether or not the user instructs to complete the operation (Step S409). When the user instructs to complete the operation (YES in Step S409), then the control portion 412 controls the driving circuit 414 to stop the vibration of the vibrators 408*a* and 408*b* (Step 410). The control portion 412 also controls the air supply and exhaust device 413 to exhaust air from the air bags 405*a* to 405*c*, 406*a* to 406*c* and 407*a* to 407*c* (Step S411), thereby completing the processing. When the user does not instruct to complete the operation in Step S409 (NO in Step S409), the processing returns to Step S406.

On the other hand, when Step S401 receives an input of an operation instruction for instructing the start of the arm rubbing kneading course ("arm rubbing kneading course" in Step S401), then a signal representing this is transmitted to the control portion 412 and the control portion 412 performs the processing as shown below.

First, the control portion 412 transmits to the air supply and exhaust device 413 a control signal for causing the air supply and exhaust device 413 to supply air to the air bags 405*a* to 405*c* (Step S412). In accordance with this control signal, the air supply and exhaust device 413 supplies air to the air bags 405*a* to 405*c*, thus causing the air bags 405*a* to 405*c* to have expansion. Then, as shown in FIG. 50 and FIG. 51, the pressing portions 404*a* to 404*c* are rotated around the rotation axis 411 to be close to the support face 402*a*.

The control portion 412 determines whether or not a predetermined time has passed since the start of the air supply to the air bags 405*a* to 405*c* (Step S413). When the predetermined time has not passed (NO in Step S413), then the processing returns to Step S412. When the predetermined time has passed since the start of the air supply in Step S413 (YES in Step S413), then the control portion 412 controls the air supply and exhaust device 413 to stop the air supply to the air bags 405*a* to 405*c* (Step S414). As a result, the rotation of the pressing portions 404*a* to 404*c* is stopped.

Next, the control portion 412 transmits to the driving circuit 414 a control signal for operating the vibrators 408*a* and 408*b* with a predetermined vibration pattern (Step S415). The control portion 412 also transmits to the air supply and exhaust device 413 a control signal for causing the air supply and exhaust device 413 to supply air to the air bags 406*a* and 407*a* (Step S416). In accordance with this control signal, the air supply and exhaust device 413 supplies air to the air bags 406*a* and 407*a* to cause the air bags 406*a* and 407*a* to have expansion to press the forearm of the user.

The control portion 412 determines whether or not a predetermined time has passed since the start of the air supply to the air bags 406*a* and 407*a* (Step S417). When the predetermined time has not passed (NO in Step S417), then the processing returns to Step S416. When the predetermined time has passed since the start of the air supply in Step S417 (YES in Step S417), then the control portion 412 controls the air supply and exhaust device 413 to exhaust air from the air bags 406*a* and 407*a* (Step S418).

The control portion 412 also transmits, substantially simultaneously with the processing in Step S418, to the air supply and exhaust device 413 a control signal for causing the air supply and exhaust device 413 to supply air to the air bags 406*a* and 407*a* (Step S419). In accordance with these control signals, the air supply and exhaust device 413 supplies air to and exhaust air from the air bags 406*a* and 407*a*, thus causing the contraction of the air bags 406*a* and 407*a* simultaneously with the expansion of the air bags 406*b* and 407*b* and reducing the pressure stimulation to the front side of the forearm of the user and pressing the center part of the forearm of the user. As a result, a position at which the pressure stimulation is applied is moved from the front side of the forearm of the user to the center part.

The control portion 412 determines whether or not a predetermined time has passed since the start of the air supply to the air bags 406*b* and 407*b* (Step S420). When the predetermined time has not passed (NO in Step S420), then the processing returns to Step S419. When the predetermined time has passed since the start of the air supply (YES in Step S420), then the control portion 412 controls the air supply and exhaust device 413 to exhaust air from the air bags 406*b* and 407*b* (Step S421).

The control portion 412 also transmits, substantially simultaneously with the processing in Step S421, to the air supply and exhaust device 413 a control signal for causing the air supply and exhaust device 413 to supply air to the air bags 406*b* and 407*b* (Step S422). In accordance with these control signals, the air supply and exhaust device 413 exhausts air from the air bags 406*b* and 407*b* and supplies air to the air bags 406*c* and 407*c*, thus causing the air bags 406*b* and 407*b* to have contraction and causing the air bags 406*c* and 407*c* to have expansion, thereby reducing the pressure stimulation to the center part of the forearm of the user and pressing the rear part of the forearm of the user. As a result, a position at which the pressure stimulation is applied is moved from the center part of the forearm of the user to the rear part.

The control portion 412 determines whether or not a predetermined time has passed since the start of the air supply to the air bags 406*c* and 407*c* (Step S423). When the predetermined time has not passed (NO in Step S423), then the processing returns to Step S422. When the predetermined time has passed since the start of the air supply in Step S423 (YES in Step S423), then the control portion 412 controls the air supply and exhaust device 413 to exhaust air from the air bags 406*c* and 407*c* (Step S424). This allows the air bags 406*c* and

407*c* to have contraction to reduce the pressing stimulation to the rear part of the forearm of the user.

Specifically, the processings in Steps S416 to S424 provide a massage corresponding to a so-called rubbing kneading in which the forearm of the user is rubbed from the front side to the rear side. The arm rubbing kneading course also uses the support face 402*a* and the pressing portions 404*a* to 404*c* to sandwich the forearm of the user while the forearm is being massaged. This can prevent the forearm of the user from escaping in the direction along which the pressure is applied by the air bags 406*a* to 406*c* and 407*a* to 407*c* to the forearm of the user and can reliably give the pressure stimulation by the air bags 406*a* to 406*c* and 407*a* to 407*c* to the forearm of the user. The pressing portions 404*a* to 404*c* also push the forearm of the user in the downward direction, thereby providing the vibrating stimulation by the vibrators 408*a* and 408*b* to the forearm of the user in a further effective manner.

In the middle of the operation as described above, the user can input an operation for instructing the operation portion 345 to complete the operation. After performing the processing in Step S424, the control portion 412 determines whether or not the user instructs to complete the operation (Step S425). When the user instructs to complete the operation (YES in Step S425), then the control portion 412 controls the driving circuit 414 to stop the vibration of the vibrators 408*a* and 408*b* (Step 426). The control portion 412 also controls the air supply and exhaust device 413 to exhaust air from the air bags 405*a* to 405*c*, 406*a* to 406*c*, and 407*a* to 407*c* (Step S427), thereby completing the processing. When the user does not instruct to complete the operation (NO in Step S425), the processing returns to Step S416.

The operation of the armrest 401 as described above is an example thereof. Another operation is also possible in which a stimulation corresponding to so-called pull kneading is provided to the arm portion of the user, for example. In the pull kneading by a massage practitioner, the arm portion of the user is grabbed by the massage practitioner in a sandwiched manner and the massaged position is moved toward the outer side of the arm while the arm is being grabbed. In the pull kneading by the armrest 401 on the other hand, the air supply and exhaust device 413 is controlled to expand the air bags 405*a* to 405*c*, 406*a* to 406*c*, and 407*a* to 407*c* to subsequently contract only the air bags 405*a* to 405*c*, thus allowing the air bags 406*a* to 406*c* and 407*a* to 407*c* to sandwich the forearm of the user while separating the pressing portions 404*a* to 404*c* from the support face 402*a*.

Another operation is also possible in which, for example, only the air bags 405*a*, 406*a*, and 407*a*, only the air bags 405*b*, 406*b*, and 407*b*, or the air bags 405*c*, 406*c*, and 407*c* are caused to have expansion or contraction so that only the front side, only the center part, or only the rear part of the forearm of the user can be massaged in an intensive manner.

When the arm portion is not massaged, the cover portions 403 of the left and right armrests 401 can be caused to be in the close position, thus allowing both forearms to be placed on the upper faces of the respective left and right armrests 401 while allowing the user to sit on the massaging apparatus 400 with a comfortable posture. When the cover portions 403 are closed, the pressing portions 404*a* to 404*c* can be hidden, thus providing a favorable appearance.

In addition to the construction including a footrest having the same construction as the footrest 304 according to embodiment 9, other constructions also may be used in which a footrest having an arbitrary construction is provided or no footrest is provided.

Although the footrest and the armrest 401 had different constructions, the massaging apparatus 400 also may include a footrest having the same construction as that of the armrest 401.

Although embodiment 13 described the construction in which the armrest 401 is fixed to the backrest 203, the present invention is not limited to this. For example, another construction also may be used in which the armrest 401 can be slid forward and backward or can be inclined in the up-and-down direction to the backrest 203. In this case, a lock mechanism for retaining the position forward and backward or the inclining angle of the armrest 401 is provided so that the armrest 401 can be maintained to be immovable to the backrest 203. This can adjust the position of the armrest 401 to allow the user to take a further comfortable posture and can reliably support the forearm of the user in the posture.

From the above description, many modifications or other embodiments are apparent to those skilled in the art. Thus, the above description should be interpreted as a mere illustration and is provided for the purpose of teaching those skilled in the art the best mode for carrying out the present invention. The details of the structure and/or function can be substantially changed without departing from the spirit of the present invention.

INDUSTRIAL APPLICABILITY

The massaging apparatus according to the present invention is useful as a chair-type or bed-type massaging apparatus, for example.

The invention claimed is:

1. A massaging apparatus having a chair-like construction configured to be capable of sandwiching and releasing an arm portion of a user and to be capable of giving pressure stimulation to the sandwiched arm portion of the user, the apparatus comprising:

an armrest having a support portion at an upper portion thereof that is configured to support a forearm of the user; and a forearm massager that is removably mounted to the armrest and that has a connecting portion connected with the armrest in a position below the support portion and a forearm massaging portion that is configured to give pressure stimulation to the forearm of the user with the forearm sandwiched, wherein the forearm massager is laterally mounted to the armrest from a side, and the forearm massaging portion is located above the support portion of the armrest with the forearm massager mounted to the armrest;

wherein the armrest has a detachable member that is movable along the longitudinal direction of the armrest;

wherein the connecting portion of the forearm massager is configured to be detachably connected with the detachable member, and the forearm massager is movable along the longitudinal direction of the armrest with the connecting portion connected with the detachable member;

wherein the armrest has a slit extending along the longitudinal direction of the armrest below the support portion, the detachable member is provided in the slit, and the connecting portion and the detachable member are connected with each other via the slit; and wherein the detachable member is movable within a range of the slit.

2. The massaging apparatus according to claim 1, further comprising a lock mechanism configured to fix the forearm massager to the armrest.

3. The massaging apparatus according to claim 1, further comprising:

a backrest configured to support an upper half body of the user;

a reclining angle change means configured to change a reclining angle of the backrest; and a control circuit, wherein the armrest has a moving means configured to move the detachable member in the longitudinal direction of the armrest; and wherein the control circuit is configured to control, in synchronization with a change of the reclining angle of the backrest by the reclining angle change means, an operation of the moving means so that the moving means causes the forearm massager to move in a direction according to a reclining direction of the backrest and by a distance corresponding to the reclining angle.

4. A massaging apparatus having a chair-like construction configured to be capable of saudwiching and releasing an arm portion of a user and to be capable of giving pressure stimulation to the sandwiched arm portion of the user, the apparatus comprising:

an armrest having a support portion at an upper portion thereof that is configured to support a forearm of the user;

a forearm massager that is removably mounted to the armrest and that has a connecting portion connected with the armrest in a position below the support portion and a forearm massaging portion that is configured to give pressure stimulation to the forearm of the user with the forearm sandwiched;

a massaging portion that is expandable and contractible by air intake and air exhaust; and an air supply and exhaust device;

wherein the forearm massager is laterally mounted to the armrest from a side, and the forearm massaging portion is located above the support portion of the armrest with the forearm massager mounted to the armrest;

wherein the armrest has a detachable member that is movable along the longitudinal direction of the armrest;

wherein the connecting portion of the forearm massager is configured to be detachably connected with the detachable member, and the forearm massager is movable alone the longitudinal direction of the armrest with the connecting portion connected with the detachable member;

wherein the connecting portion has a plug through which the air is guided to the massaging portion; and wherein the detachable member has a socket that is connected with the plug with the connecting portion of the forearm massager connected with the detachable member, and the air is sent from the air supply and exhaust device through the plug.

5. The massaging apparatus according to claim 4, wherein the forearm massager further comprises:

a fix and support portion configured to support the forearm of the user with the forearm massager attached to the armrest;

a pressing portion configured to move close to and away from the fix and support portion and configured to cooperate with the fix and support portion to sandwich the forearm of the user supported on the fix and support portion; and an actuator configured to move the pressing portion to be close to and away from the fix and support portion;

wherein the massaging portion is provided at a part of the pressing portion which is opposed to the fix and support portion; and wherein the massaging portion has two air bags arranged in a direction crossing the longitudinal direction of the armrest; and the massaging apparatus further comprises:

a control circuit configured to control:

an operation of the actuator to cause the pressing portion to move close to the fix and support portion to thereby allow the forearm of the user supported on the fix and support portion to be sandwiched between the fix and support portion and the pressing portion;

then an operation of the massaging portion to cause the two air bags to be expanded to allow the forearm of the user sandwiched between the fix and support portion and the pressing portion to be sandwiched in the direction crossing the longitudinal direction of the armrest; and then an operation of the actuator to cause the pressing portion to move away from the fix and support portion to thereby allow the two air bags sandwiching the forearm of the user to move away from the forearm of the user.

* * * * *